US009884260B2

(12) United States Patent
Weisman et al.

(10) Patent No.: US 9,884,260 B2
(45) Date of Patent: Feb. 6, 2018

(54) WATER TOY

(71) Applicant: GLOBAL MARKETING ENTERPRISE (GME) LTD., Tel Aviv (IL)

(72) Inventors: Zafrira Weisman, Tel Aviv (IL); Israel Zanger, Tel Aviv (IL)

(73) Assignee: GLOBAL MARKETING ENTERPRISE (GME) LTD., Tel Aviv (IL)

( * ) Notice: Subject to any disclaimer, the term of this patent is extended or adjusted under 35 U.S.C. 154(b) by 0 days.

(21) Appl. No.: 15/307,312

(22) PCT Filed: Sep. 10, 2015

(86) PCT No.: PCT/IL2015/050934

§ 371 (c)(1),
(2) Date: Oct. 27, 2016

(87) PCT Pub. No.: WO2016/038618

PCT Pub. Date: Mar. 17, 2016

(65) Prior Publication Data

US 2017/0173483 A1 Jun. 22, 2017

Related U.S. Application Data

(60) Provisional application No. 62/048,670, filed on Sep. 10, 2014.

(51) Int. Cl.
*A63H 23/16* (2006.01)

(52) U.S. Cl.
CPC ..... *A63H 23/16* (2013.01)

(58) Field of Classification Search
USPC ..... 473/153, 156, 157, 160, 163, 173, 174, 473/429, 430, 433, 444–448, 473
See application file for complete search history.

(56) References Cited

U.S. PATENT DOCUMENTS 2,511,323 A * 6/1950 Briggs ..... A63H 23/06 446/163
4,205,785 A 6/1980 Stanley
4,223,894 A 9/1980 Fabricant
(Continued)

FOREIGN PATENT DOCUMENTS

CN 203736849 7/2014
CN 104068769 10/2014
(Continued)

OTHER PUBLICATIONS

International Search Report & Written Opinion for PCT/IL2015/050934, dated Jan. 8, 2016.
(Continued)

*Primary Examiner* — Nini Legesse
(74) *Attorney, Agent, or Firm* — McDonnell Boehnen Hulbert & Berghoff LLP

(57) ABSTRACT

A bath toy system including a water play space delimiter arranged to be located in a water-filled bath and to define a water play space separate from a remainder of the water filled bath, a water spray assembly generating at least one water spray within the water play space and at least one floatable fanciful element floatable on the water within the water play space.

19 Claims, 53 Drawing Sheets

(56) References Cited

U.S. PATENT DOCUMENTS

| | | | | |
|---|---|---|---|---|
| 4,235,378 | A | 11/1980 | Melin et al. | |
| 4,496,329 | A | 1/1985 | Kubiatowicz | |
| 4,846,751 | A * | 7/1989 | Kosoris | A63H 33/28 446/160 |
| 5,503,597 | A | 4/1996 | Lochtefeld et al. | |
| 5,918,809 | A | 7/1999 | Simmons | |
| 6,012,960 | A | 1/2000 | Lee | |
| 6,375,090 | B1 | 4/2002 | Noorolah | |
| 6,561,914 | B2 | 5/2003 | Henry | |
| 6,652,348 | B2 | 11/2003 | Yen | |
| 6,782,567 | B1 | 8/2004 | Austin et al. | |
| 7,597,559 | B2 | 10/2009 | Shteinberg | |
| 7,703,696 | B2 | 4/2010 | Eddins et al. | |
| 8,221,184 | B2 * | 7/2012 | Nuttall | A63H 18/028 446/153 |
| 8,821,304 | B2 | 9/2014 | Ensing | |
| 2006/0143818 | A1 | 7/2006 | Bickmore et al. | |
| 2006/0208101 | A1 | 9/2006 | DeBoer et al. | |
| 2007/0037470 | A1 | 2/2007 | Rothan | |
| 2013/0061384 | A1 | 3/2013 | Robertson | |
| 2013/0181067 | A1 | 7/2013 | Todokoro | |

FOREIGN PATENT DOCUMENTS

| | | |
|---|---|---|
| DE | 3837818 | 5/1990 |
| DE | 4126413 | 2/1993 |
| FR | 2915689 | 11/2008 |
| JP | H0420367 | 1/1992 |
| WO | 1990/14142 | 11/1990 |
| WO | 2016/038618 | 3/2016 |

OTHER PUBLICATIONS

The International Search Report with Written Opinion for PCT/IL2015/050934, dated Dec. 15, 2015, pp. 1-16.

* cited by examiner 400
414
420
406
410
416
402
B 454
454
454
454
454
462
D
D
468
464
466
466
450
480

454
472
470
C
C
468
464
466
466
450
462
480

948
946
944
934
940
942
932
939
936
938
930

910
900
920
930
922
928
904
926
915
905
928
925
905

1400
1452
1412
1405
1440
1430
1426
1412
1406
1440
1452
1412
1426
1430
1402
1470
1404

1400
1452
1412
1440
E
1430
1426
F
1412
1480
1440
1452
1464
1412

1452
1412
1426
E
F
1430
1406
1470
1402
1405
1404

1400
1412
1412
1460
1462
1480
1405
1470
1406
1402
1404

1400
1412
1412
1464
1464
1464
1464
1412
1412
1480
1470
1406
1402
1404
1405

WATER TOY

REFERENCE TO RELATED APPLICATIONS

This application is a U.S. national phase of International Application No. PCT/IL2015/050934, filed on Sep. 10, 2015, which claims priority to U.S. Provisional Application No. 62/048,670, filed Sep. 10, 2014, both of which are incorporated by reference herein in their entirety.

FIELD OF THE INVENTION

The present invention relates to water toys for young children.

BACKGROUND OF THE INVENTION

Various types of water toys are known.

SUMMARY OF THE INVENTION

The present invention seeks to provide improved water toys particularly suitable for young children.

There is thus provided in accordance with a preferred embodiment of the present invention a bath toy system including a water play space delimiter arranged to be located in a water-filled bath and to define a water play space separate from a remainder of the water filled bath, a water spray assembly generating at least one water spray within the water play space and at least one floatable fanciful element floatable on the water within the water play space.

Preferably, the water play space delimiter is a floating water play space delimiter and the at least one water spray includes at least one water spray including a non-radial component in a plane of the delimiter within the water play space and impinging at least intermittently on the at least one floatable fanciful element, thereby causing rotational displacement of the delimiter and the at least one floatable fanciful element in mutually opposite directions. Additionally or alternatively, the water spray assembly has a water inlet drawing water from a location within the water-filled bath but outside the water play space.

There is also provided in accordance with another preferred embodiment of the present invention a bath toy system including at least one floatable fanciful element floatable on water within a water-filled water play space and a floatable and rotatable water spray assembly generating at least one water spray including a non-radial component in a plane defined by the water spray assembly within the water-filled water play space and impinging at least intermittently on the at least one floatable fanciful element, thereby causing rotational displacement of the water spray assembly and the at least one floatable fanciful element in mutually opposite directions.

In accordance with a preferred embodiment of the present invention the at least one floatable fanciful element is selectably placeable in water spray receiving engagement with the water spray assembly and is operative to convert a water spray having a first spatial configuration received at at least a first location thereat to a water spray having a second spatial configuration emitted at at least a second location thereat which is different from the first spatial configuration. Additionally, the water spray assembly generates the at least one water spray above a water level within the water play space, the water spray assembly also generates at least a second water spray, the plurality of floatable fanciful elements are floatable on the water within the water-filled water play space and are intermittently impinged by the at least a second water spray and each of the plurality of mutually differently fanciful spray modulating objects define at least one generally vertical water spray traversal channel extending from the first location to the at least a second location.

There is further provided in accordance with yet another preferred embodiment of the present invention a bath toy system including a water spray assembly generating at least one water spray within an at least partially water-filled water play space and at least one floating, unsinkable and unlistable fanciful spray modulating object which is selectably placeable in water spray receiving engagement with the water spray assembly and which is operative to convert a water spray having a first spatial configuration received at at least a first location thereat to a water spray having a second spatial configuration emitted at at least a second location thereat which is different from the first spatial configuration.

There is even further provided in accordance with still another preferred embodiment of the present invention a bath toy system including a water spray assembly generating at least one water spray within an at least partially water-filled water play space and at least one self-rotatable fanciful spray modulating object which is selectably placeable in water spray receiving engagement with the water spray assembly and which is operative to self-rotate when placed in operative engagement with the at least one water spray and to convert a water spray having a first spatial configuration received at at least a first location thereat to at least one first water spray having a second spatial configuration emitted at at least a second location thereat which is different from the first spatial configuration and at least one second water spray directed so as to produce rotation of the object.

Preferably, the water play space defines an endless loop and the at least one fanciful spray modulating object is floatable in the at least partially water-filled water play space defining an endless loop and is drivable by at least one water spray generated by the water spray assembly in looped motion along the endless loop. Additionally or alternatively, the at least one fanciful element includes a plurality of fanciful elements, the plurality of fanciful elements including at least one of a plurality of mutually differently fanciful spray modulating objects and a plurality of floatable fanciful spray modulating objects in which each of the plurality of fanciful spray modulating objects produce a water spray having a spatial configuration which is different from that produced by another one of the plurality of fanciful spray modulating objects.

In accordance with a preferred embodiment of the present invention the water spray assembly is adapted to be floating and to be operative for generating at least one water spray impinging at least intermittently on at least one floatable fanciful element, thereby causing rotational displacement of the water spray assembly delimiter and the at least one floatable fanciful element in mutually opposite directions.

Preferably, the bath toy system also includes a child-operable joy stick controlling multiple operational parameters of the water spray assembly.

There is also provided in accordance with a further preferred embodiment of the present invention a bath toy system including a water spray assembly generating at least one water spray within an at least partially water-filled water play space and a child-operable joy stick controlling multiple operational parameters of the water spray assembly.

In accordance with a preferred embodiment of the present invention the bath toy system also includes a multimedia generator providing at least one of audible and visually sensible outputs and the child-operable joy stick also governs the operation of the multimedia generator.

Preferably, the child-operable joy stick is operative to select at least one of a pulsed or a continuous water spray, a time pattern of at least pulsed sprays of varying amplitude and an amplitude of a water spray produced by the water spray assembly.

In accordance with a preferred embodiment of the present invention the bath toy system also includes a spray parameter linked sound and light generating system operative to provide audible and visual outputs in time coordination with at least one operational parameter of the water spray assembly.

BRIEF DESCRIPTION OF THE DRAWINGS

The present invention will be understood and appreciated more fully from the following detailed description in which.

DETAILED DESCRIPTION OF PREFERRED EMBODIMENTS

It is appreciated that the terms 'water filled bath' and 'water filled bath region', as used in the description of the present invention, are not limited to water found in a bathtub and may include any body of water or water filled receptacle, including, but not limited to, a bathtub, a swimming pool and a beach.

Figure 1A:
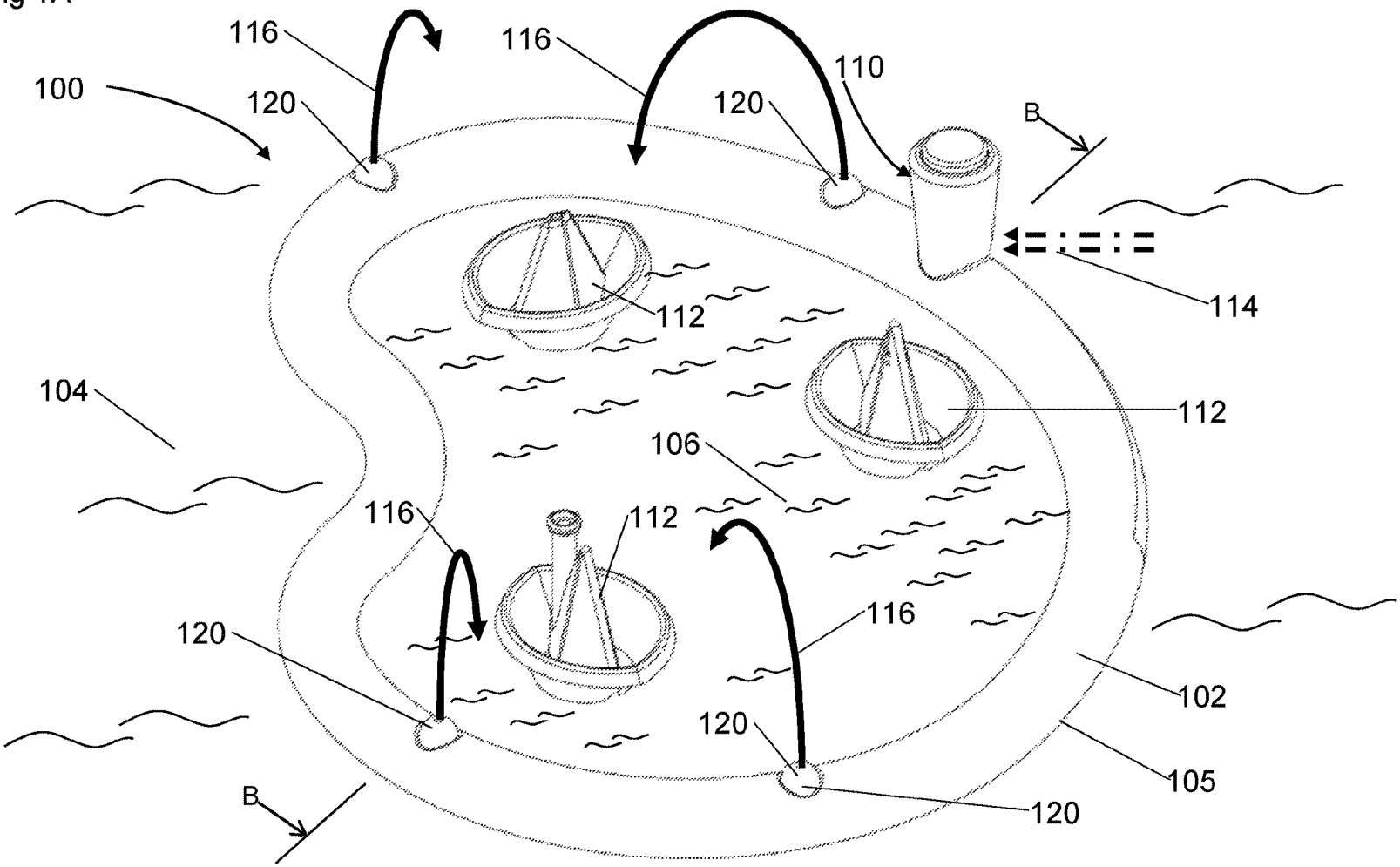
FIGS. 1A and 1B are simplified, respective pictorial and functional illustrations of a water toy constructed and operative in accordance with an embodiment of the present invention, FIG. 1B being taken along lines B-B in FIG. 1A.
Figure 1B:
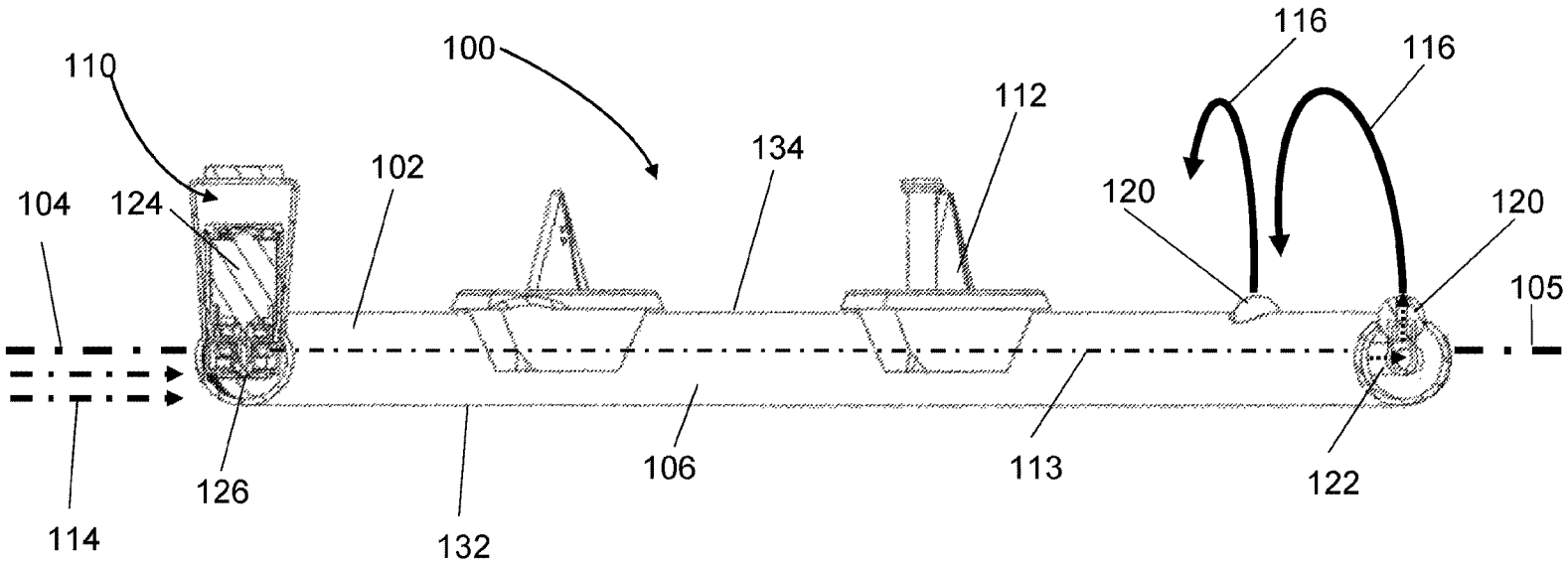

Reference is now made to FIGS. 1A and 1B, which are simplified, respective pictorial and structural/functional illustrations of a water toy system constructed and operative in accordance with an embodiment of the present invention.

As seen in FIGS. 1A and 1B, there is provided a water toy system 100, preferably a bath toy, including a water play space delimiter preferably in the form of a ring like enclosure 102, preferably arranged to be located in a water-filled bath region 104, having a nominal water line 105, and to define a water play space 106 separate from a remainder of the water filled bath 104.

A water spray generating assembly 110 generates at least one water spray within the water play space 106 and at least one, and preferably a few, floatable fanciful elements, such as toy boats 112, are arranged to be floatable on water within the water play space 106.

In the illustrated embodiment, the water space delimiter may be a ring-like enclosure 102 of any suitable desired shape. It may be fixed in place, such as by being anchored to the bottom of a bathtub, or may float on the water in the bath. A principal function of the water space delimiter is to restrict the range of movement of the floatable fanciful elements, such as toy boats 112, to within a desired water play space, preferably in front of a child. Another function of the water space delimiter is to define a relatively calm water surface in the water play space. The water line 113 of the water play space may be the same as or different from the water line 105 of the bath region. In the illustrated embodiment of FIGS. 1A and 1B, it is the same.

The water spray generating assembly 110 is preferably built into the water play space delimiter and preferably draws water from outside the water play space 106 and outside the delimiter, as illustrated by arrows 114, and sprays the water into the water play space 106, as indicated by arrows 116. In the illustrated embodiment of FIGS. 1A & 1B, multiple water sprays are provided from multiple nozzles 120, which are coupled by piping 122 to an outlet of a battery-operated water pump 124 having a water inlet 126, all of which form part of the water spray generating assembly 110.

In the embodiment of FIGS. 1A & 1B, the water play space 106 may be considered to be of an area defined by the delimiter, here shown as ring-like enclosure 102, and of a depth below the water line 113, which is equal to at least the draft of the toy boats 112 in the water within that area. In the illustrated embodiment, the depth of the water play space 106 may be considered to be the depth to which the bottom surface of the delimiter extends, here designated by reference numeral 132, which is below the water line 105 of the bath region 104. The water play space 106 may be considered to extend above the water line 105 of the bath region 104 and above the water line 113 of the water play space, preferably to a height to which the top surface of the delimiter extends, here designated by reference numeral 134. Alternatively, the water play space may be considered to extend above height 134 to a maximum height reached by water sprays 116.

Figure 2A:
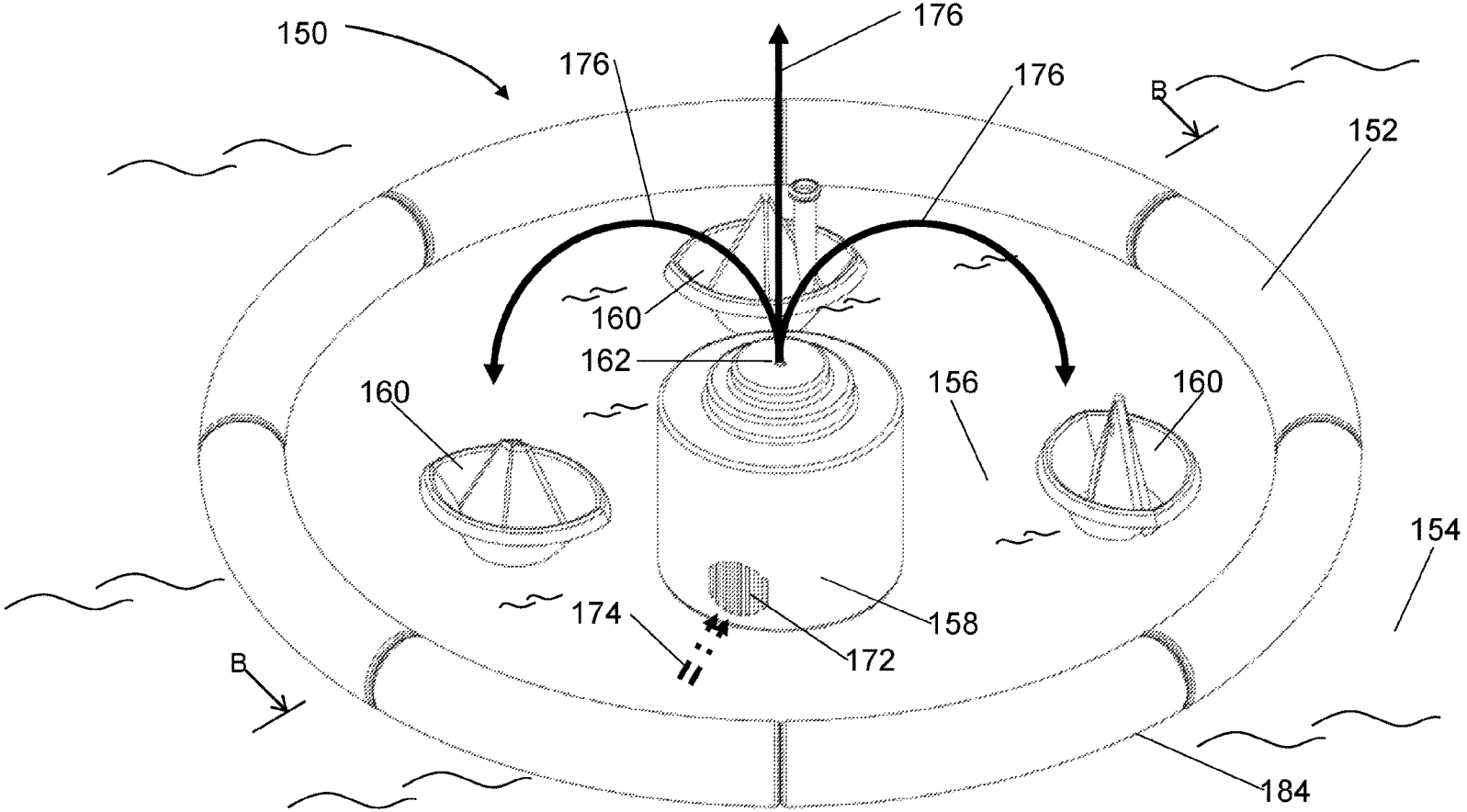
FIGS. 2A and 2B are simplified, respective pictorial and functional illustrations of a water toy constructed and operative in accordance with another embodiment of the present invention, FIG. 2B being taken along lines B-B in FIG. 2A.
Figure 2B:
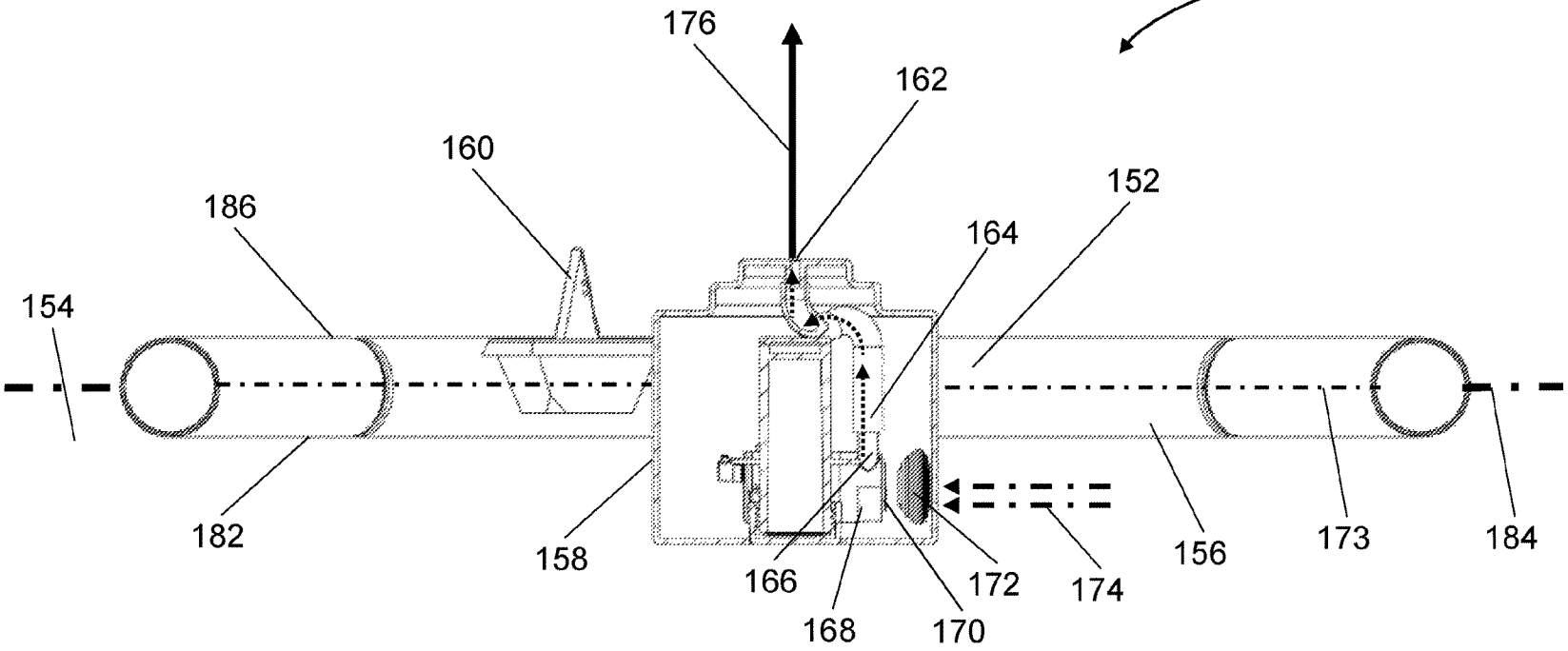

Reference is now made to FIGS. 2A and 2B, which are simplified, respective pictorial and structural/functional illustrations of a water toy system constructed and operative in accordance with another embodiment of the present invention.

As seen in FIGS. 2A and 2B, there is provided a water toy system 150, preferably a bath toy, including a water play space delimiter preferably in the form of a generally circular ring-like enclosure 152, preferably arranged to be located in a water-filled bath region 154 and to define a water play space 156 separate from a remainder of the water filled bath region 154.

A central water spray generating assembly 158 generates a central generally vertical water spray in the water play space 156 and at least one, and preferably a few, floatable fanciful elements, such as toy boats 160, are arranged to be floatable on water within the water play space 156.

In the illustrated embodiment, the water space delimiting ring-like enclosure 152 may be fixed in place, such as by being anchored to the bottom of a bathtub, or may float on the water in the bath. It may or may not be fixed to or physically attached to the central water spray generating assembly 158. As in the embodiment of FIGS. 1A & 1B, a principal function of the water space delimiter is to restrict the range of movement of the floatable fanciful elements to within a desired water play space, preferably in front of a child. Another function of the water space delimiter is to define a relatively calm water surface in the water play space.

In the embodiment of FIGS. 2A and 2B, the water spray generating assembly 158 is preferably separate from the water play space delimiter and sprays the water upwardly so that it falls within the water play space 156. In the illustrated embodiment of FIGS. 2A & 2B, the water spray generating assembly 158 includes a single nozzle 162, which is coupled by piping 164 to an outlet 166 of a battery-operated water pump 168 having a water inlet 170.

The water spray generating assembly 158 preferably draws water via water inlet 170 and a filter 172, which is preferably below the water line 173 of the water play space 156, but may be, as illustrated, within the area defined by the delimiting ring-like enclosure 152. The inlet water flow is indicated by arrows 174 and the outlet spray is indicated by arrows 176.

As in the embodiment of FIGS. 1A & 1B, here the water play space 156 may be considered to be of an area defined by the delimiter, here ring-like enclosure 152, and of a depth below the water line 173 equal to at least the draft of the toy boats 162 in the water within that area. In the illustrated embodiment the depth of the water play space 156 may be considered to be the depth to which the bottom surface of the delimiter extends, here designated by reference numeral 182, which is below the water line 184 of the bath region 154. The water play space 156 may be considered to extend above the water line 184 of the bath region 154 and above the water line 173 of the water play space, preferably to a height to which the top surface of the delimiter extends, here designated by reference numeral 186. Alternatively, the water play space may be considered to extend above height 186 to a maximum height reached by water spray 176.

Figure 3A:
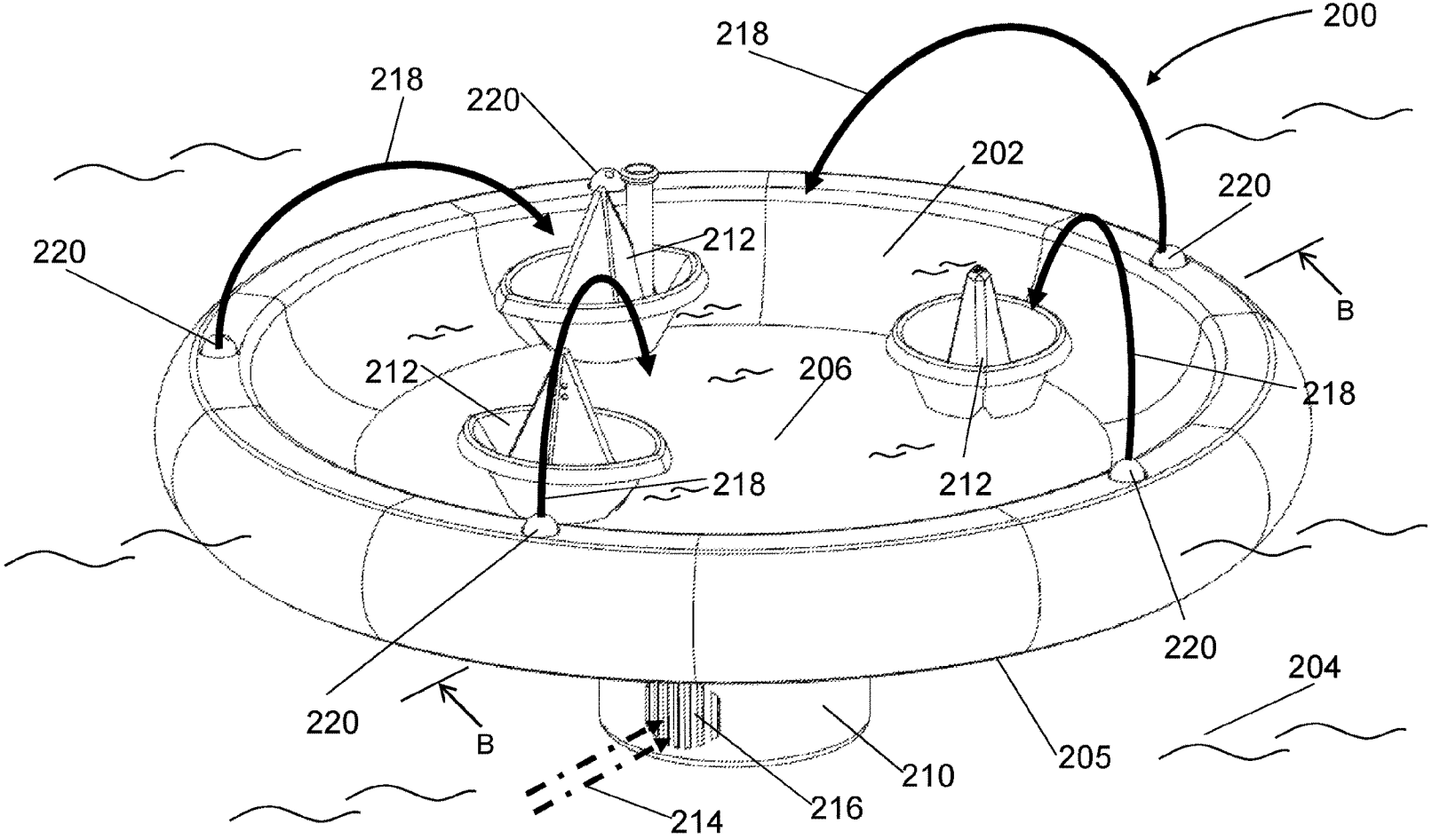
FIGS. 3A and 3B are simplified, respective pictorial and functional illustrations of a water toy constructed and operative in accordance with yet another embodiment of the present invention, FIG. 3B being taken along lines B-B in FIG. 3A.
Figure 3B:
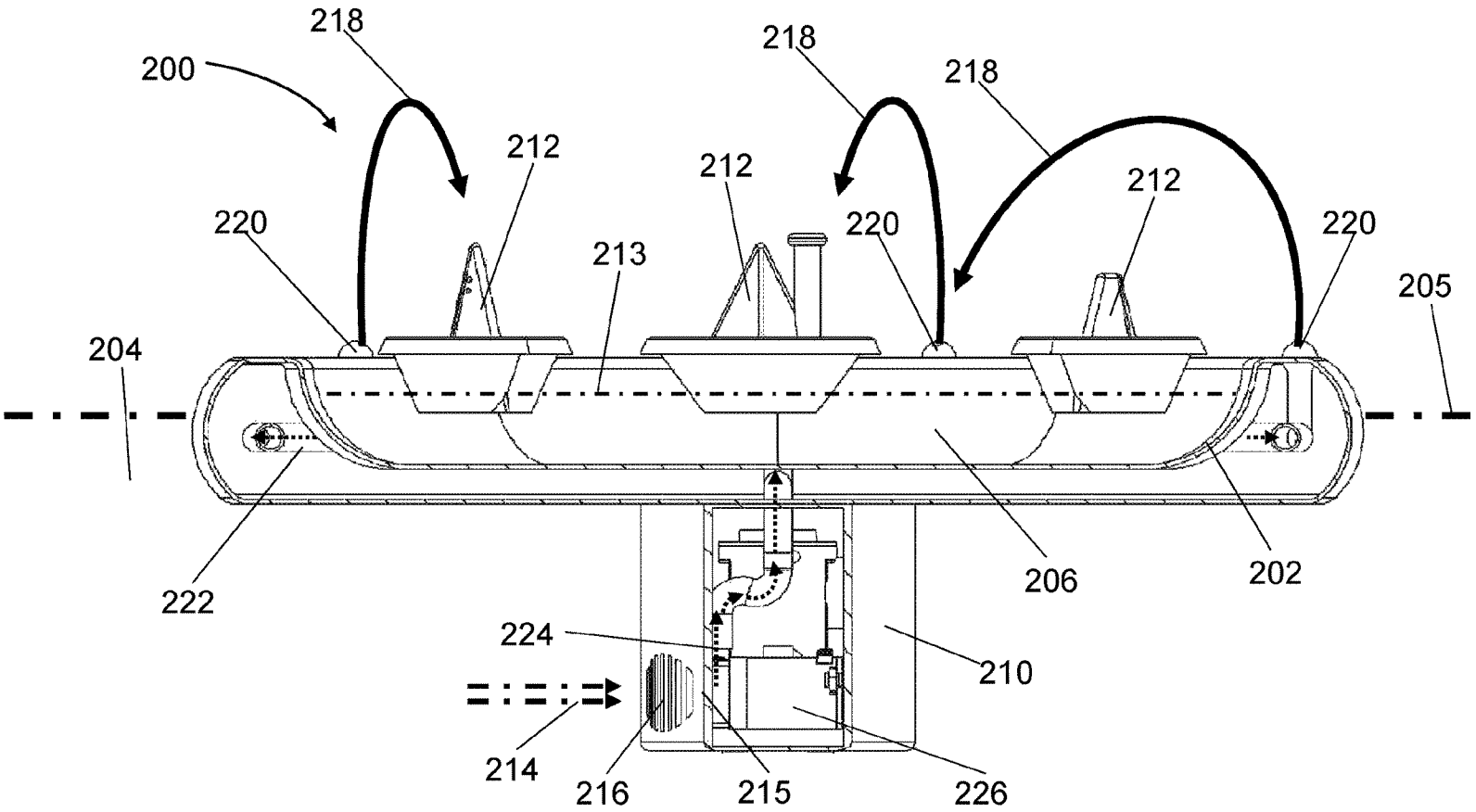

Reference is now made to FIGS. 3A and 3B, which are simplified, respective pictorial and structural/functional illustrations of a water toy system constructed and operative in accordance with yet another embodiment of the present invention.

As seen in FIGS. 3A and 3B, there is provided a water toy system 200, preferably a bath toy, including a water play space delimiter preferably in the general form of a bowl 202, preferably arranged to be located in a water-filled bath region 204, having a nominal water line 205, and to define an at least partially water-filled water play space 206 separate from a remainder of the water filled bath 204.

A water spray generating assembly 210 generates at least one water spray within the water play space 206 and at least one, and preferably a few, floatable fanciful elements, such as toy boats 212, are arranged to be floatable on water within the water-filled water play space 206.

In the illustrated embodiment, the water space delimiter may be a concave enclosure or bowl 202 of any suitable desired shape. It may be fixed in place, such as by being anchored to the bottom of a bathtub, or may float on the water in the bath region. A principal function of the water space delimiter is to restrict the range of movement of the floatable fanciful elements to within a desired water play space, preferably in front of a child. Another function of the water space delimiter is to define a relatively calm water surface in the water play space. In this embodiment, a further function of the delimiter is to raise the water play space to a height above that of the bath region 204, such that the water line 213 of the water play space is decoupled from the water line 205 of the bath region and may be above or below water line 205. In the illustrated embodiment, the water line 213 is seen to be above water line 205.

The water spray generating assembly 210 is preferably integrally formed with the delimiter and is located therebelow and at the center thereof. Water spray generating assembly 210 preferably draws water from outside the water play space 206 and below the delimiter, as illustrated by arrows 214, via a water inlet 215 and a filter 216, and sprays the water into the water play space 206, as indicated by arrows 218. In the illustrated embodiment of FIGS. 3A & 3B, multiple water sprays are provided from multiple nozzles 220, which are coupled by piping 222 to an outlet 224 of a battery-operated pump 226.

Figure 4A:
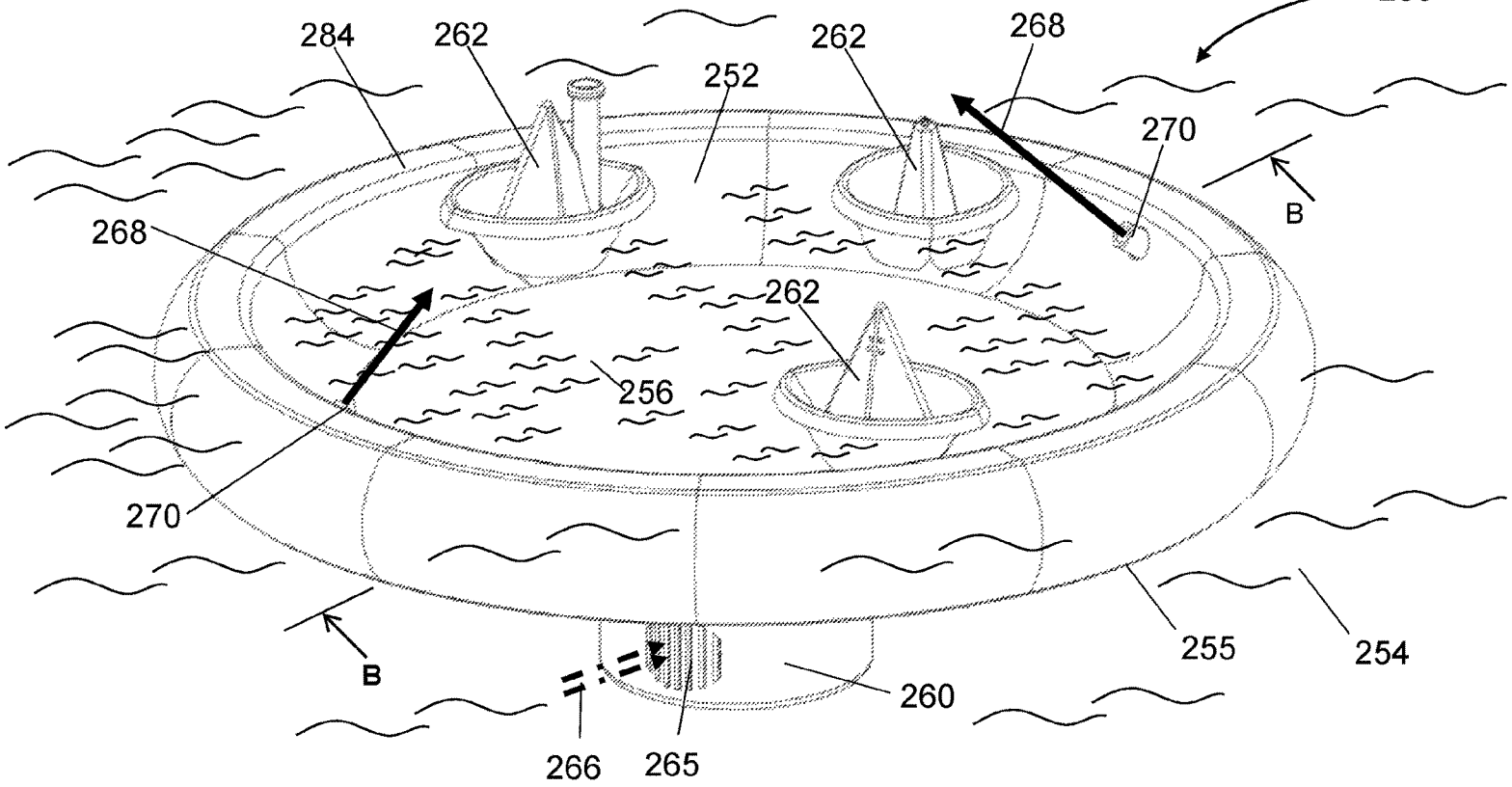
FIGS. 4A and 4B are simplified, respective pictorial and functional illustrations of a water toy constructed and operative in accordance with still another embodiment of the present invention, FIG. 4B being taken along lines B-B in FIG. 4A.
Figure 4B:
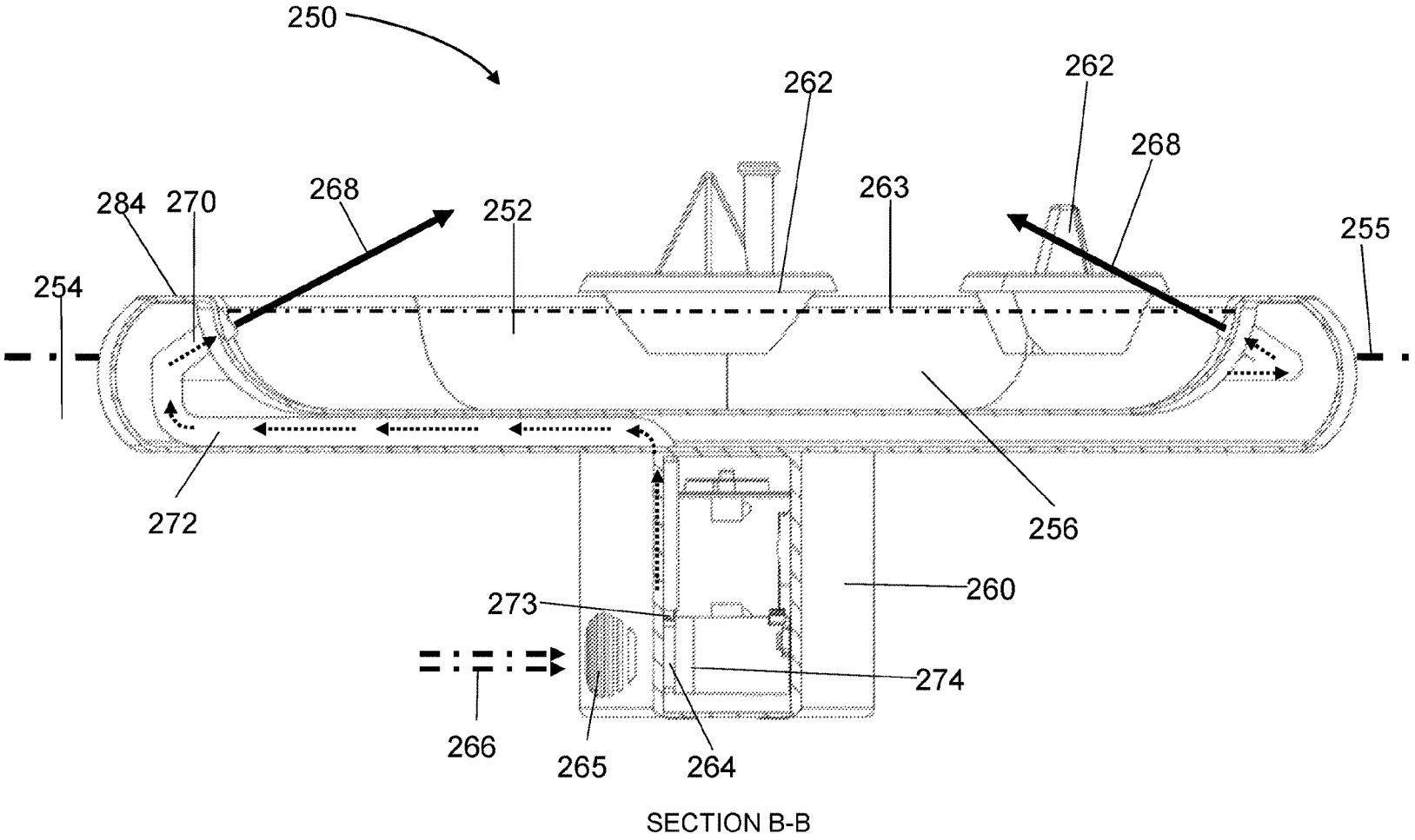

Reference is now made to FIGS. 4A and 4B, which are simplified, respective pictorial and structural/functional illustrations of a water toy system constructed and operative in accordance with still another embodiment of the present invention.

As seen in FIGS. 4A and 4B, there is provided a water toy system 250, preferably a bath toy, including a water play space delimiter, preferably in the general form of a bowl 252, preferably arranged to be located in a water-filled bath region 254, having a nominal water line 255, and to define an at least partially water-filled water play space 256, separate from a remainder of the water filled bath 254.

A water spray generating assembly 260 generates at least one water spray within the water play space 256 and at least one, and preferably a few, floatable fanciful elements, such as toy boats 262, are arranged to be floatable on water within the water-filled water play space 256.

In the illustrated embodiment, the water space delimiter may be a concave enclosure or bowl 252 of any suitable desired shape. It may be fixed in place, such as by being anchored to the bottom of a bathtub, or may float on the water in the bath region. A principal function of the water space delimiter is to restrict the range of movement of the floatable fanciful elements to within a desired water play space, preferably in front of a child. Another function of the water space delimiter is to define a relatively calm water surface in the water play space. In this embodiment, a further function of the delimiter is to raise at least part of the water play space 256 to a height above that of the bath region 254, such that the water line 263 of the water play space is decoupled from the water line 255 of the bath region and may be above or below water line 255. In the illustrated embodiment, the water line 263 is seen to be above water line 255.

The water spray generating assembly 260 is preferably integrally formed with the delimiter and is located therebelow and at the center thereof. Water spray generating assembly 260 preferably draws water via a water inlet 264 and a filter 265 from outside the water play space 256 and below the delimiter, as illustrated by arrows 266, and directs at least one stream of water into the water play space 256, as indicated by arrows 268.

As seen in the illustrated embodiment of FIGS. 4A & 4B, water streams are provided from at least one nozzle 270, which is coupled by piping 272 to the outlet 273 of a battery-operated water pump 274 which receives water via water inlet 264 and filter 265, all of which form part of the water spray generating assembly 260. It is appreciated that, while in the illustrated embodiment shown in FIGS. 4A & 4B the nozzle 270 is below water line 263, nozzle 270 may be below water line 263.

In the embodiment of FIGS. 4A & 4B, the water play space 256 is defined by the bowl 252 in area and in depth. The water play space 256 may be considered to extend above the water line 255 of the bath region 254 and above the water line 263 of the water play space, preferably to a height to which the top surface of the delimiter extends, here designated by reference numeral 284. Alternatively, the water play space may be considered to extend above height 284 to a maximum height reached by floatable elements 262.

Figure 5A:
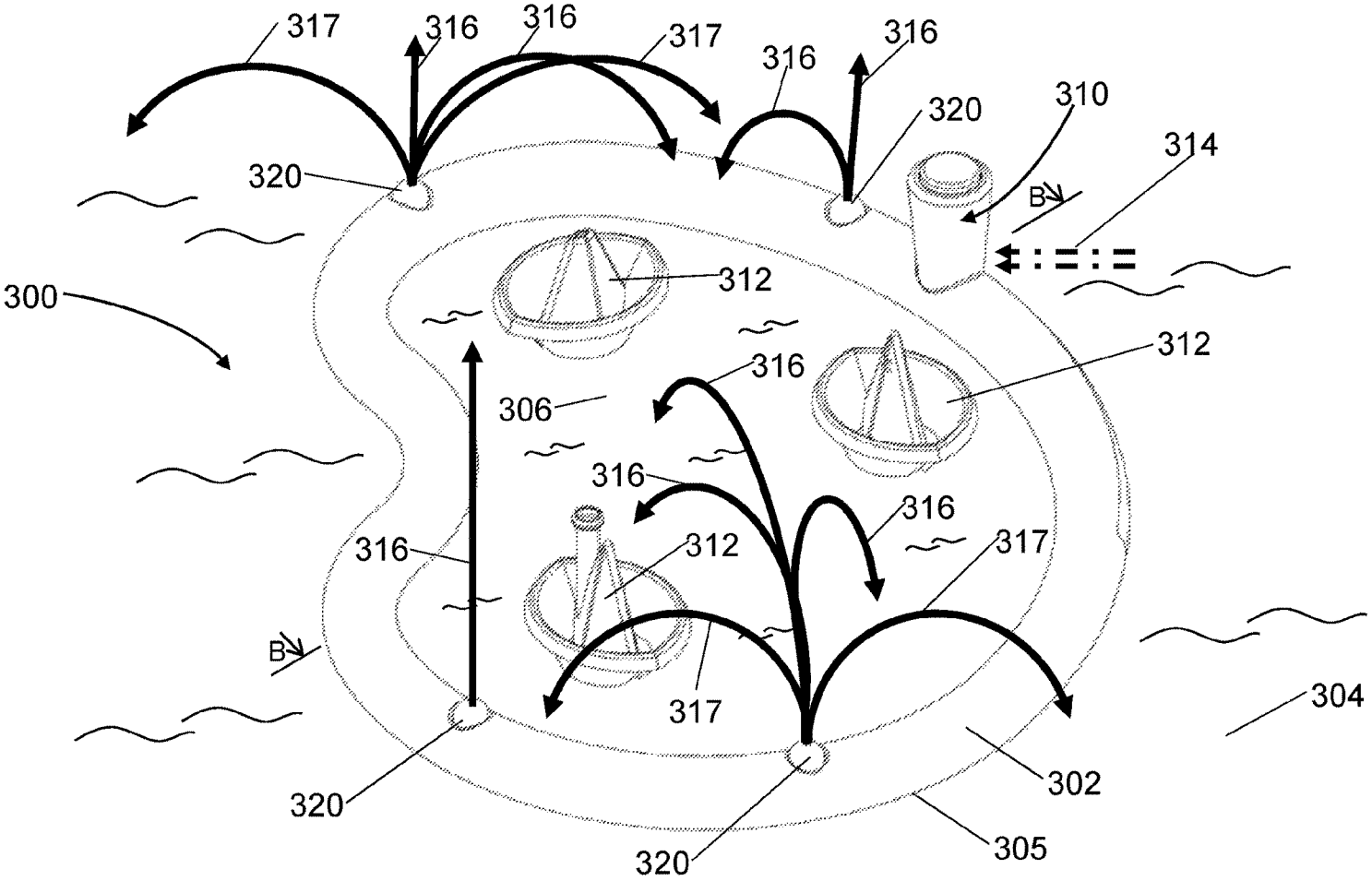
FIGS. 5A and 5B are simplified, respective pictorial and functional illustrations of a water toy constructed and operative in accordance with a further embodiment of the present invention, FIG. 5B being taken along lines B-B in FIG. 5A.
Figure 5B:
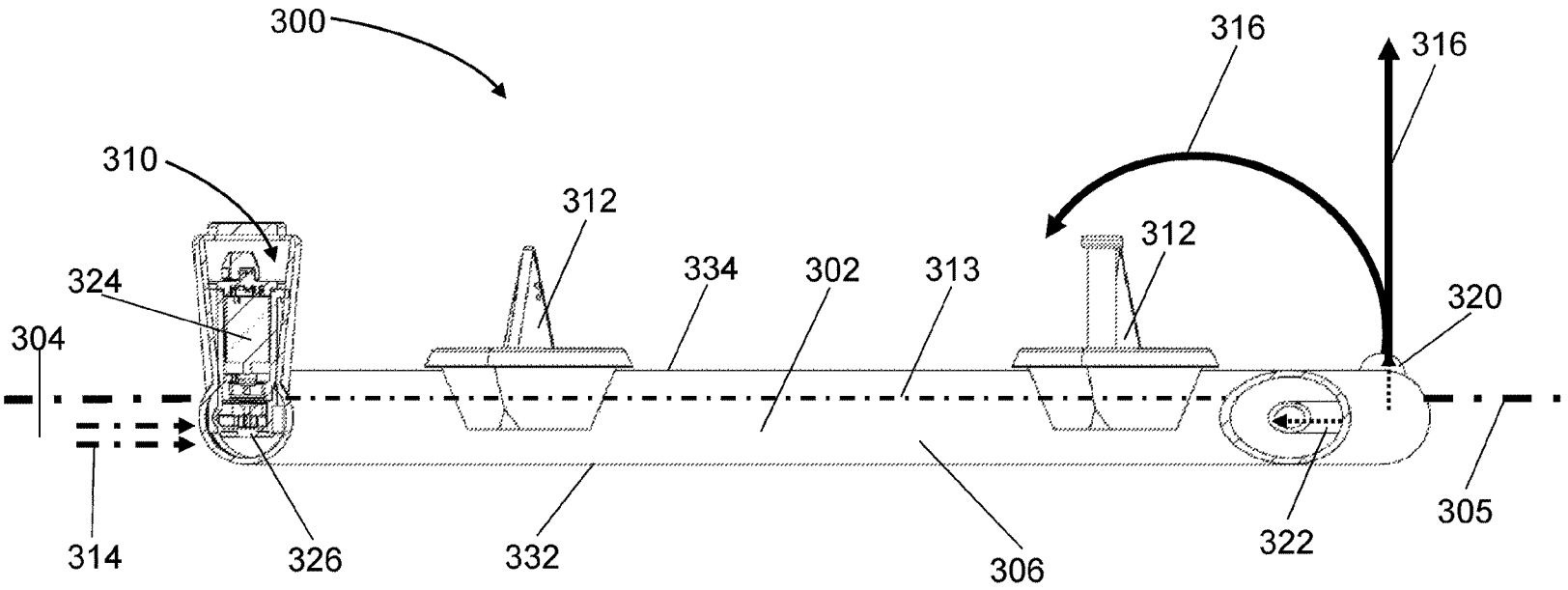

Reference is now made to FIGS. 5A and 5B, which are simplified, respective pictorial and structural/functional illustrations of a water toy system constructed and operative in accordance with a further embodiment of the present invention.

As seen in FIGS. 5A and 5B, there is provided a water toy system 300, preferably a bath toy, including a water play space delimiter preferably in the form of a ring-like enclosure 302, preferably arranged to be located in a water-filled bath region 304, having a nominal water line 305, and to define a water play space 306 separate from a remainder of the water filled bath 304.

A water spray generating assembly 310 generates at least one water spray within the water play space 306 and at least one, and preferably a few, floatable fanciful elements, such as toy boats 312, are arranged to be floatable on water within the water play space 306.

In the illustrated embodiment, the water space delimiter may be a ring enclosure 302 of any suitable desired shape. It may be fixed in place, such as by being anchored to the bottom of a bathtub, or may float on the water in the bath. A principal function of the water space delimiter is to restrict the range of movement of the floatable fanciful elements to within a desired water play space, preferably in front of a child. Another function of the water space delimiter is to define a relatively calm water surface in the water play space. In the illustrated embodiment, the water line 313 of the water play space 306 is the same as the water line 305 of the bath region 304.

The water spray generating assembly 310 is preferably built into the water play space delimiter and preferably draws water from outside the water play space 306 and outside the delimiter, as illustrated by arrows 314, and sprays the water into and outside the water play space 306, as indicated by arrows 316 and 317, respectively. In the illustrated embodiment of FIGS. 5A & 5B, multiple water sprays are provided in multiple directions from various nozzles 320, which are coupled by piping 322 to the outlet of a battery-operated water pump 324 having a water inlet 326, all of which form part of the water spray generating assembly 310.

In the embodiment of FIGS. 5A & 5B, the water play space 306 may be considered to be of an area defined by the delimiter, here ring enclosure 302, and of a depth below water line 313 equal to at least the draft of the toy boats 312 in the water within that area. In the illustrated embodiment the depth of the water play space 306 may be considered to be the depth to which the bottom surface of the delimiter extends, here designated by reference numeral 332, which is below the water line 305 of the bath region 304. The water play space 306 may be considered to extend above the water line 305 of the bath region 304 and above the water line 313 of the water play space 306, preferably to a height to which the top surface of the delimiter extends, here designated by reference numeral 334. Alternatively, the water play space 306 may be considered to extend above height 334 to a maximum height reached by water sprays 316 and 317.

Figure 6A:
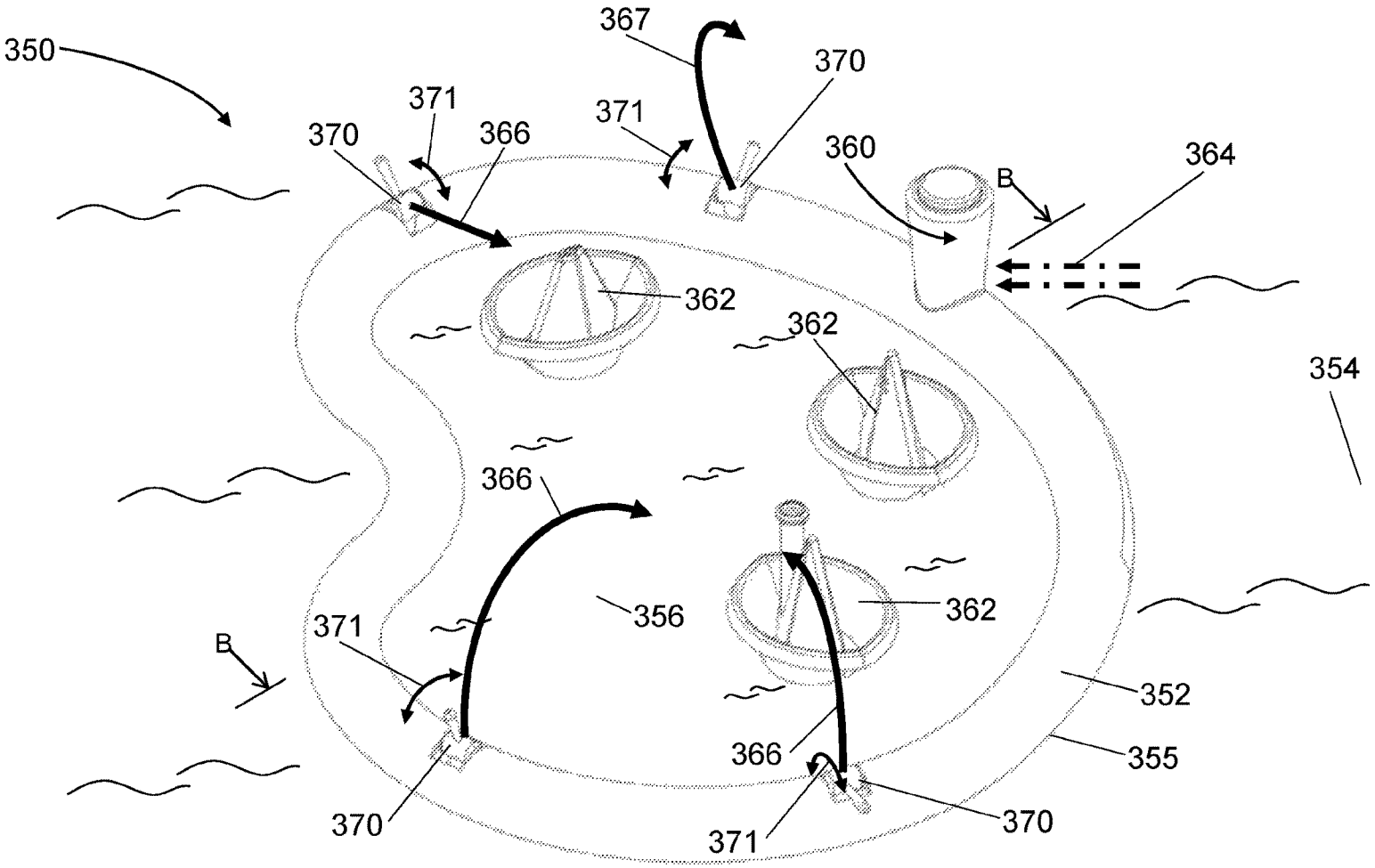
FIGS. 6A and 6B are simplified, respective pictorial and functional illustrations of a water toy constructed and operative in accordance with yet a further embodiment of the present invention, FIG. 6B being taken along lines B-B in FIG. 6A.
Figure 6B:
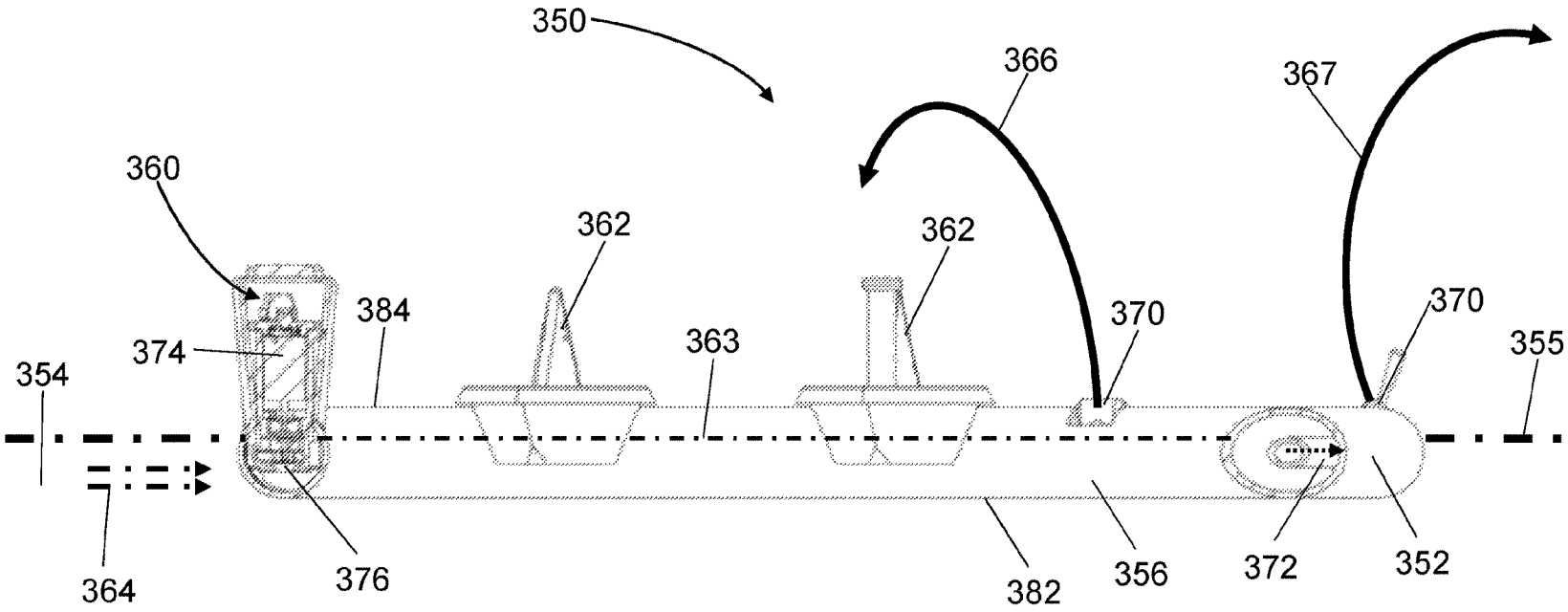

Reference is now made to FIGS. 6A and 6B, which are simplified, respective pictorial and structural/functional illustrations of a water toy system constructed and operative in accordance with a still further embodiment of the present invention.

As seen in FIGS. 6A and 6B, there is provided a water toy system 350, preferably a bath toy, including a water play space delimiter preferably in the form of a ring-like enclosure 352, preferably arranged to be located in a water-filled bath region 354, having a nominal water line 355, and to define a water-filled water play space 356 separate from a remainder of the water filled bath 354.

A water spray generating assembly 360 generates at least one water spray within the water play space 356 and at least one, and preferably a few, floatable fanciful elements, such as toy boats 362, are arranged to be floatable on water within the water-filled water play space 356.

In the illustrated embodiment, the water space delimiter may be a ring enclosure 352 of any suitable desired shape. It may be fixed in place, such as by being anchored to the bottom of a bathtub, or may float on the water in the bath. A principal function of the water space delimiter is to restrict the range of movement of the floatable fanciful elements to within a desired water play space, preferably in front of a child. Another function of the water space delimiter is to define a relatively calm water surface in the water play space 356. The water line 363 of the water play space 356 is here seen to be the same as the water line 355 of the bath region 354.

The water spray generating assembly 360 is preferably built into the water play space delimiter and preferably draws water from outside the water play space 356 and outside the delimiter, as illustrated by arrows 364, and sprays the water into and outside the water play space 356, as indicated by arrows 366 and 367, respectively. In the illustrated embodiment of FIGS. 6A & 6B, multiple selectably directionally variable water sprays are provided from various selectably directionally variable nozzles 370, as indicated by arrows 371, which are coupled by piping 372 to the outlet of a battery-operated water pump 374 having a water inlet 376, all of which form part of the water spray generating assembly 360.

In the embodiment of FIGS. 6A & 6B, the water play space 356 may be considered to be of an area defined by the delimiter, here ring enclosure 352, and of a depth of at least the draft of the toy boats 362 in the water within that area. In the illustrated embodiment, the depth of the water play space 356 may be considered to be the depth to which the bottom surface of the delimiter extends, here designated by reference numeral 382, which is below the water line 355 of the bath region 354. The water play space 356 may be considered to extend above the water line 355 of the bath region 354 and above the water line 363 of the water play space 356, preferably to a height to which the top surface of the delimiter extends, here designated by reference numeral 384. Alternatively, the water play space 356 may be considered to extend above height 384 to a maximum height reached by water sprays 366 and 367.

Figures 7A, 7B, 7C:
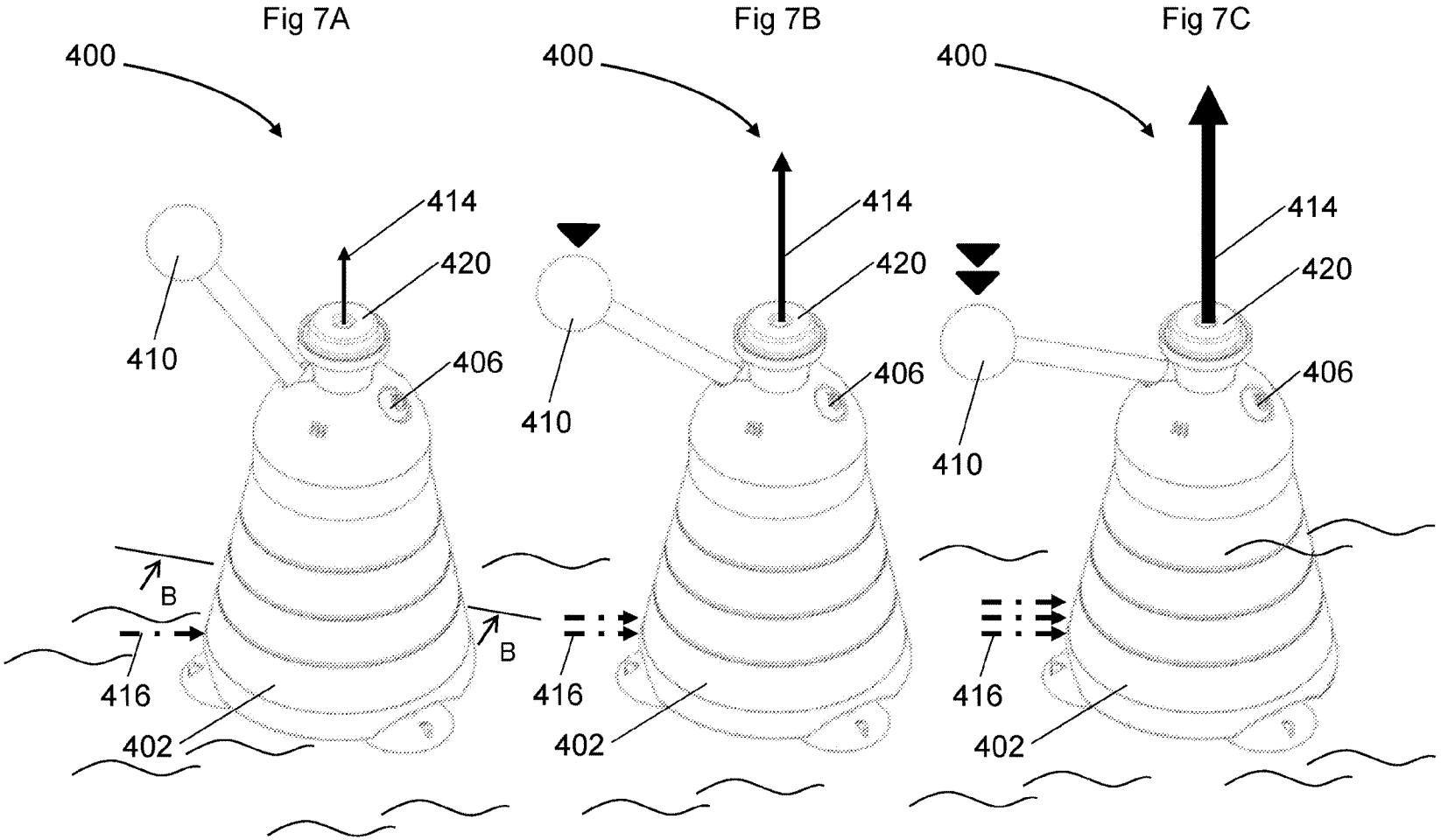
FIGS. 7A, 7B and 7C are simplified pictorial illustrations of three operative orientations of a joystick-operated water toy constructed and operative in accordance with a preferred embodiment of the invention.

Reference is now made to FIGS. 7A-7F, which are simplified illustrations of a joystick-operated water toy constructed and operative in accordance with a preferred embodiment of the invention. FIGS. 7A, 7B and 7C are simplified pictorial illustrations of three operative orientations of the joystick-operated water toy of FIGS. 7A-7F and FIGS. 7D, 7E and 7F are partially cut away illustrations with enlargements, which correspond thereto.

As seen in FIGS. 7A-7F, there is provided a joystick-operated water toy system 400, preferably a bath toy, including a fanciful housing 402, which encloses a water spray generating assembly 404, which generates at least one water spray within a water play space (not shown). In the illustrated embodiment, the housing 402 may be of any suitable desired shape. It may be fixed in place, such as by being anchored to the bottom of a bathtub, or may float on the water in a bath. An On/Off switch 406 is preferably mounted on the side of housing 402. A young child operable joystick 410 is pivotably mounted onto the housing 402 and operates a spray volume control button 412 (FIGS. 7D-7F) of a spray volume control valve 413, such that variation of the orientation of the joystick 410 produces a concomitant variation of the volume and/or height of a spray, here designated by reference numeral 414, produced by the water spray generating assembly 404.

The water spray generating assembly 404 is preferably mounted inside housing 402 and preferably draws water from outside the housing 402 as indicated by arrows 416. In the illustrated embodiment of FIGS. 7A-7F, preferably a single water spray 414 is provided from a nozzle 420, which is coupled by piping 422 via spray volume control valve 413, operated by spray volume control button 412, to the outlet of a battery-operated water pump 425 having a water inlet 426, all of which form part of the water spray generating assembly 404.

Alternatively, spray control button 412 may electronically control the operation of water pump 425 to vary the pump speed based on the orientation of joystick 410.

FIG. 7A shows the water toy of FIGS. 7A-7F in an ON state, preferably resulting from pressing on the On switch 406. The joystick 410 in an upwardly-most minimum spray operative orientation. FIG. 7B shows the water toy of FIGS. 7A-7F also in an ON state, with the joystick 410 in an intermediate spray operative orientation. FIG. 7C shows the water toy of FIGS. 7A-7F also in an ON state, with the joystick 410 in a downwardly-most, maximum spray operative orientation.

It is noted that On/Off functionality is preferably not provided by the joystick 410.

Figure 7D:
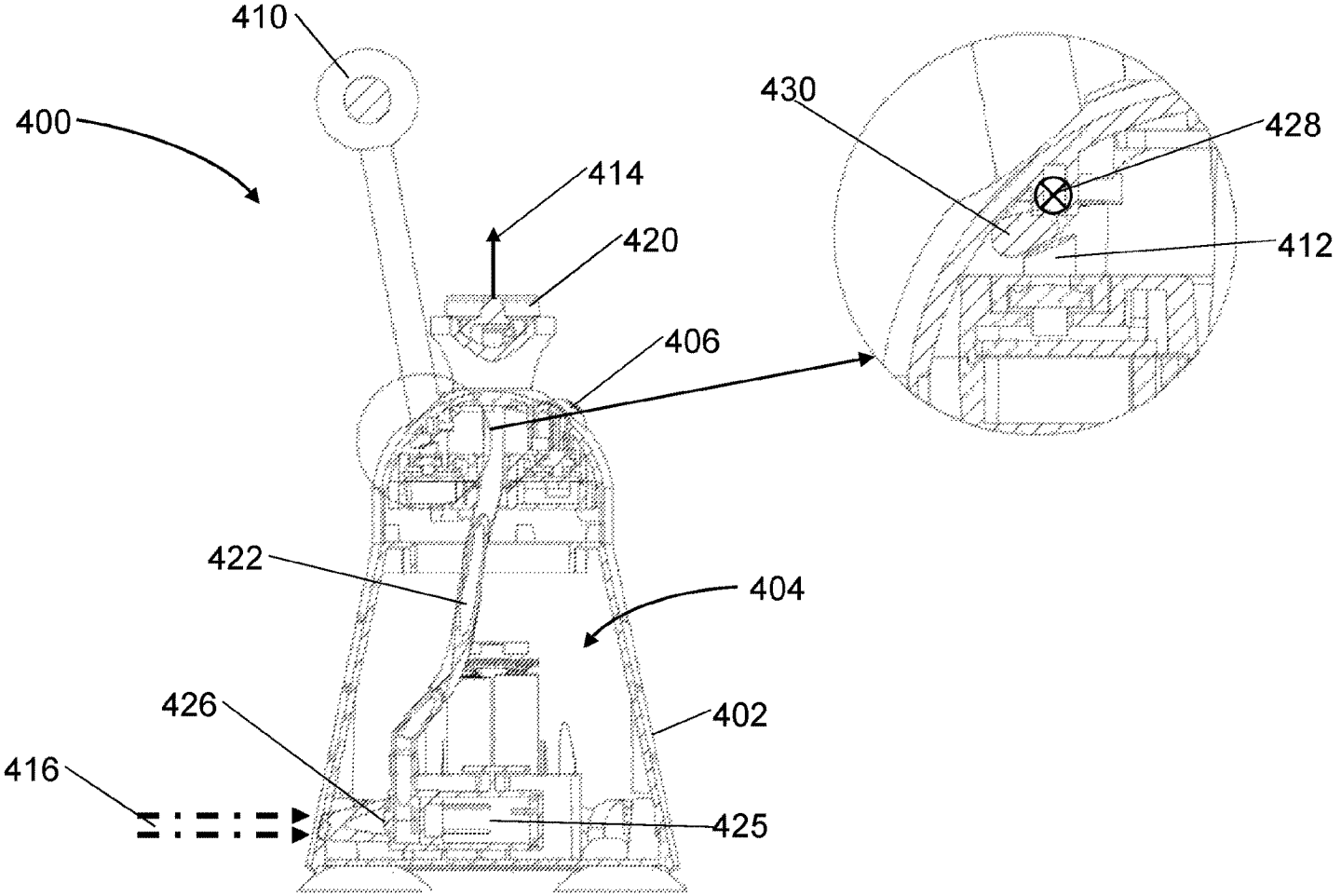
FIGS. 7D, 7E and 7F are enlarged illustrations of three operative orientations of a portion of the joystick operated toy, corresponding to the operative orientations shown in FIGS. 7A, 7B and 7C, respectively.
Figure 7E:
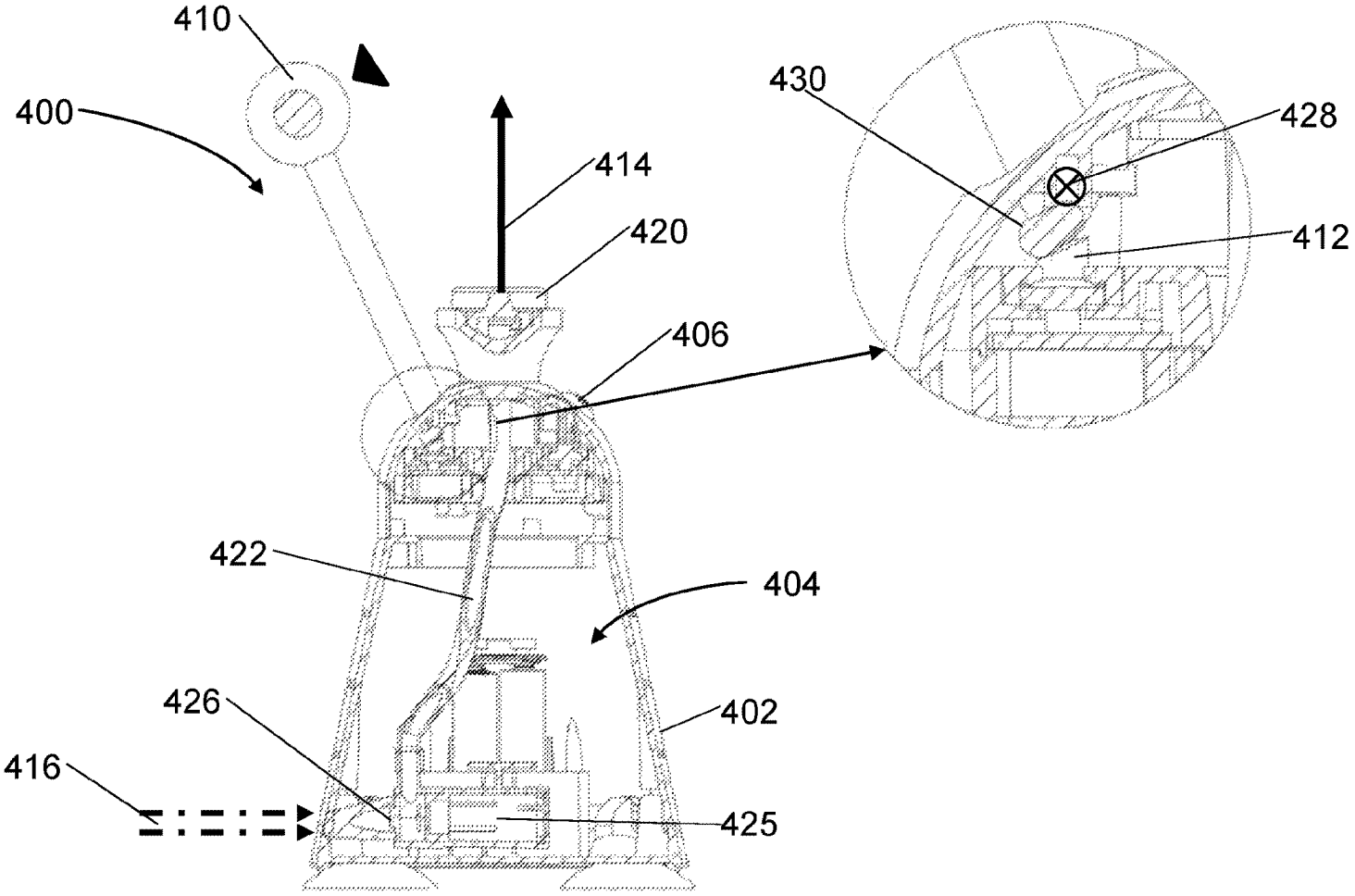
Figure 7F:
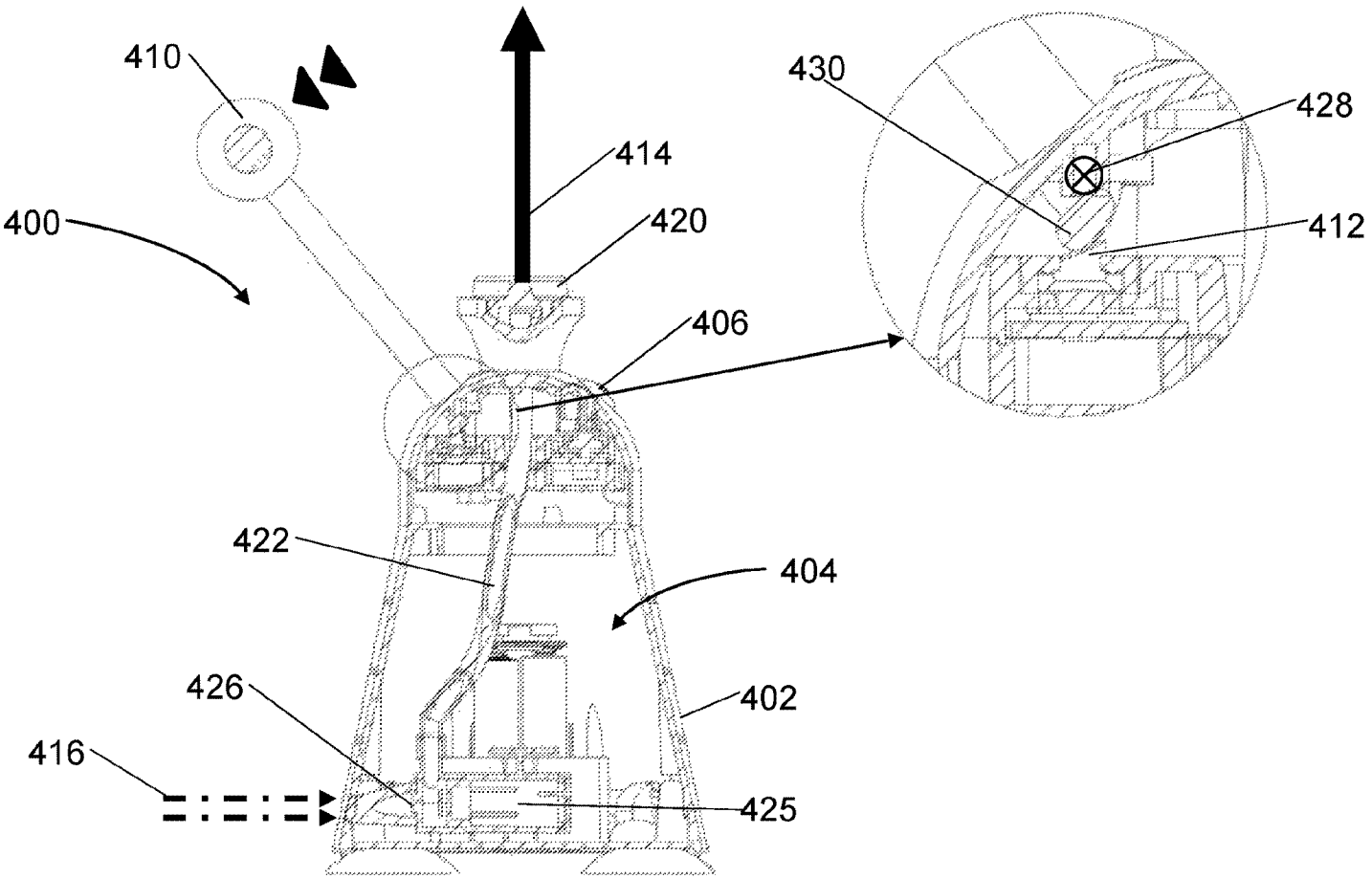

FIGS. 7A, 7B & 7C and corresponding FIGS. 7D, 7E & 7F illustrate the operation of the joystick 410. It is seen that when the joystick 410 is in an upper pivot position about a joystick pivot axis 428 fixed with respect to housing 402, as shown in FIGS. 7A and 7D, a relatively small spray is produced and a cam 430, fixed to joystick 410, does not depress spray volume control button 412. When the joystick 410 is in an intermediate pivot position about joystick pivot axis 428, as shown in FIGS. 7B and 7E, an intermediate volume spray is produced and cam 430, fixed to joystick 410, partially depresses spray volume control button 412. When the joystick 410 is in a fully lowered pivot position about joystick pivot axis 428, as shown in FIGS. 7C and 7F, a relatively strong, large volume spray is produced as cam 430 fixed to joystick 410 fully depresses spray volume control button 412.

Figures 8A, 8B:
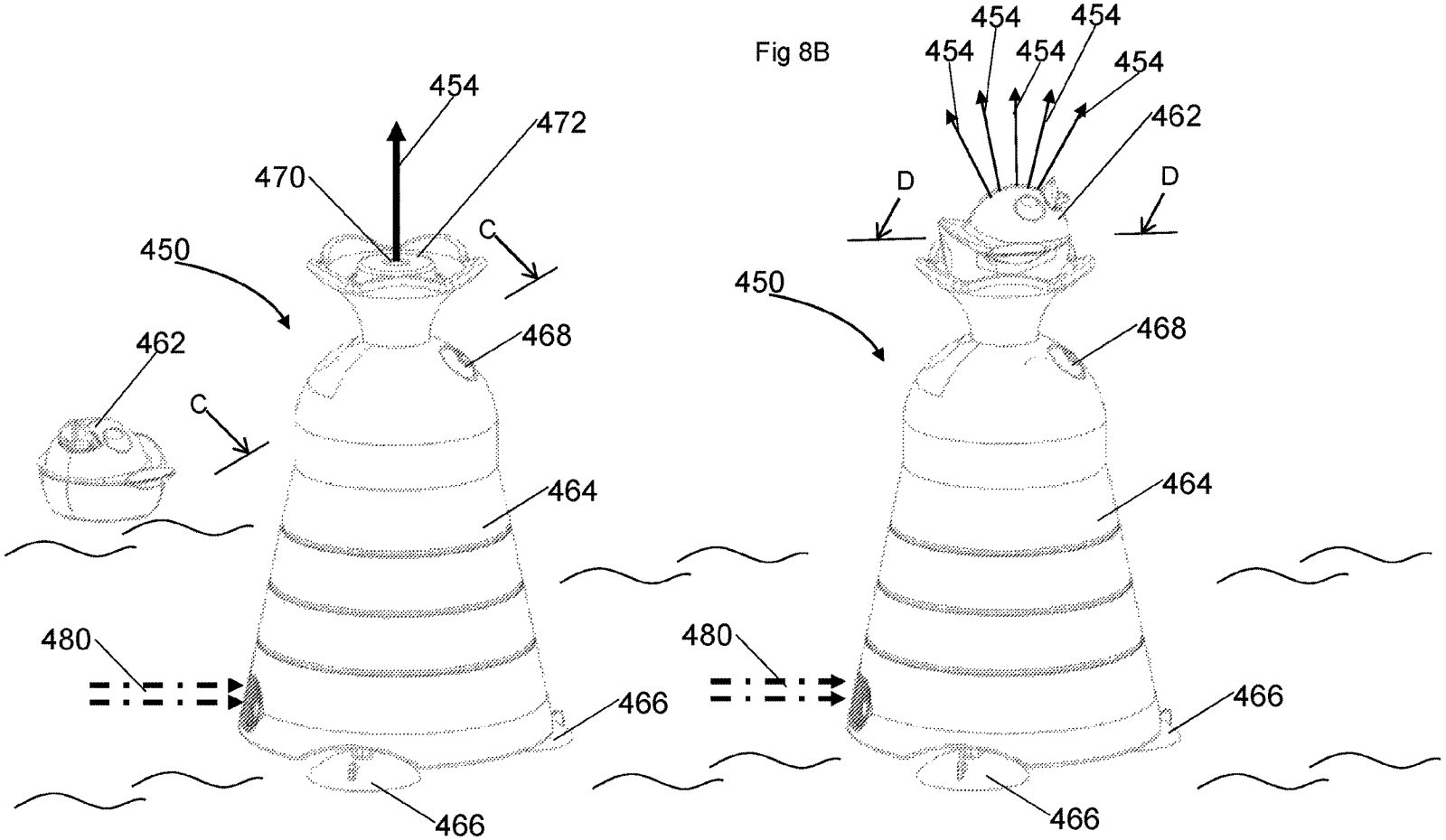
FIGS. 8A and 8B are simplified pictorial illustrations of two operative orientations of a changeable spray water toy system constructed and operative in accordance with a preferred embodiment of the invention.
Figure 8C:
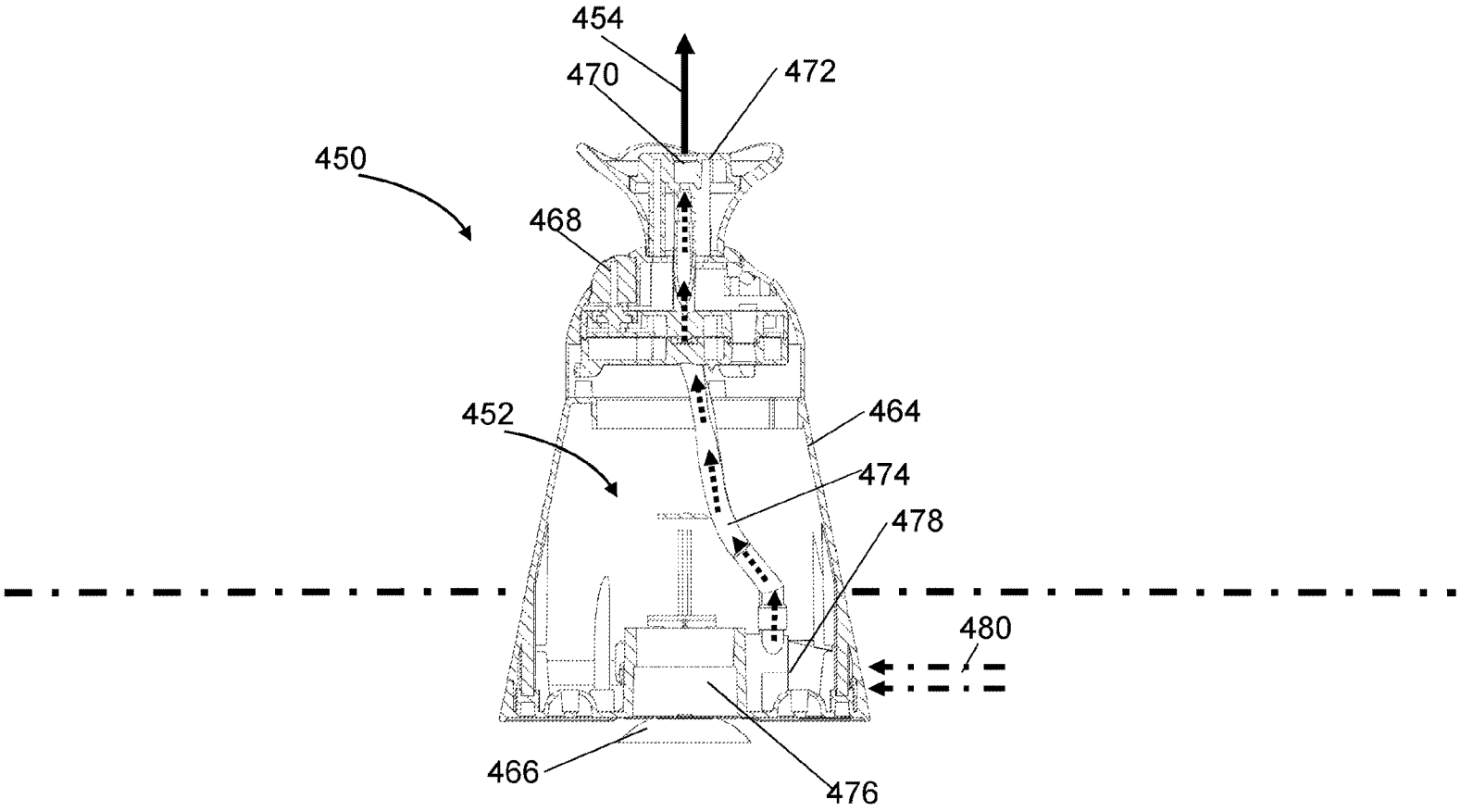
FIGS. 8C and 8D are simplified respective sectional illustrations of a spray generator and of a fanciful floatable spray configuration modulator forming parts of the changeable spray water toy system of FIGS. 8A & 8B, taken along respective section lines C-C in FIG. 8A and D-D in FIG. 8B.
Figure 8D:
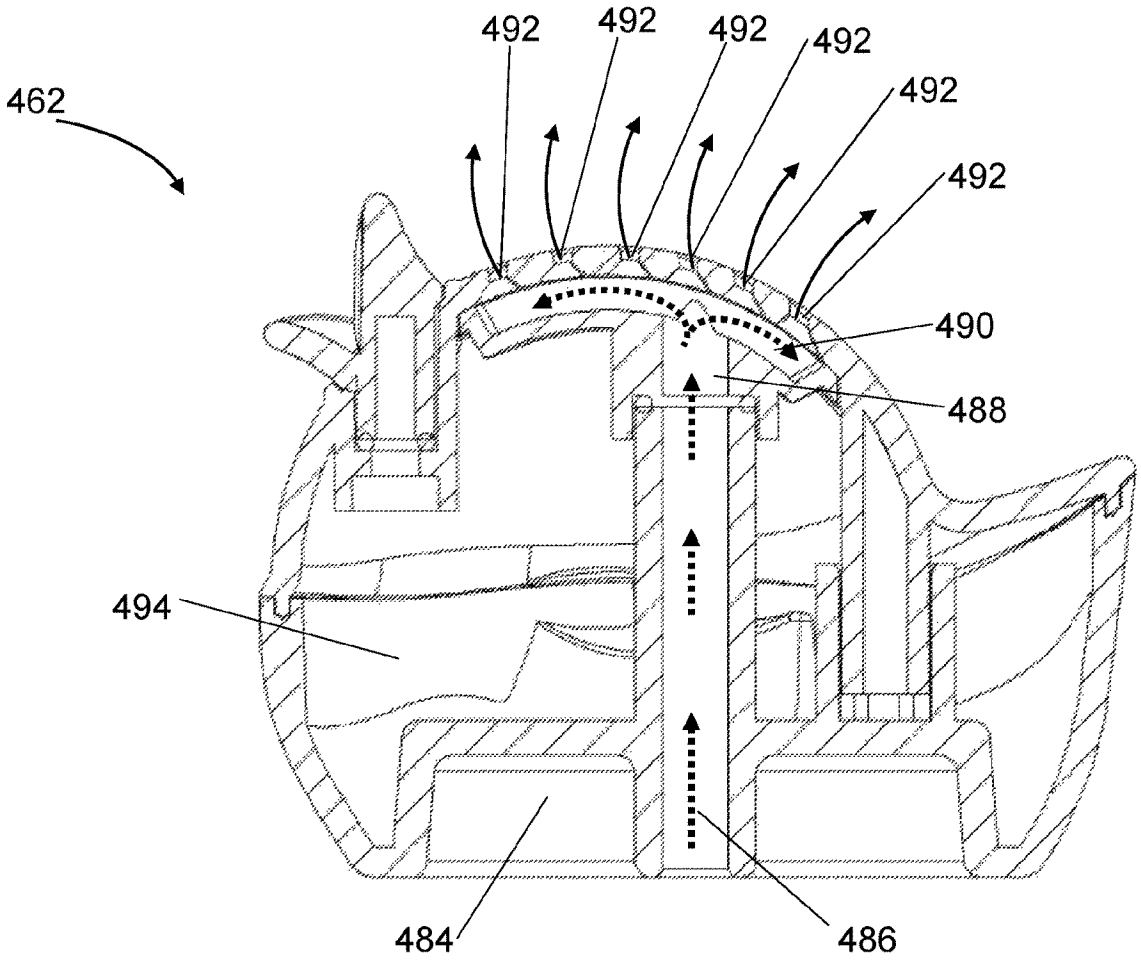

Reference is now made to FIGS. 8A and 8B, which are simplified pictorial illustrations of two operative orientations of a changeable spray water toy system constructed and operative in accordance with a preferred embodiment of the invention, and to FIGS. 8C and 8D, which are simplified respective sectional illustrations of a spray generator and of a fanciful floatable spray configuration modulator forming parts of the changeable spray water toy system of FIGS. 8A & 8B, taken along section lines C-C in FIG. 8A and D-D in FIG. 8B.

As seen in FIGS. 8A and 8B, there is provided a water toy system 450, preferably a bath toy, including a water spray generating assembly 452, which generates at least one water spray 454. At least one, and preferably a few, floatable fanciful unsinkable and unlistable elements, such as toy ducks 462, are arranged to be floatable on water within a bath (not shown).

Water spray generating assembly 452 is preferably enclosed in a housing 464, may be of any suitable desired shape and is preferably fanciful. It may be fixed in place, such as by being anchored to the bottom of a bathtub as by vacuum cups 466, or may float on the water in a bath. An On/Off switch 468 is preferably mounted on the side of housing 464. In the illustrated embodiment of FIGS. 8A-8D, preferably a single vertical water spray 454 is provided from a spray outlet aperture 470 of a nozzle 472, which is coupled by piping 474 to the outlet of a battery-operated water pump 476 having a water inlet 478, all of which form part of the water spray generating assembly 452. Water is preferably drawn from the bath, as indicated by arrows 480.

In the embodiment of FIGS. 8A-8D, the water spray generating assembly 452 and specifically nozzle 472 are configured for selectably receiving in engagement with nozzle 472 one of a plurality of floating unlistable and unsinkable mutually differently fanciful spray modulating objects 462 which are selectably placeable in water spray receiving engagement with the nozzle 472 of the water spray generating assembly 452 and which are operative to convert single vertical water spray 454 having a first spatial configuration received at at least a first location thereat to a water spray 482 having a second spatial configuration emitted at at least a second location thereat which is different from said first spatial configuration.

As seen particularly in FIG. 8D, the floating unlistable and unsinkable mutually fanciful spray modulating object, here in the form of a duck 462, preferably includes a bottom surface recess 484 arranged to mate with nozzle 472 and a conduit 486 arranged to be inserted into spray outlet aperture 470 of nozzle 472 for receiving a pressurized vertically upwardly directed flow of water therethrough. Conduit 486 preferably terminates at an upward end 488 thereof at a manifold 490 having a plurality of spray outlet apertures 492.

It is a particular feature of spray modulating objects 462, irrespective of their fanciful configuration and their output spray arrangement, that they are floating, unlistable and unsinkable. These properties preserve their play value and are the result of the provision of at least one, and preferably more, preferably circumferentially disposed, sealed, gas filled compartments 494. Alternatively, sealed gas filled compartments 494 may be filled with a floatable material and need not be sealed.

Figure 9B:
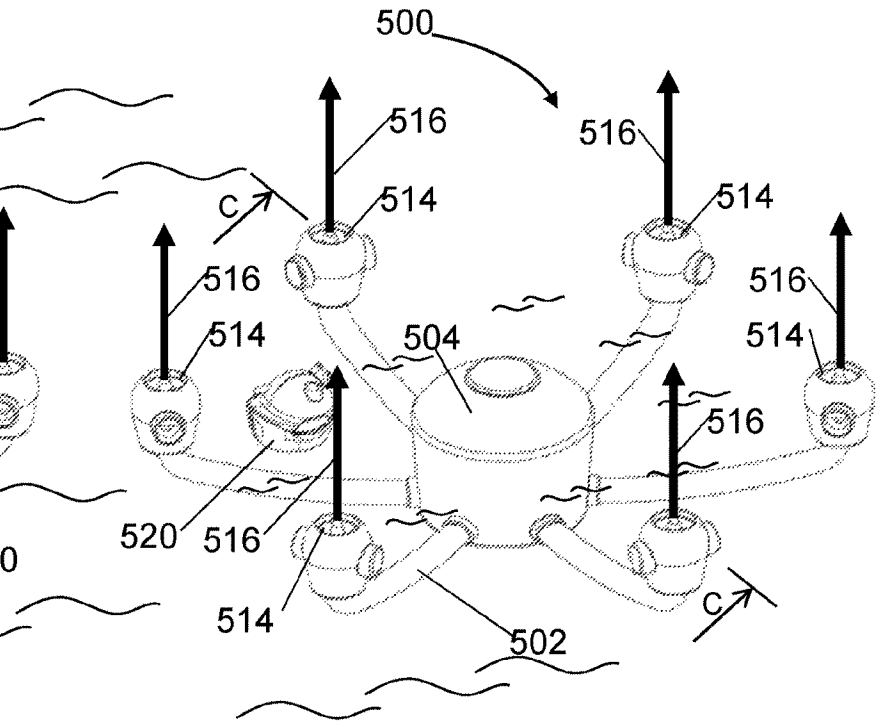
FIGS. 9A and 9B are simplified pictorial illustrations of two operative orientations of a changeable spray water toy system constructed and operative in accordance with another preferred embodiment of the invention.
Figure 9A:
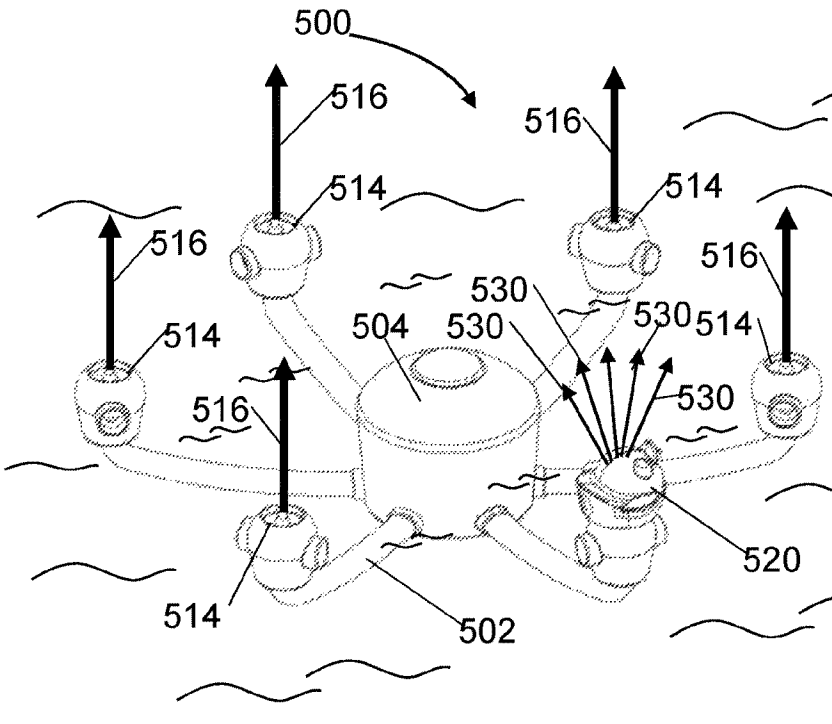
Figure 9C:
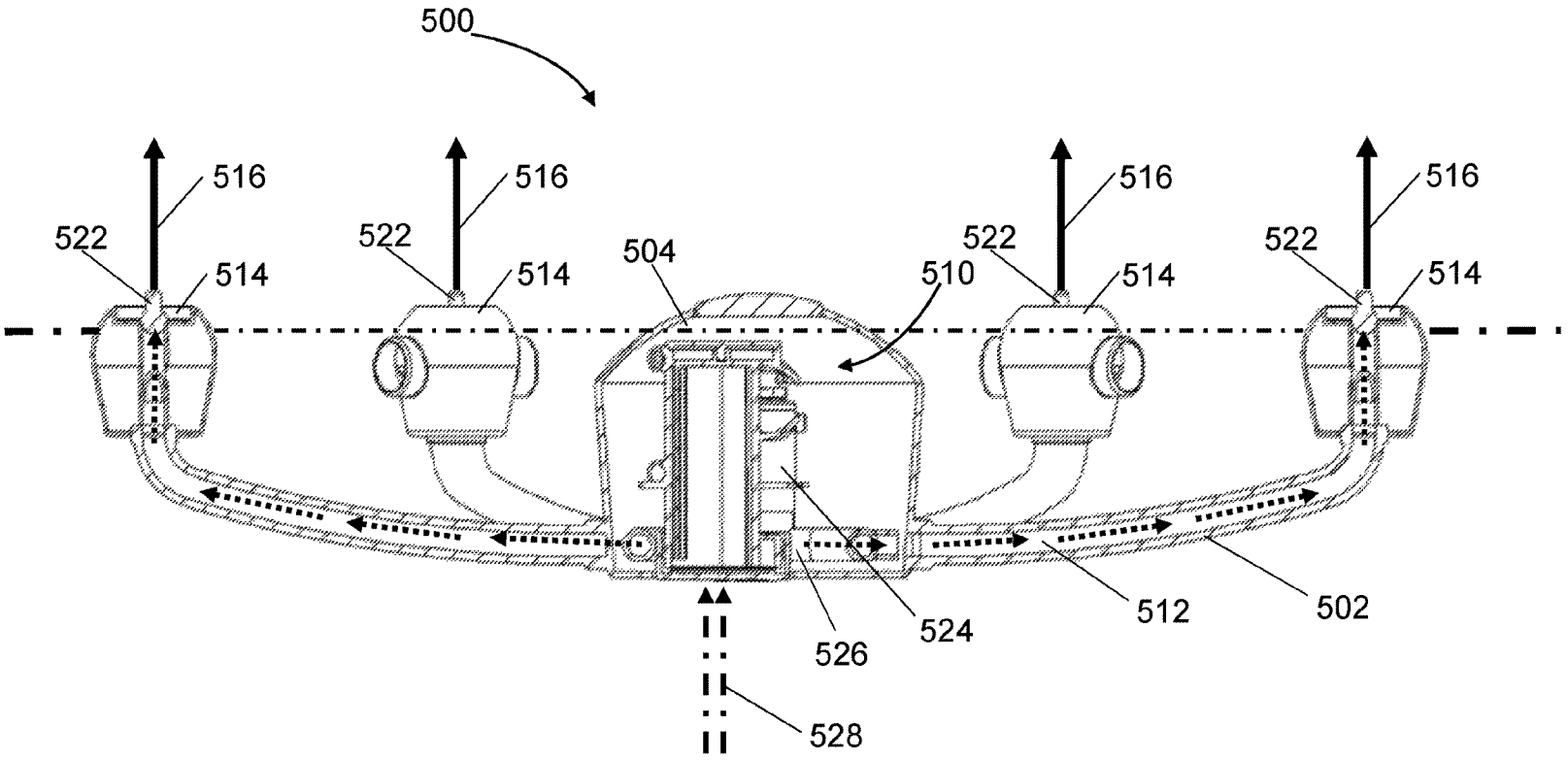
FIG. 9C is a simplified sectional illustrations of a base unit forming part of the changeable spray water toy system of FIGS. 9A & 9B taken along section lines C-C in FIG. 9B.

Reference is now made to FIGS. 9A and 9B, which are simplified pictorial illustrations of two operative orientations of a changeable spray water toy system constructed and operative in accordance with another preferred embodiment of the invention, and to FIG. 9C, which is a simplified sectional illustration of a base unit forming part of the changeable spray water toy system of FIGS. 9A & 9B taken along section lines C-C in FIG. 9A.

As seen in FIGS. 9A-9C, there is provided a changeable spray water toy system 500, preferably a bath toy, including a housing 502 including a central portion 504 enclosing a water spray generating assembly 510, from which central portion extend multiple generally radially extending conduits 512, each of which terminates in a nozzle 514, which produces an upwardly directing spray 516.

At least one, and preferably a few, floatable fanciful unsinkable and unlistable elements, such as toy ducks 520, are arranged to be floatable on water within a bath (not shown).

Housing 502 may be fixed in place, such as by being anchored to the bottom of a bathtub, or may float on the water in a bath. In the illustrated embodiment of FIGS. 9A-9C, preferably a single vertical water spray 516 is provided from a spray outlet aperture 522 of each nozzle 514, which is coupled by a conduit 512 to the outlet of a battery-operated water pump 524 having a water inlet 526, all of which form part of the water spray generating assembly 510. Water is preferably drawn from the bath from below housing 502, as indicated by arrows 528.

In the embodiment of FIGS. 9A-9C, the water spray generating assembly 510 and specifically nozzles 514 are each configured for selectably receiving in engagement with nozzle 514 one of a plurality of floating unlistable and unsinkable mutually differently fanciful spray modulating objects, such as toy ducks 520, which are selectably placeable in water spray receiving engagement with a nozzle 514 of the water spray generating assembly 510 and which are operative to convert single vertical water spray 516 having a first spatial configuration received at at least a first location thereat to a water spray 530 having a second spatial configuration emitted at at least a second location thereat which is different from the first spatial configuration. A preferred embodiment of such a floating unlistable and unsinkable mutually differently fanciful spray modulating object, such as toy ducks 520, is described hereinabove with reference to FIG. 8D, it being appreciated that various such objects preferably each have a differently configured outlet spray.

It is a particular feature of spray modulating objects, such as ducks 520, irrespective of their fanciful configuration and their output spray arrangement, that they are floating, unlistable and unsinkable. These properties preserve their play value and are the result of the provision of at least one and preferably more, volumes filled with a buoyant material, such as a gas or a closed cell foamed plastic material.

Figure 10B:
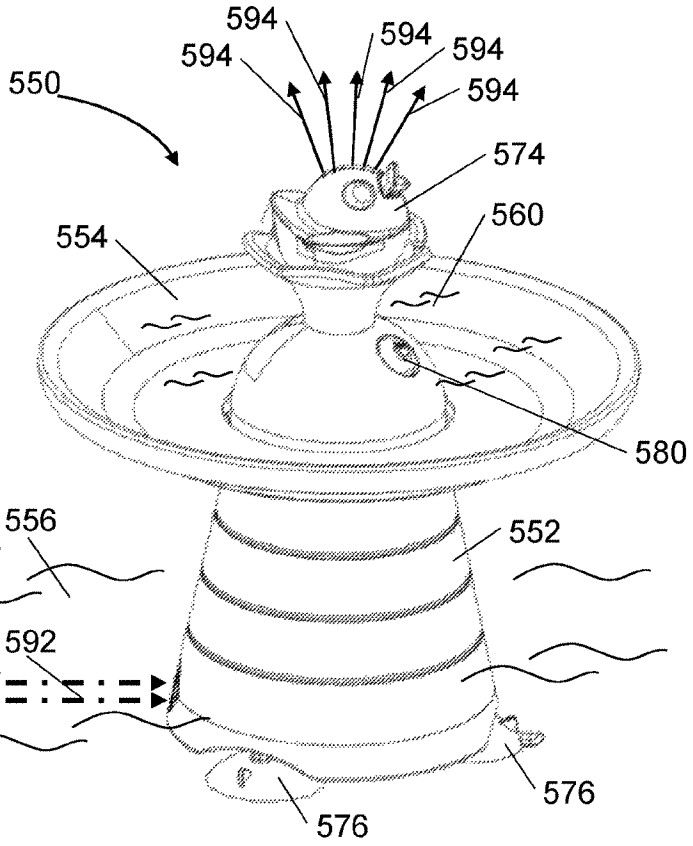
FIGS. 10A and 10B are simplified pictorial illustrations of two operative orientations of a changeable spray water play space delimited toy system constructed and operative in accordance with a preferred embodiment of the invention.
Figure 10A:
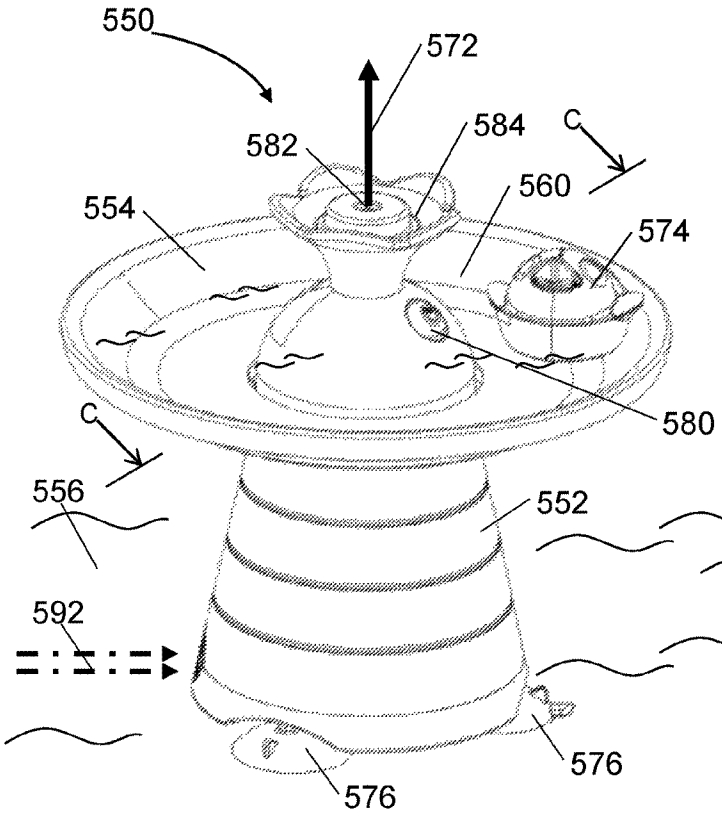
Figure 10C:
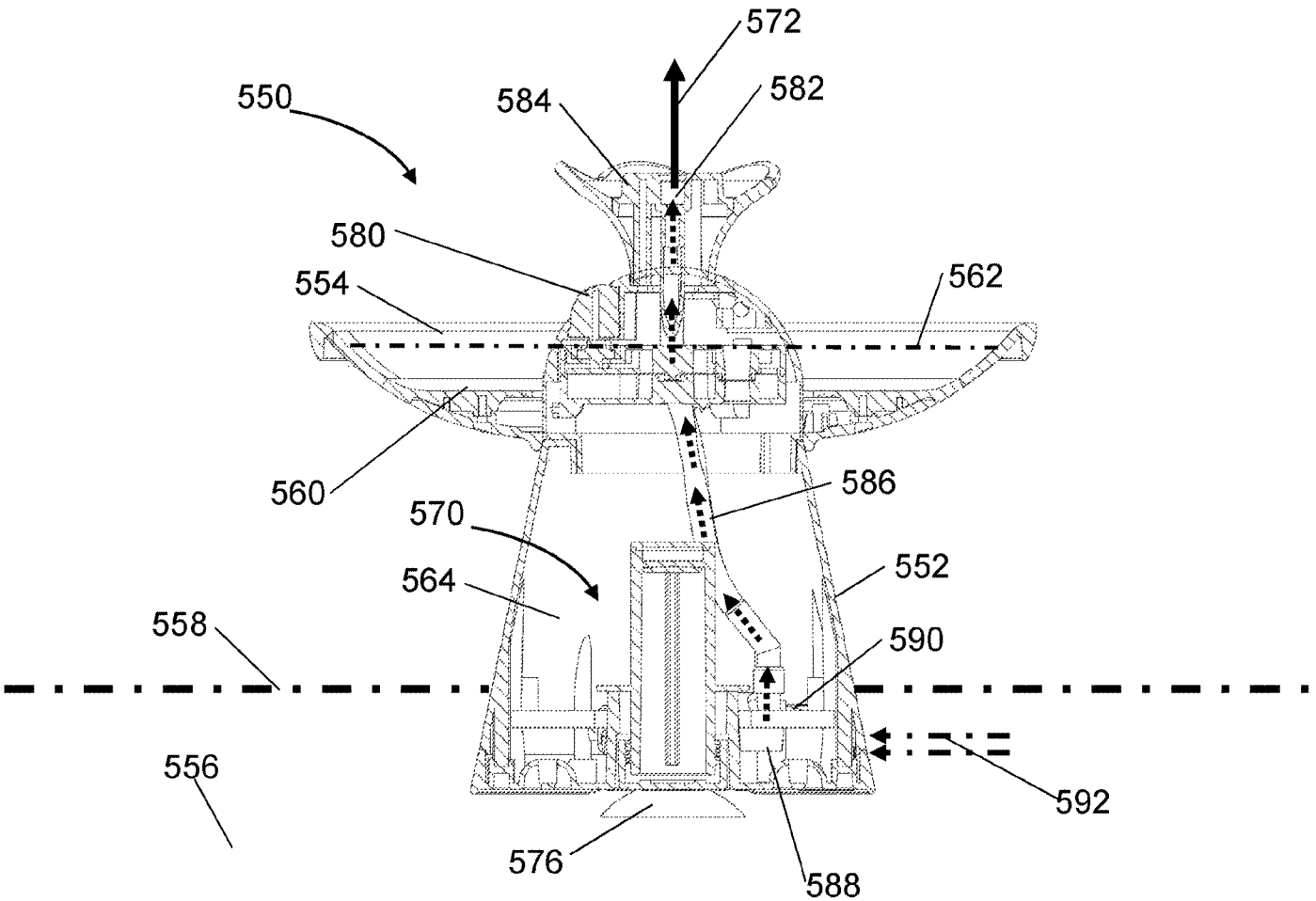
FIG. 10C is a simplified sectional illustrations of a base unit forming part of the changeable spray water play space toy system of FIGS. 10A & 10B taken along section lines C-C in FIG. 10A.

Reference is now made to FIGS. 10A and 10B, which are simplified pictorial illustrations of two operative orientations of a changeable spray water toy system constructed and operative in accordance with a preferred embodiment of the invention, and to FIG. 10C, which is a simplified respective sectional illustrations of a spray generator and water play space delimiter forming part of the changeable spray water toy system of FIGS. 10A & 10B, taken along section lines C-C in FIG. 10A.

As seen in FIGS. 10A-10C, there is provided a water toy system 550, preferably a bath toy, including a housing 552, preferably in a fanciful form and including a water play space delimiter, preferably in the general form of a bowl 554, preferably arranged to be located in a water-filled bath region 556, having a nominal water line 558, and to define an at least partially water-filled water play space 560 separate from a remainder of the water filled bath region 556 and having a nominal water line 562.

Housing 552 preferably also includes a central portion 564 which encloses a water spray generating assembly 570, which preferably generates a single upwardly directed spray 572 within the water play space 560. There are also provided at least one, and preferably a few, floatable unsinkable and unlistable fanciful objects, such as toy ducks 574, which may be identical in structure and function to the objects described hereinabove with reference to FIGS. 8A-9C and are arranged to be floatable on water within the water-filled water play space 560.

In the illustrated embodiment, the water space delimiter may be a concave enclosure or bowl 554 of any suitable desired shape. It may be fixed in place, such as by being anchored to the bottom of a bathtub, as by vacuum cups 576, or may float on the water in the bath region. A principal function of the water space delimiter is to restrict the range of movement of the floatable fanciful elements to within a desired water play space, preferably in front of a child. Another function of the water space delimiter is to define a relatively calm water surface in the water play space 560. In this embodiment, a further function of the delimiter is to raise the water play space 560 to a height above that of the bath region 556, such that the water line 562 of the water play space 560 is decoupled from the water line 558 of the bath region 556 and may be above or below water line 558. In the illustrated embodiment, the water line 562 is seen to be substantially above water line 558.

The water spray generating assembly 570 preferably includes an On/Off switch 580 on the outside of central portion 564 of the housing. In the illustrated embodiment of FIGS. 10A-10C, preferably single vertical water spray 572 is provided from a spray outlet aperture 582 of a nozzle 584, which is coupled by piping 586 to the outlet of a battery-operated water pump 588 having a water inlet 590, all of which form part of the water spray generating assembly 570. Water is preferably drawn from the bath, as indicated by arrows 592.

In the embodiment of FIGS. 10A-10C, the water spray generating assembly 570 and specifically nozzle 584 are configured for selectably receiving in engagement with nozzle 584 one of a plurality of floating unlistable and unsinkable mutually differently fanciful spray modulating objects 574, which are selectably placeable in water spray receiving engagement with the nozzle 584 of the water spray generating assembly 570 and which are operative to convert single vertical water spray 572 having a first spatial configuration received at at least a first location thereat to a water spray 594, having a second spatial configuration emitted at at least a second location thereat which is different from said first spatial configuration. As noted above, the structure and operative of the floating unlistable and unsinkable mutually fanciful spray modulating objects may be as described hereinabove with reference to FIG. 8D. Various ones of objects 574 preferably produce different output spray configurations.

Figures 11A, 11B:
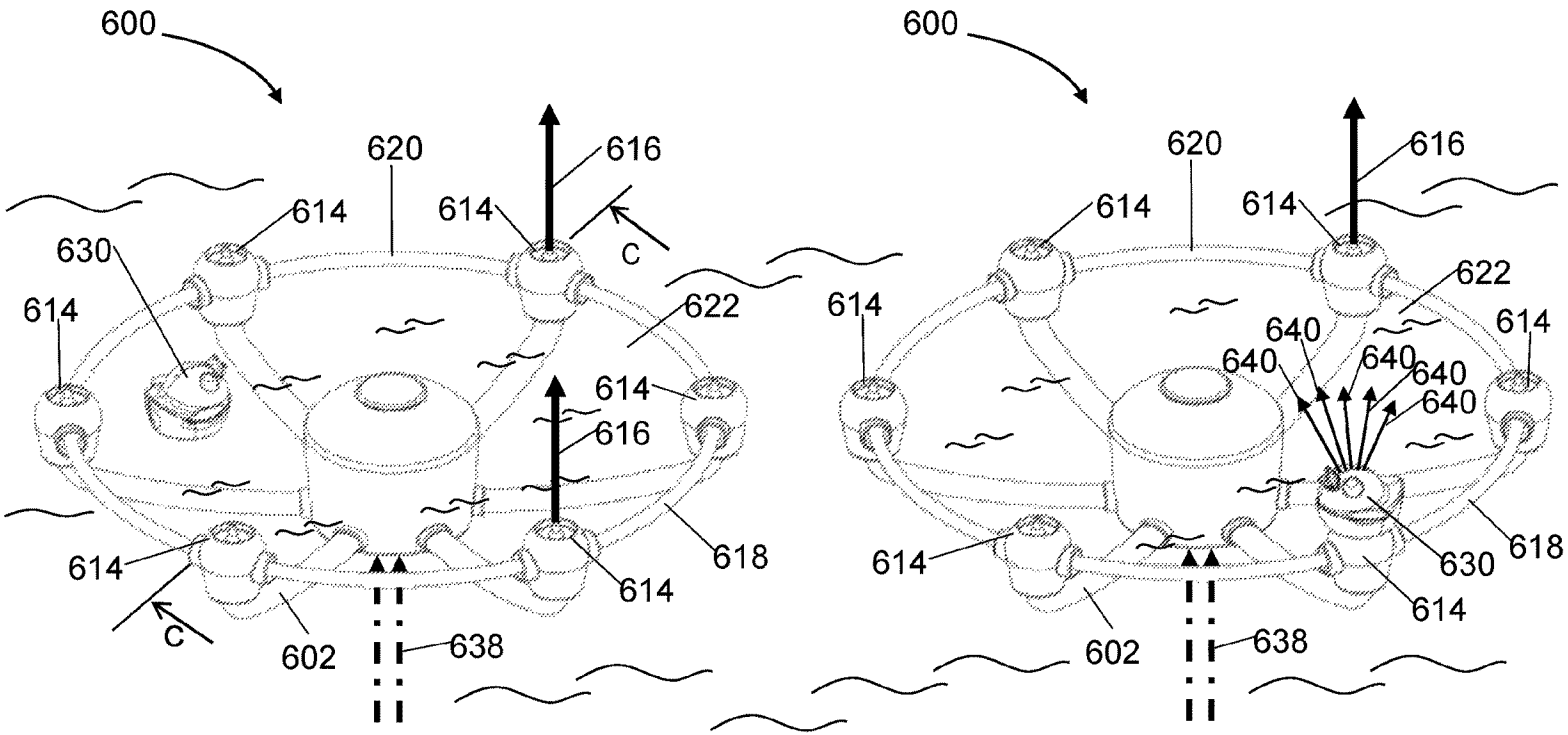
FIGS. 11A and 11B are simplified pictorial illustrations of two operative orientations of a changeable spray water play space delimited toy system constructed and operative in accordance with another preferred embodiment of the invention.
Figure 11C:
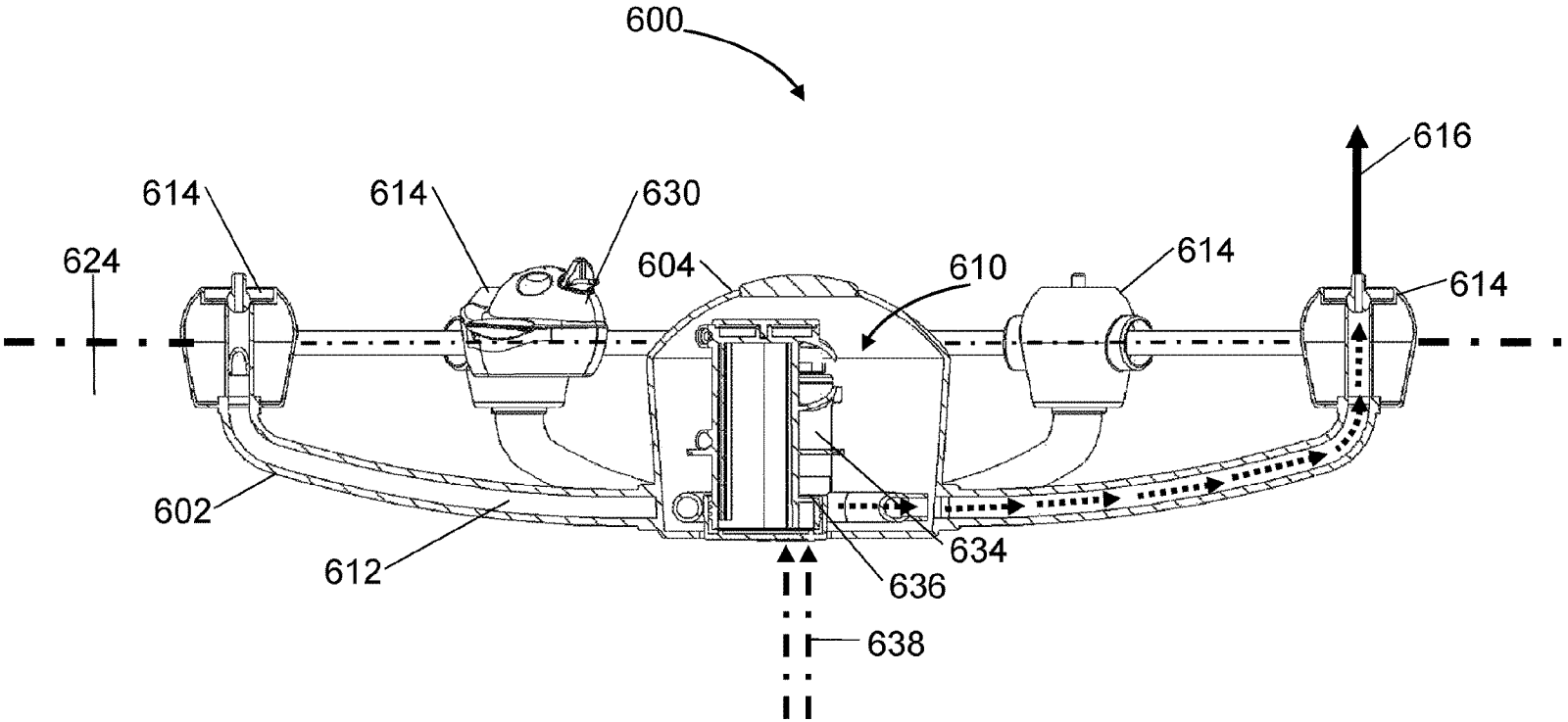
FIG. 11C is a simplified sectional illustrations of a base unit forming part of the changeable spray water play space toy system of FIGS. 11A & 11B taken along section lines C-C in FIG. 11A.

Reference is now made to FIGS. 11A and 11B, which are simplified pictorial illustrations of two operative orientations of a changeable spray water play space delimited water toy system constructed and operative in accordance with still another preferred embodiment of the invention, and to FIG. 11C, which is a simplified sectional illustration of a base unit forming part of the changeable spray water play space delimited water toy system of FIGS. 11A & 11B taken along section lines C-C in FIG. 11A.

As seen in FIGS. 11A-11C, there is provided a changeable spray water play space delimited water toy system 600, preferably a bath toy, including a housing 602 including a central portion 604 enclosing a water spray generating assembly 610, from which central portion extend multiple generally radially extending conduits 612, each of which terminates in a nozzle 614, which produces an upwardly directing spray 616. The nozzles 614 are interconnected by circumferential portions 618 and define together therewith a water play space delimiter 620, which defines therewithin a water play space 622.

Water play space delimiter 620 is preferably in the form of a generally circular ring-like enclosure, preferably arranged to be located in a water-filled bath region 624 and to define water play space 622 separate in its area from a remainder of the water filled bath region 624.

Each of nozzles 614 generates a central generally vertical water spray 616 in the water play space 622 and at least one, and preferably a few, floatable unsinkable and unlistable fanciful objects, such as toy ducks 630, an example of which is described hereinabove with reference to FIG. 8D, are arranged to be floatable on water within the water play space 622.

In the illustrated embodiment, the water space delimiting ring-like enclosure 620 may be fixed in place, such as by being anchored to the bottom of a bathtub, or may float on the water in the bath. As in the embodiment of FIGS. 1A & 1B, a principal function of the water space delimiter is to restrict the range of movement of the floatable fanciful elements to within a desired water play space, preferably in front of a child. Another function of the water space delimiter is to define a relatively calm water surface in the water play space 622.

Each nozzle 614 is coupled by a conduit 612 to the outlet of a battery-operated water pump 634 having a water inlet 636, all of which form part of the water spray generating assembly 610. Water is preferably drawn from the bath from below housing 602, as indicated by arrows 638.

In the embodiment of FIGS. 11A-11C, the water spray generating assembly 610 and specifically nozzles 614 are each configured for selectably receiving in engagement with nozzle 614 one of a plurality of floating unlistable and unsinkable mutually differently fanciful spray modulating objects, such as toy ducks 630, which are selectably placeable in water spray receiving engagement with a nozzle 614 of the water spray generating assembly 610 and which are operative to convert single vertical water spray 616 having a first spatial configuration received at at least a first location thereat to a water spray 640 having a second spatial configuration emitted at at least a second location thereat which is different from the first spatial configuration. A preferred embodiment of such a floating unlistable and unsinkable mutually differently fanciful spray modulating object, such as toy ducks 630, is described hereinabove with reference to FIG. 8D, it being appreciated that various such objects preferably each have a differently configured outlet spray.

It is a particular feature of the spray modulating objects, such as toy ducks 630, irrespective of their fanciful configuration and their output spray arrangement, that they are floating, unlistable and unsinkable. These properties preserve their play value and are the result of the provision of at least one, and preferably more, volume filled with a buoyant material, such as a gas or a closed cell foamed plastic material.

Figure 12A:
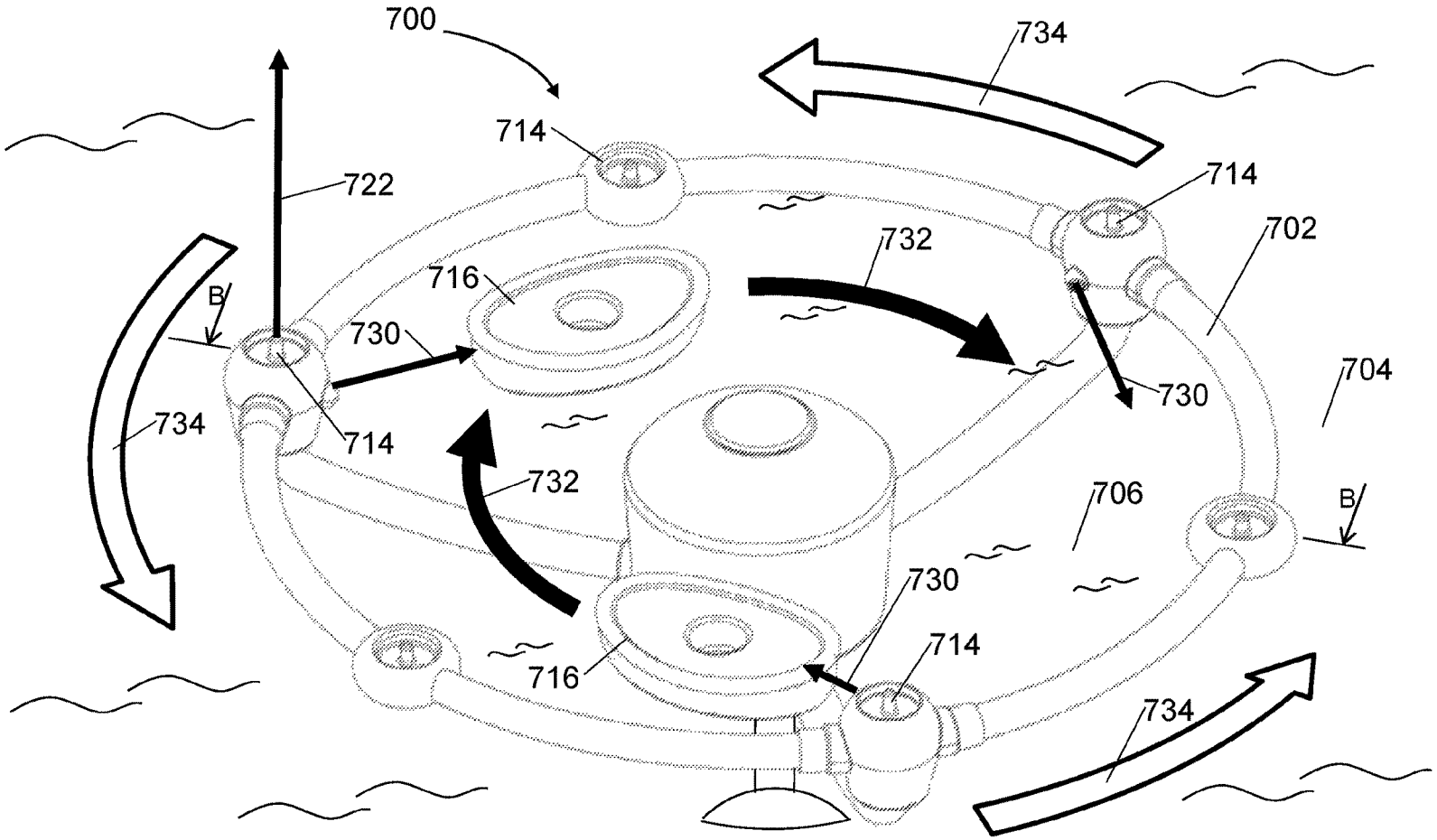
FIGS. 12A and 12B are simplified respective pictorial and sectional illustrations of an oppositely directional floatable toy system constructed and operative in accordance with another preferred embodiment of the invention, FIG. 12B being taken along lines B-B in FIG. 12A.
Figure 12B:
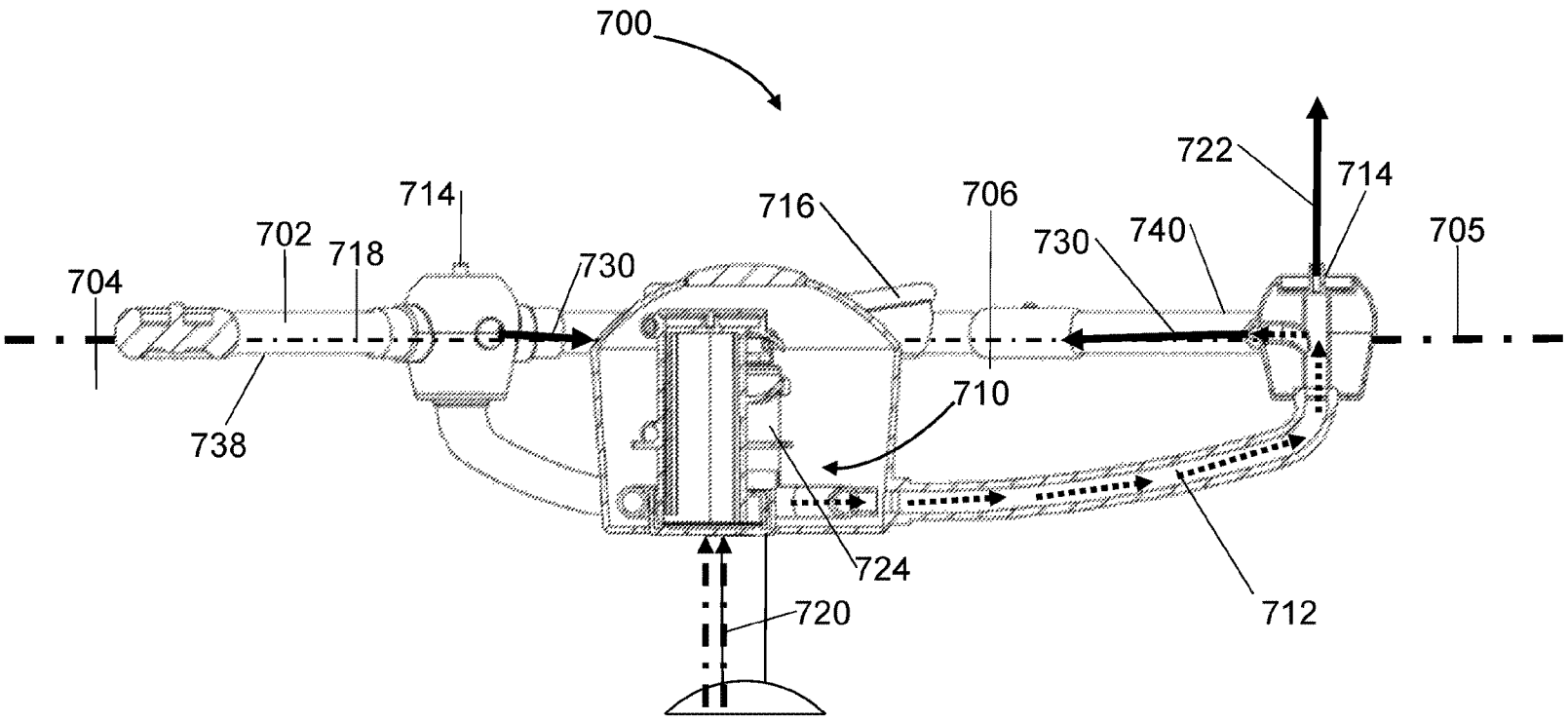

Reference is now made to FIGS. 12A and 12B, which are simplified, respective pictorial and structural/functional illustrations of a water toy system constructed and operative in accordance with an embodiment of the present invention.

As seen in FIGS. 12A and 12B, there is provided a water toy system 700, preferably a bath toy, including a water play space delimiter, preferably in the form of a ring like enclosure 702, preferably arranged to be located in a water-filled bath region 704, having a nominal water line 705, and to define a water play space 706 separate from a remainder of the water filled bath 704.

A water spray generating assembly 710 is preferably coupled by a plurality of generally radially directed conduits 712 to a plurality of nozzles 714, each of which generates at least one water spray within the water play space 706 and at least one, and preferably a few, floatable, unsinkable, unlistable fanciful objects, such as toy boats 716, are arranged to be floatable on water within the water play space 706.

In the illustrated embodiment, the water space delimiter may be a ring-like enclosure 702 of any suitable desired shape which may be entirely freely floatable or alternatively may be floatable and tethered so that it can rotate but is not displaced from a given general location in the bath. A principal function of the water space delimiter is to restrict the range of movement of the floatable fanciful objects, such as toy boats 716, to within a desired water play space, preferably in front of a child. Another function of the water space delimiter is to define a relatively calm water surface in the water play space 706. The water line 718 of the water play space 706 in this embodiment is the same as the water line 705 of the bath region 704.

The water spray generating assembly 710 is located centrally of the water play space delimiter and preferably draws water from below the water play space 706 and outside the delimiter, as illustrated by arrows 720, and sprays the water into the water play space 706, as indicated by arrows 722. In the illustrated embodiment of FIGS. 12A & 12B, multiple water sprays are provided by multiple nozzles 714, which are coupled by conduits 712 to the outlet of a battery-operated water pump 724.

It is a particular feature of this embodiment of the invention that at least some of nozzles 714 provide a water spray that has at least a non-radial component in the plane of the delimeter, which may be a tangential component, as shown by arrows 730. Here this water spray is shown to be above the water line 718 of the water play space 706 and to impinge on floatable fanciful objects, such as toy boats 716, preferably causing them to be displaced in a generally circular motion indicated by arrows 732 along a track defined by the sprays indicated by arrows 730. The reaction force of the non-radial sprays indicated by arrows 730 causes a corresponding rotation of the remainder of the water toy system including the delimiter in a direction indicated by arrows 734.

If the delimiter is free floating, the mutually counter rotations of the floatable fanciful objects, such as toy boats 716, indicated by arrows 732, and of the remainder of the toy system, indicated by arrows 734, may continue as long as the sprays along arrows 730 are provided. If, however, the delimiter is tethered, eventually the counter torque in the tether resulting from the rotation of the delimiter will cause its rotation to stop and rotation in an opposite direction to commence. This back rotation of the delimiter will enhance the rotation force applied to the objects, such as toy boats 716, by the sprays along arrows 730. The back rotation of the delimiter will continue until the torque falls below a threshold that will allow rotation of the delimiter as indicated by arrows 734 to commence again. This cyclic rotational motion will continue as long as the non-radial sprays along arrows 730 are provided.

It is appreciated that alternatively, the sprays along arrows 730 may be replaced by underwater positive water flows in the same direction, with generally the same effects as those described hereinabove.

In the embodiment of FIGS. 12A & 12B, the water play space 706 is may be considered to be of an area defined by the delimiter, here shown as ring-like enclosure 702, and of a depth below the water line 718, which is equal to at least the draft of the toy boats 716 in the water within that area. In the illustrated embodiment, the depth of the water play space 706 may be considered to be the depth to which the bottom surface of the delimiter extends, here designated by reference numeral 738, which is below the water line 705 of the bath region 704. The water play space 706 may be considered to extend above the water line 705 of the bath region 704 and above the water line 718 of the water play space 706, preferably to a height to which the top surface of the delimiter extends, here designated by reference numeral 740. Alternatively, the water play space 706 may be considered to extend above height 740 to a maximum height reached by water sprays 722.

Figure 13A:
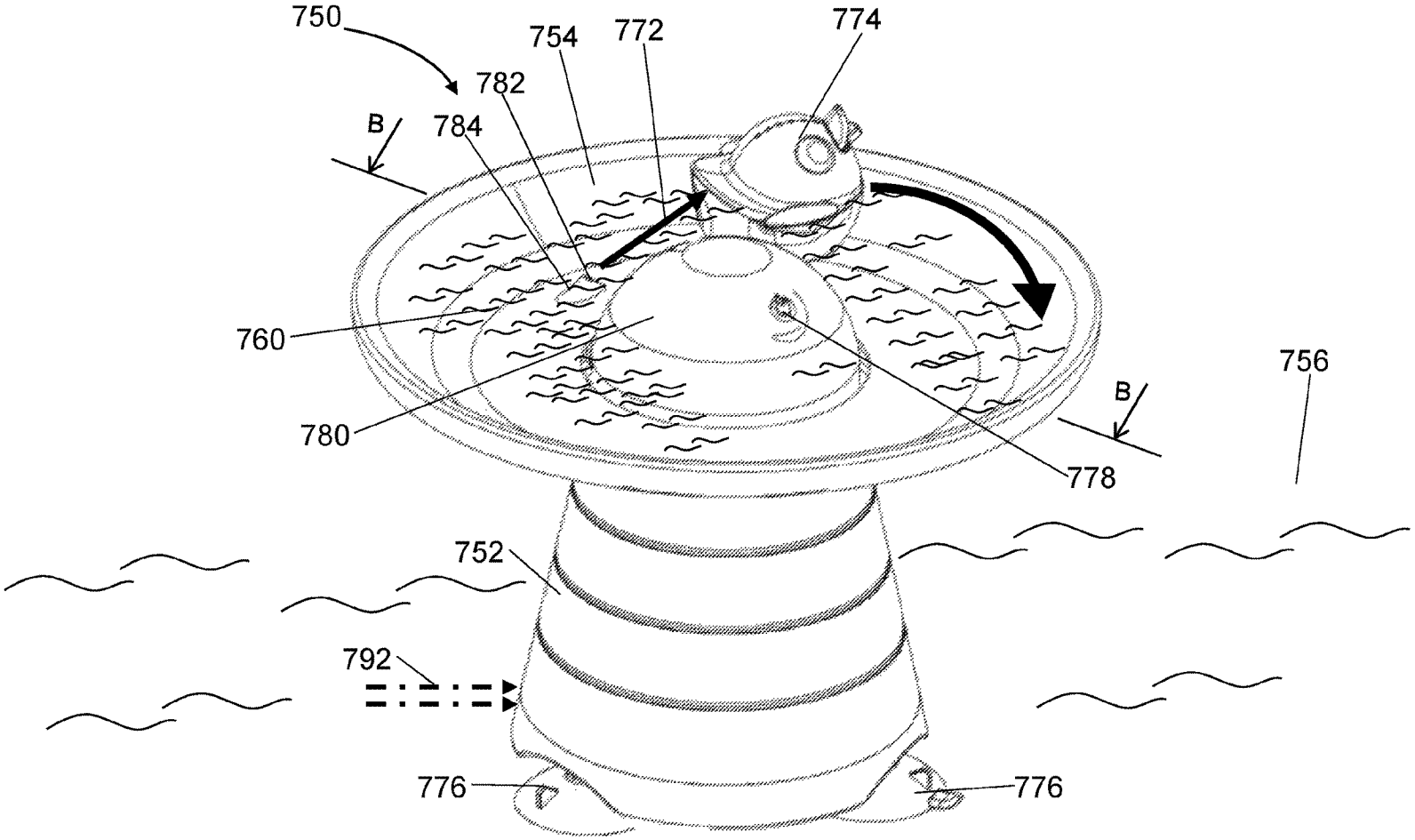
FIGS. 13A and 13B are simplified respective pictorial and sectional illustrations of an rotational motion driven anchored toy system constructed and operative in accordance with a preferred embodiment of the invention, FIG. 13B being taken along lines B-B in FIG. 13A.
Figure 13B:
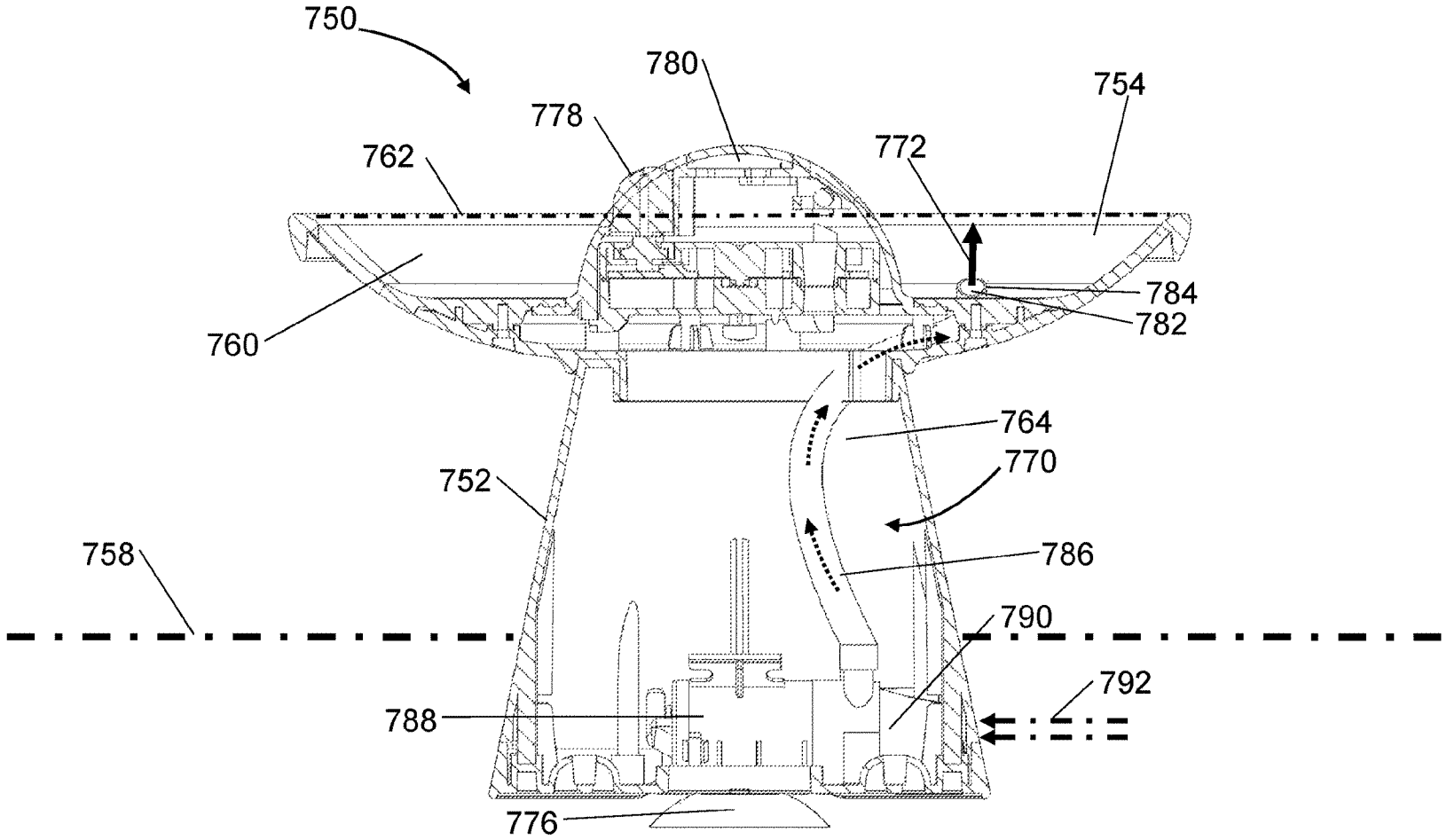

Reference is now made to FIGS. 13A and 13B, which are simplified respective pictorial and sectional illustrations of a rotational motion driven anchored toy system constructed and operative in accordance with a preferred embodiment of the invention, FIG. 13B being taken along lines B-B in FIG. 13A.

As seen in FIGS. 13A & 13B, there is provided a water toy system 750, preferably a bath toy, including a housing 752, preferably in a fanciful form and including a water play space delimiter preferably in the general form of a bowl 754, preferably arranged to be located in a water-filled bath region 756, having a nominal water line 758, and to define an at least partially water-filled water play space 760, separate from a remainder of the water filled bath region 756 and having a nominal water line 762.

Housing 752 preferably also includes a central portion 764 which encloses a water spray generating assembly 770, which preferably generates at least one upwardly directed spray 772 within the water play space 760, which is preferably also tangential with respect to the inner circumference of the housing and has at least a non-radial component in the plane of the delimiter. There are also provided at least one, and preferably a few, floatable unsinkable and unlistable fanciful objects, such as toy ducks 774, which may be identical in structure and function to the objects described hereinabove with reference to FIGS. 8A-9C and are arranged to be floatable on water within the water play space 760.

In the illustrated embodiment, the water space delimiter may be a concave enclosure or bowl 754 of any suitable desired shape. It may be fixed in place, such as by being anchored to the bottom of a bathtub, as by vacuum cups 776, or may float on the water in the bath region 756. A principal function of the water space delimiter is to restrict the range of movement of the floatable fanciful elements to within a desired water play space, preferably in front of a child. Another function of the water space delimiter is to define a relatively calm water surface in the water play space 760. In this embodiment, a further function of the delimiter is to raise the water play space 760 to a height above that of the bath region 756, such that the water line 762 of the water play space is decoupled from the water line 758 of the bath region 756 and may be above or below water line 758. In the illustrated embodiment, the water line 762 is seen to be substantially above water line 758.

The water spray generating assembly 770 preferably includes an On/Off switch 778 on the outside of upper portion 780 of central portion 764 of the housing 752. In the illustrated embodiment of FIGS. 13A & 13B, preferably a single water spray 772 having an upward directional component as well as a component which is non-radial in the plane of the delimiter, is provided from a spray outlet aperture 782 of a nozzle 784, which is coupled by piping 786 to the outlet of a battery-operated water pump 788 having a water inlet 790, all of which form part of the water spray generating assembly 770. Water is preferably drawn from the bath, as indicated by arrows 792.

Figure 14A:
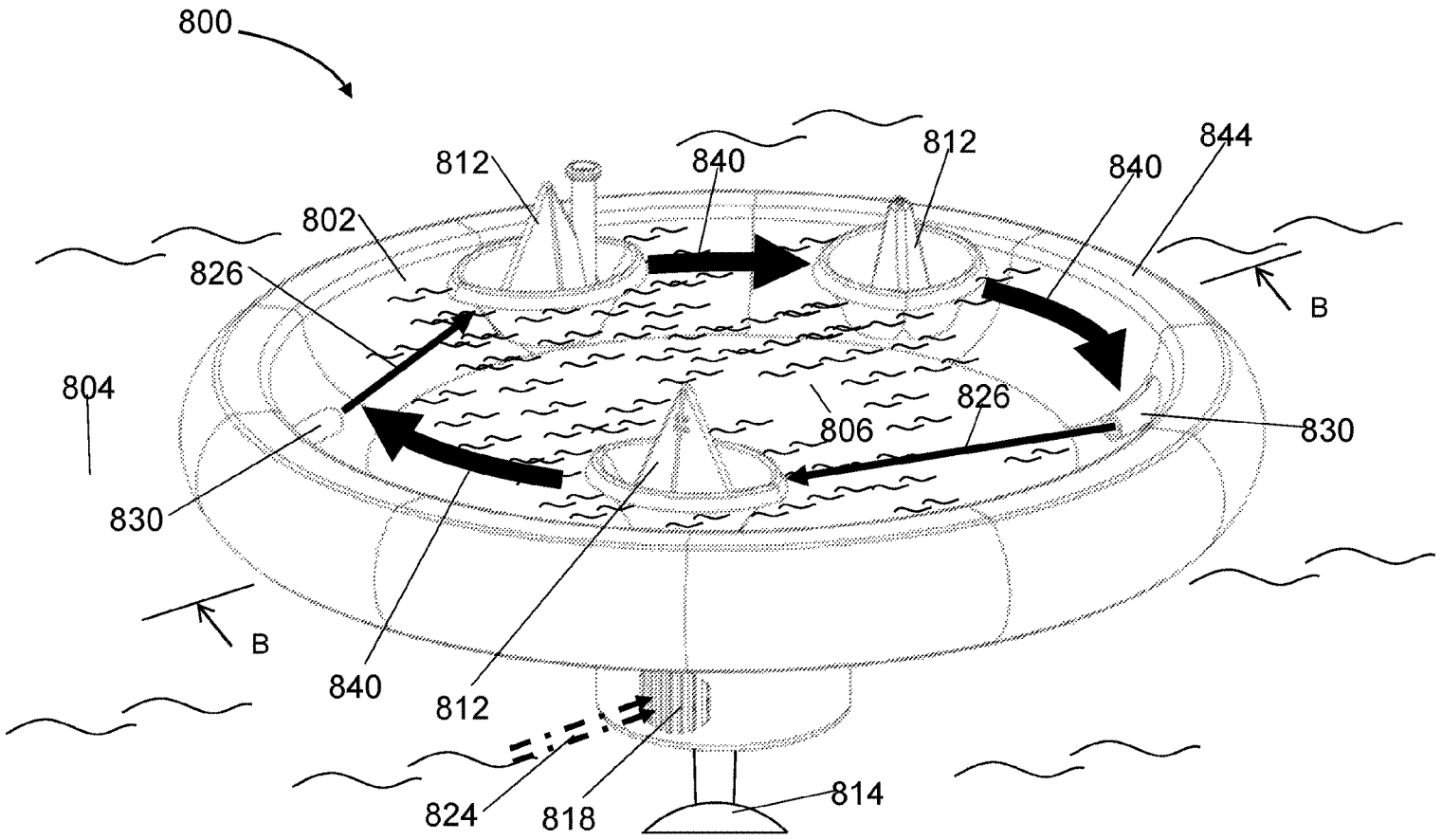
FIGS. 14A and 14B are simplified respective pictorial and sectional illustrations of an rotational motion driven anchored toy system constructed and operative in accordance with another preferred embodiment of the invention, FIG. 14B being taken along lines B-B in FIG. 14A.
Figure 14B:
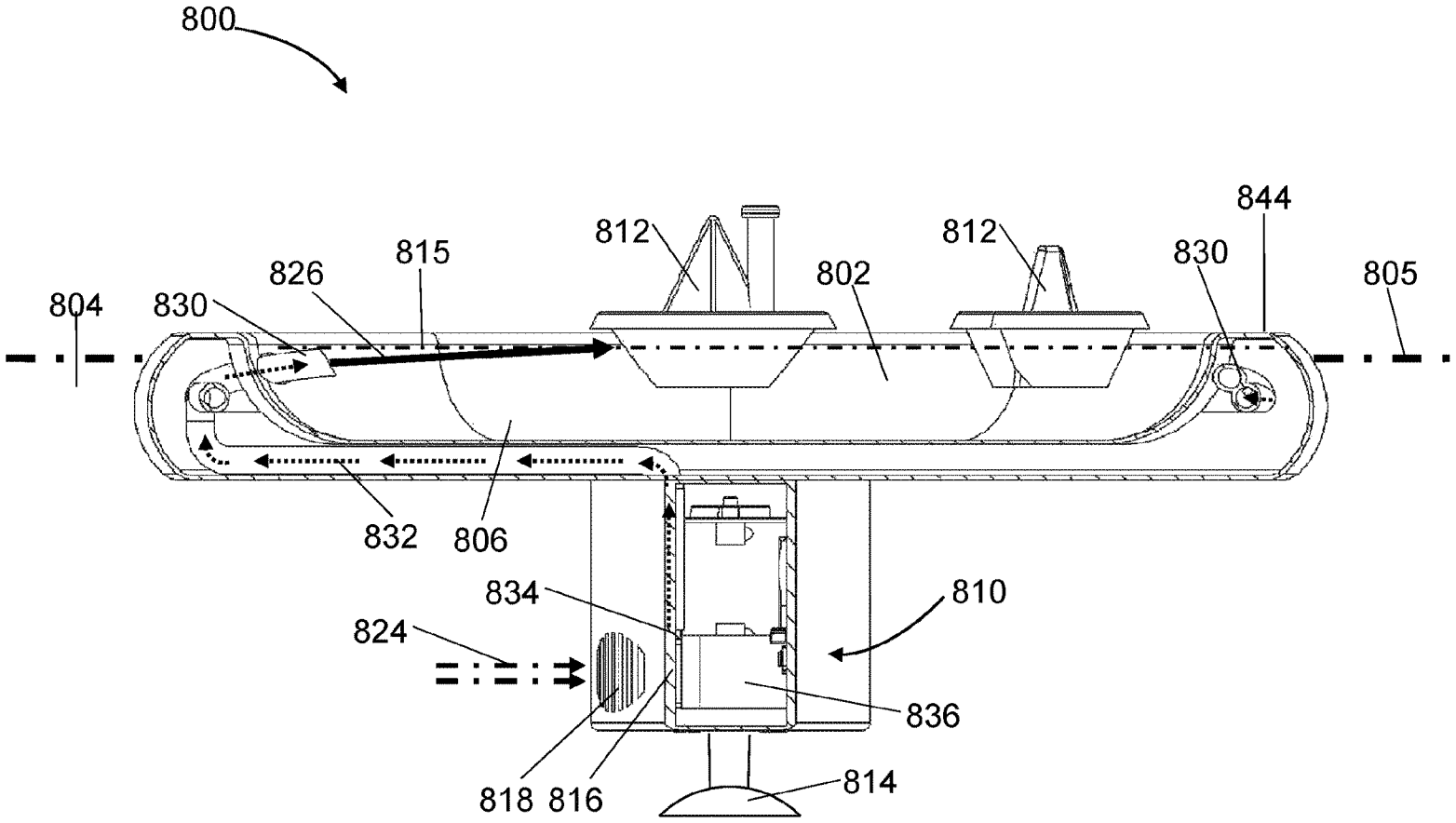

Reference is now made to FIGS. 14A and 14B, which are simplified respective pictorial and sectional illustrations of an rotational motion driven anchored toy system constructed and operative in accordance with another preferred embodiment of the invention, FIG. 14B being taken along lines B-B in FIG. 14A.

As seen in FIGS. 14A and 14B, there is provided a water toy system 800, preferably a bath toy, including a water play space delimiter, preferably in the general form of a bowl 802, preferably arranged to be located in a water-filled bath region 804, having a nominal water line 805 and to define an at least partially water-filled water play space 806, separate from a remainder of the water filled bath 804.

A water spray generating assembly 810 generates at least one, and preferably two, pressurized water currents within the water play space 806 and at least one, and preferably a few, floatable fanciful elements, such as toy boats 812, are arranged to be floatable on water within the water play space 806.

In the illustrated embodiment, the water space delimiter may be a concave enclosure or bowl 802 of any suitable desired shape. It may be fixed in place, such as by being anchored to the bottom of a bathtub as by a vacuum cup 814, or may float on the water in the bath region. A principal function of the water space delimiter is to restrict the range of movement of the floatable fanciful elements to within a desired water play space, preferably in front of a child. Another function of the water space delimiter is to define a relatively calm water surface in the water play space 806. In this embodiment, a further function of the delimiter is to raise at least part of the water play space 806 to a height above that of the bath region 804, such that a water line 815 of the water play space 806 is decoupled from the water line 805 of the bath region 804 and may be above or below water line 805. In the illustrated embodiment, the water line 815 is seen to be slightly above water line 805.

The water spray generating assembly 810 is preferably integrally formed with delimiter 802 and is located therebelow and at the center thereof. Water spray generating assembly 810 preferably draws water via a water inlet 816 and a filter 818 from outside the water play space 806 and below the delimiter, as illustrated by arrows 824, and directs two streams of pressurized water under water line 815 into the water play space 806, in a non-radial direction, which may be in a direction which is tangential to an inner circumference of the delimiter, as indicated by arrows 826, for creating a preferably circular current and preferably intermittently impinging on an underwater portion of each of toy boats 812, thereby displacing the toy boats 812 in an endless circular loop.

In the illustrated embodiment of FIGS. 14A & 14B, preferably the streams indicated by arrows 826 exit from nozzles 830, which are coupled by piping 832 to the outlet 834 of a battery-operated water pump 836 which receives water via water inlet 816 and filter 818, all of which form part of the water spray generating assembly 810, thereby generating a water current in an endless loop, as indicated by arrows 840, for displacing the floatable fanciful elements, such as toy boats 812, in endless loop motion.

In the embodiment of FIGS. 14A & 14B, the water play space 806 is defined by the bowl 802 in area and in depth. The water play space 806 may be considered to extend above the water line 805 of the bath region 804 and above the water line 815 of the water play space 806, preferably to a height to which the top surface of the delimiter extends, here designated by reference numeral 844. Alternatively, the water play space may be considered to extend above height 844 to a maximum height reached by floatable elements, such as toy boats 812.

Figure 15A:
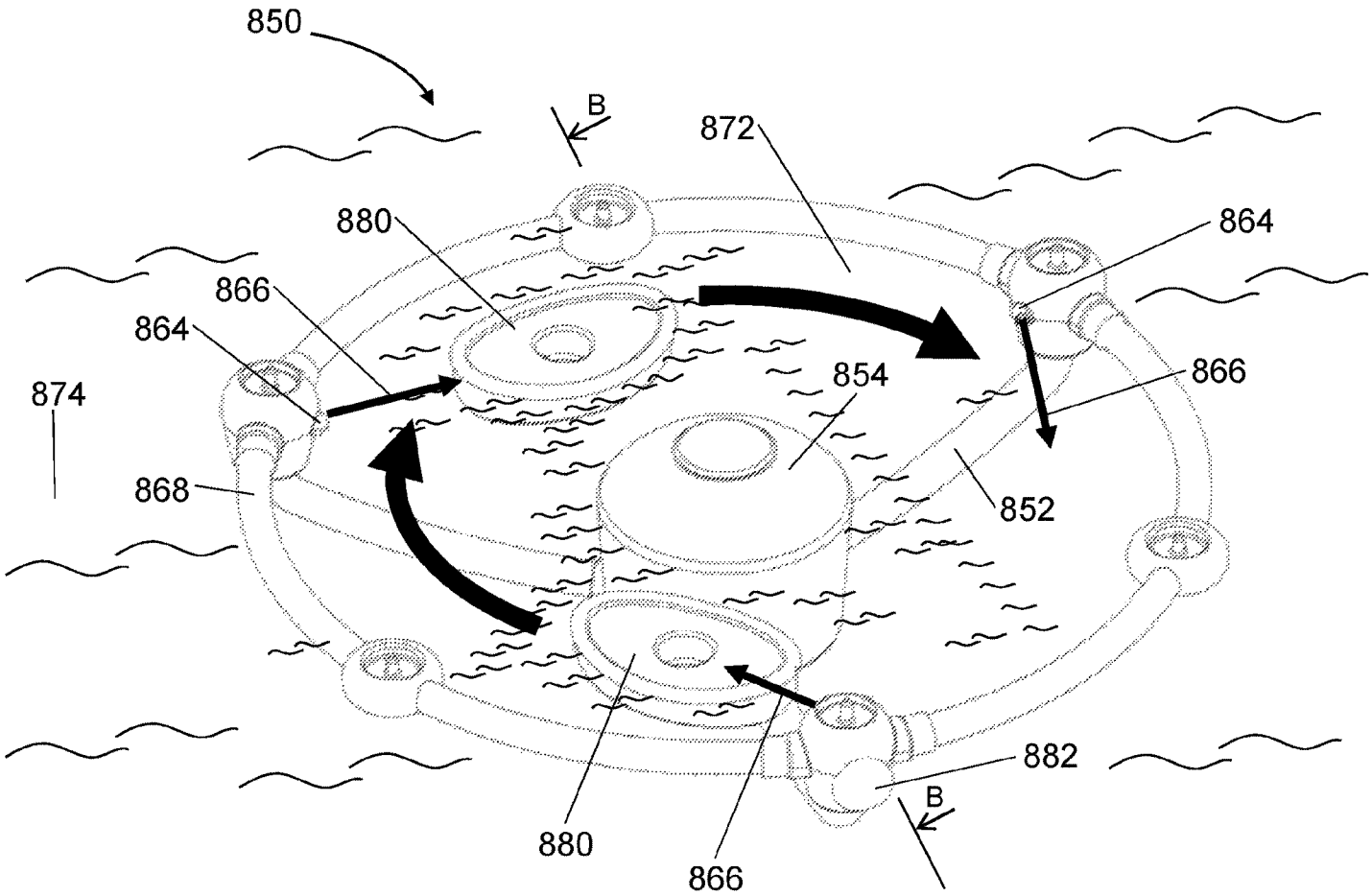
FIGS. 15A and 15B are simplified respective pictorial and sectional illustrations of an rotational motion driven anchored toy system constructed and operative in accordance with another preferred embodiment of the invention, FIG. 15B being taken along lines B-B in FIG. 15A.
Figure 15B:
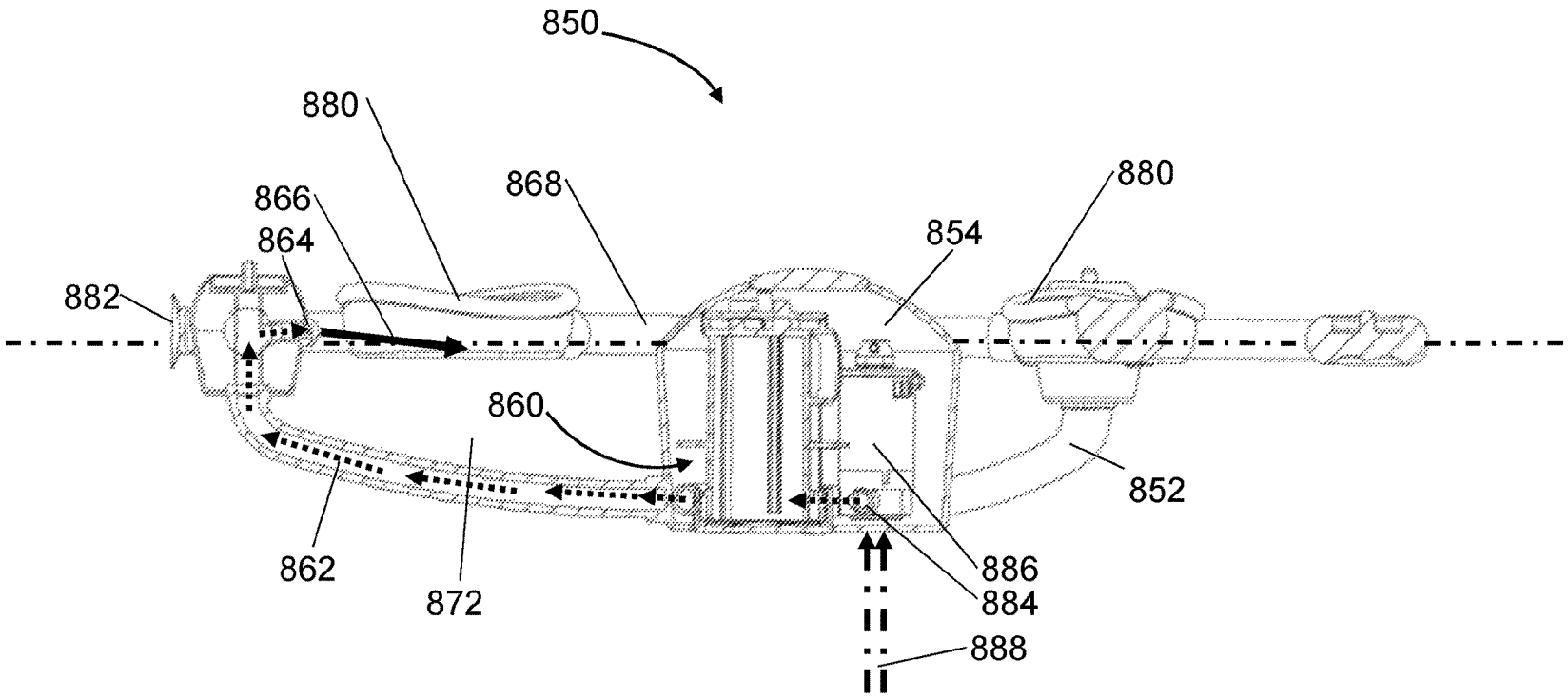

Reference is now made to FIGS. 15A and 15B, which are simplified respective pictorial and sectional illustrations of an rotational motion driven anchored toy system constructed and operative in accordance with another preferred embodiment of the invention, FIG. 15B being taken along lines B-B in FIG. 15A.

As seen in FIGS. 15A & 15B, there is provided a rotational motion driven anchored toy system 850, preferably a bath toy, including a housing 852 including a central portion 854 enclosing a water spray generating assembly 860, from which central portion extend multiple generally radially extending conduits 862, each of which terminates in a nozzle 864, which produces a non-radial spray 866, which may be tangential to a generally circular area delimited by nozzles 864, preferably in a generally horizontal direction. The nozzles 864 are preferably interconnected by circumferential portions 868 and define together therewith a water play space delimiter 870, which defines therewithin a water play space 872.

Water play space delimiter 870 is preferably in the form of a generally circular ring-like enclosure, preferably arranged to be located in a water-filled bath region 874 and to define water play space 872 separate in its area from a remainder of the water filled bath region 874.

Each of nozzles 864 generates a non-radial spray 866, which may be, which may be tangential to a generally circular area delimited by nozzles 864, in the water play space 872 and at least one, and preferably a few, floatable unsinkable and unlistable fanciful objects, such as toy boats 880, are arranged to be floatable on water within the water play space 872 and to be driven in continuous circular motion by sprays 866, which impinge thereon at least intermittently.

In the illustrated embodiment, the water space delimiting ring-like enclosure 870 may be fixed in place, such as by being anchored to the side of a bathtub by means of a suction cup 882 or may float on the water in the bath. As in the embodiment of FIGS. 1A & 1B, a principal function of the water space delimiter is to restrict the range of movement of the floatable fanciful elements to within a desired water play space, preferably in front of a child. Another function of the water space delimiter is to define a relatively calm water surface in the water play space 872.

Each nozzle 864 is coupled by a conduit 862 to the outlet of a battery-operated water pump 884 having a water inlet 886, all of which form part of the water spray generating assembly 860. Water is preferably drawn from the bath from below housing 852, as indicated by arrows 888.

Figure 16A:
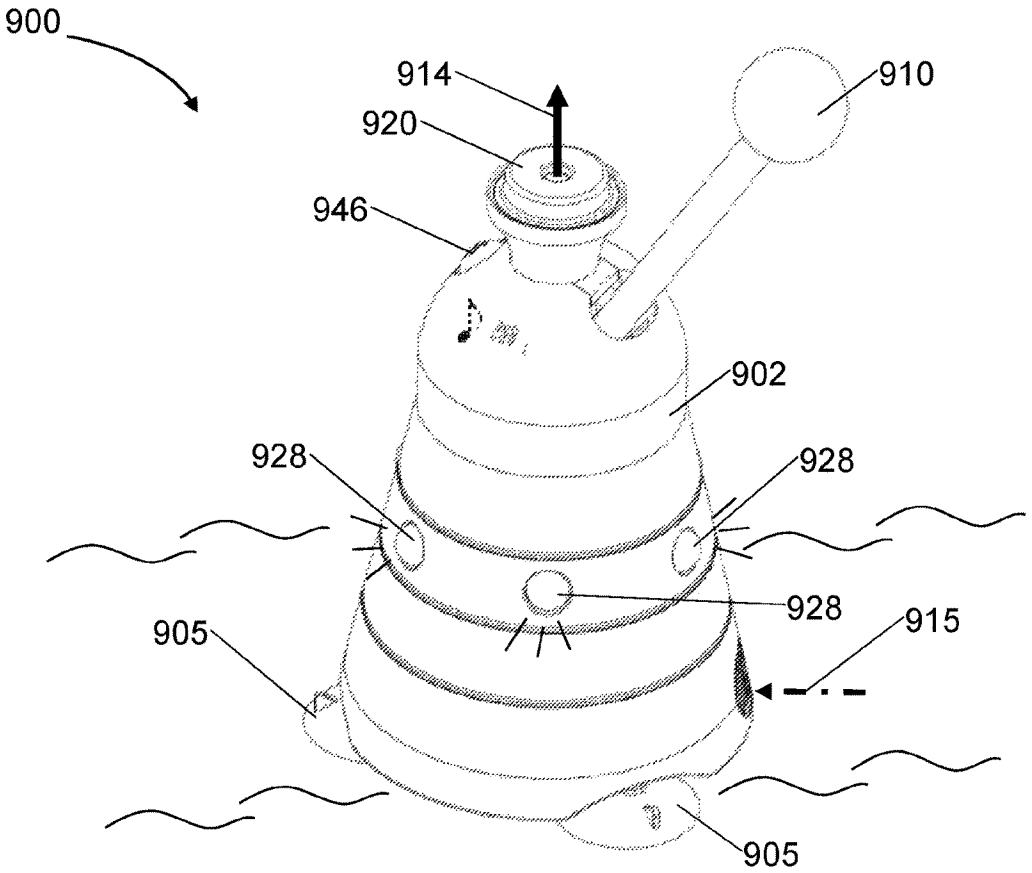
FIGS. 16A, 16B, 16C 16D and 16E are simplified pictorial illustrations of five operative orientations of a multimedia joystick-controlled water toy constructed and operative in accordance with an embodiment of the present invention.
Figure 16B:
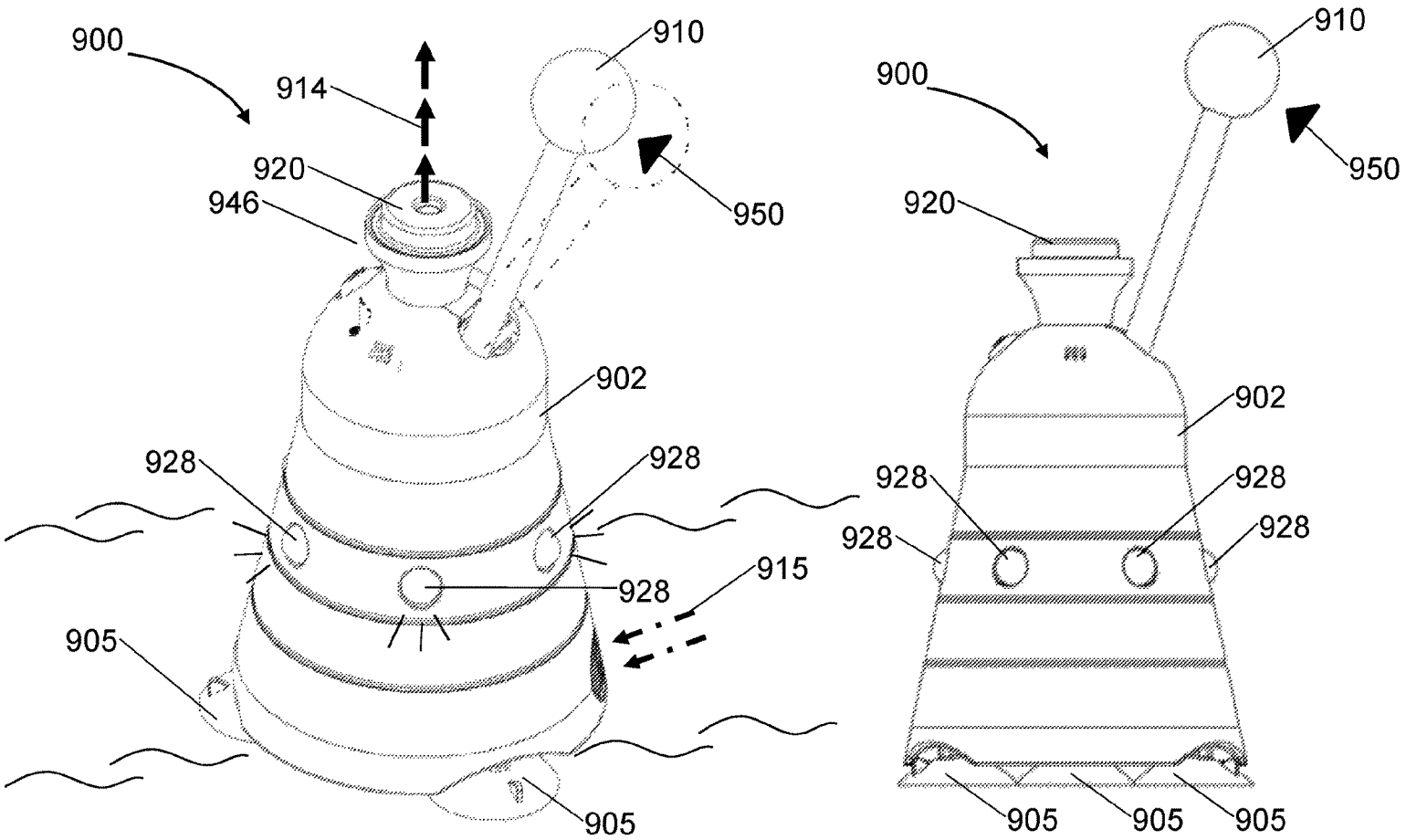
Figure 16C:
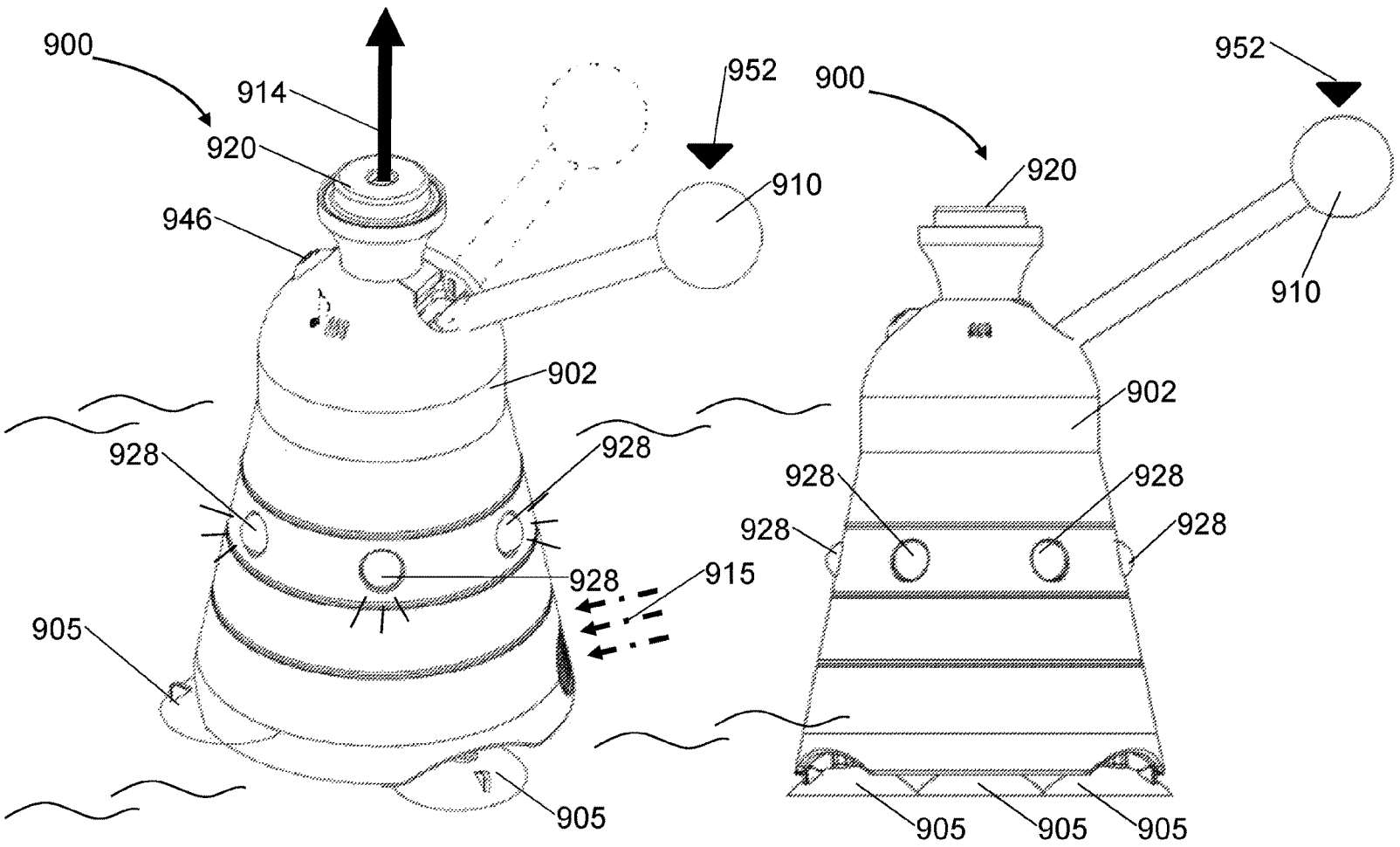
Figure 16D:
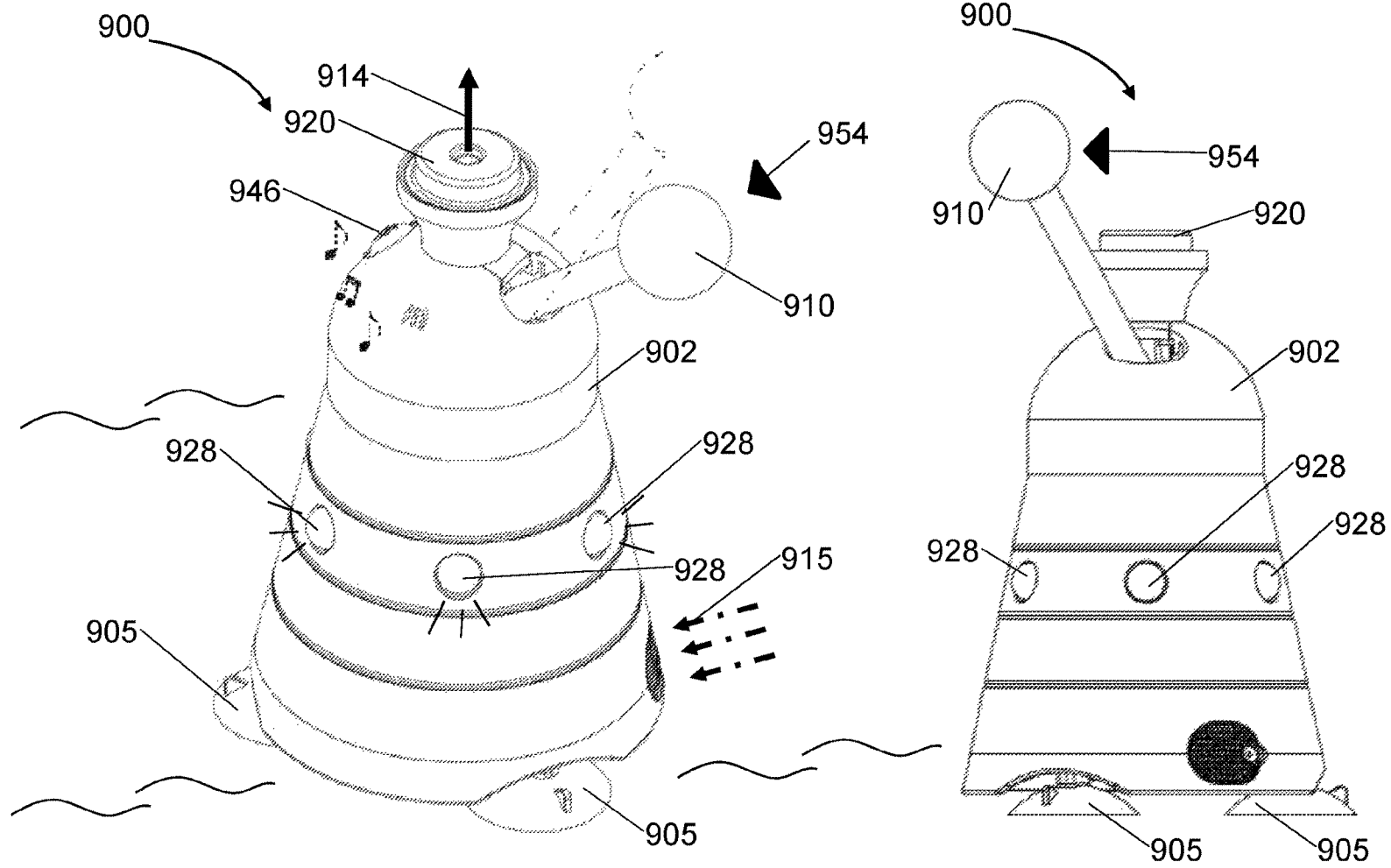
Figure 16E:
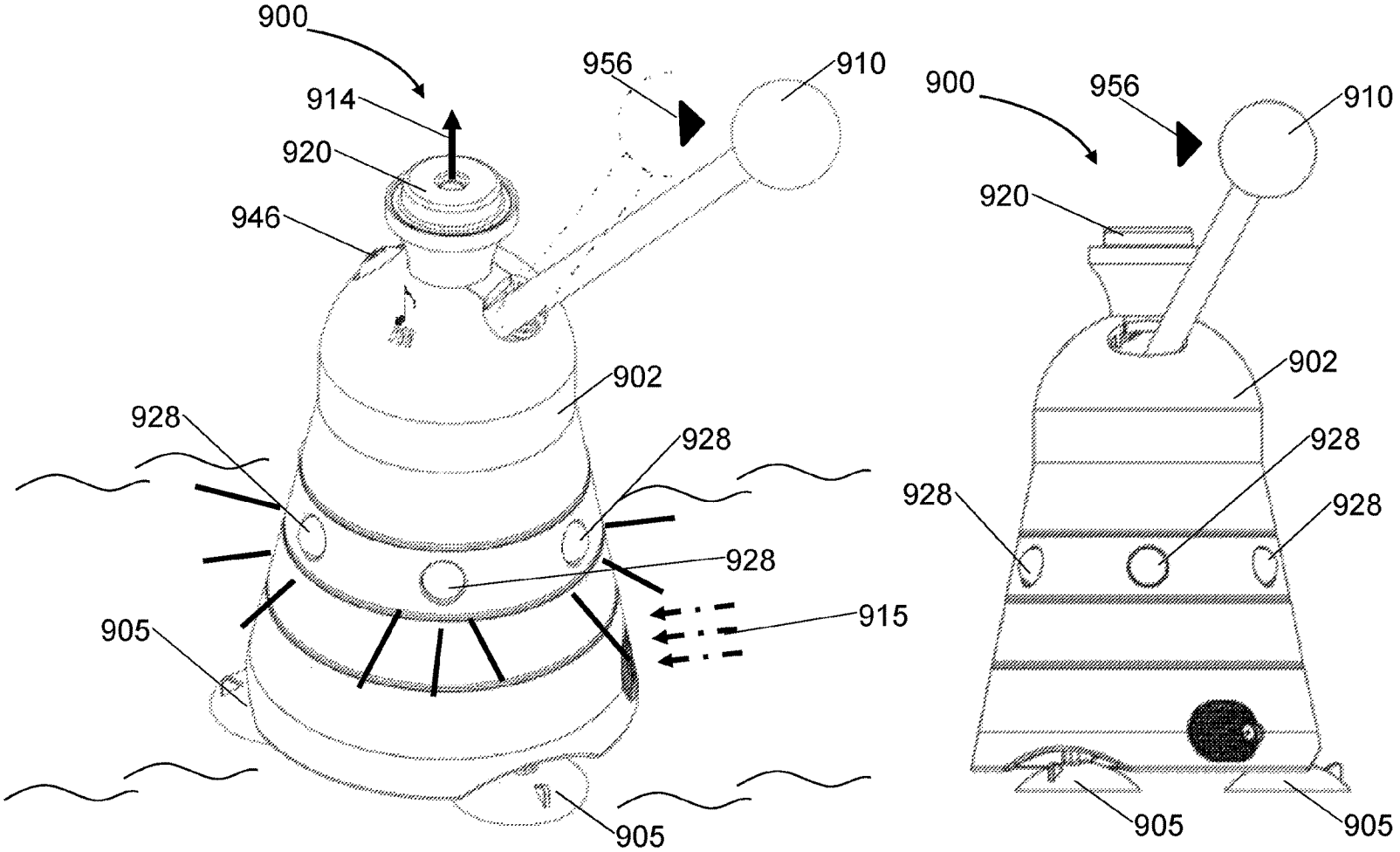
Figures 16F, 16G:
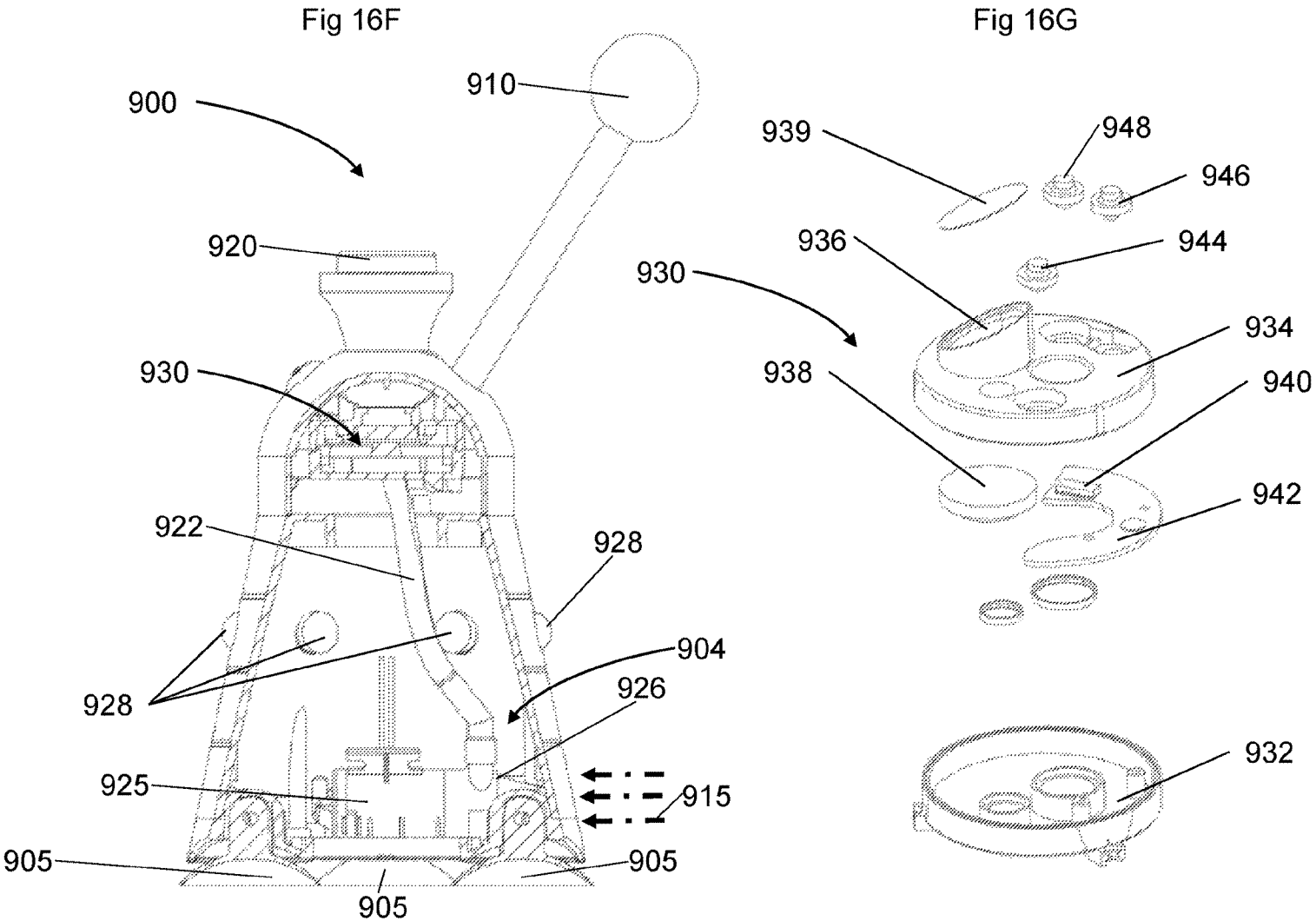
FIG. 16F is a simplified partially cut-away pictorial illustration of the multi-media joystick-controlled water toy of FIGS. 16A-16E.
FIG. 16G is a simplified exploded view illustration of parts of the multi-media joystick-controlled water toy of FIGS. 16A-16F FIGS. 17A and 17B are simplified pictorial illustrations of two operative orientations of a changeable spray stationary water toy system constructed and operative in accordance with another preferred embodiment of the invention.

Reference is now made to FIGS. 16A, 16B, 16C 16D and 16E, which are simplified pictorial illustrations of five operative orientations of a multi-media joystick-controlled water toy constructed and operative in accordance with an embodiment of the present invention; to FIG. 16F, which is a simplified partially cut-away pictorial illustration of the multi-media joystick-controlled water toy of FIGS. 16A-16E, and to FIG. 16G, which is a simplified exploded view illustration of parts of the multi-media joystick-controlled water toy of FIGS. 16A-16F.

As seen in FIGS. 16A-16G, there is provided a joystick-operated water toy system 900, preferably a bath toy, including a fanciful housing 902, which encloses a water spray generating assembly 904, which generates a vertical water spray within a water play space (not shown). In the illustrated embodiment, the housing 902 may be of any suitable desired shape. It may be fixed in place, such as by being anchored to the bottom of a bathtub by vacuum cups 905, or may float on the water in a bath. An On/Off switch (not shown) is preferably mounted on the side of housing 902. A young child operable joystick 910 is pivotably mounted onto the housing 902 and operates a spray volume controller (not shown) controlling a spray volume control valve (not shown), such that variation of the orientation of the joystick 910 produces a concomitant variation of the volume, pulse rate and/or height of a spray, here designated by reference numeral 914, produced by the water spray generating assembly 904.

The water spray generating assembly 904 is preferably mounted inside housing 902 and preferably draws water from outside the housing 902 as indicated by arrows 915. In the illustrated embodiment of FIGS. 16A-16E, preferably a single water spray 914 is provided from a nozzle 920, which is coupled by piping 922 via the spray volume control valve, operated by the spray volume controller, to the outlet of a battery-operated water pump 925 having a water inlet 926, all of which form part of the water spray generating assembly 904. Lamps, such as LEDs 928, are preferably arranged about the periphery of housing 902.

Also disposed within housing 902, preferably in a water-tight enclosure, is an electronics module 930 which provides joystick-controlled multi-media outputs, preferably including an audio component and a visual component. A simplified exploded view of the electronics module 930 is shown in FIG. 16G and it is seen that the enclosure preferably includes a bottom cover 932 and a top cover 934. The top cover defines a speaker housing portion 936 for mounting of a speaker 938, covered by a speaker membrane 939. An integrated circuit 940 governs the joystick-controlled multi-media outputs and is mounted on a printed circuit board 942. Integrated circuit 940 also preferably includes the spray volume controller, which provides joystick controlled spray control valve output based on the joystick position. A joystick controlled button 944, a manually controllable externally accessible On/Off button 946 and a manually controllable, externally accessible audio mute button 948 cooperate with circuitry on the printed circuit board 942.

A plurality of typical operative orientations of the joystick-operated toy of FIGS. 16A-16G will now be described, it being understood that these are mere illustrative examples and that a great variety of multi-media outputs may be realized by suitable positioning of the joystick.

FIG. 16A shows the water toy of FIGS. 16A-16G in an ON state, preferably resulting from pressing on the On/Off button 946. The joystick 910 in an intermediate vertically pivoted operative orientation and is centered. In this operative orientation, a continuous level spray 914, a low level output of lights 928 and a low level audio output are provided.

FIG. 16B shows the water toy of FIGS. 16A-16G also in an ON state, preferably resulting from pressing on the On/Off button 946. The joystick 910 in a raised vertically pivoted operative orientation, as indicated by an arrow 950, and is centered. In this operative orientation, an intermediate level pulsed spray 914, a low level output of lights 928 and a low level audio output are provided.

FIG. 16C shows the water toy of FIGS. 16A-16G also in an ON state, preferably resulting from pressing on the On/Off button 946. The joystick 910 in a lowered vertically pivoted operative orientation, as indicated by an arrow 952, and is centered. In this operative orientation, a high level continuous spray 914, a low level output of lights 928 and a low level audio output are provided.

FIG. 16D shows the water toy of FIGS. 16A-16G also in an ON state, preferably resulting from pressing on the On/Off button 946. The joystick 910 is shifted to the left, in the sense of FIG. 16D, relative to its position in FIG. 16A, as indicated by an arrow 954. In this operative orientation, a low level pulsed spray 914, a low level output of lights 928 and a high level audio output are provided.

FIG. 16E shows the water toy of FIGS. 16A-16G also in an ON state, preferably resulting from pressing on the On/Off button 946. The joystick 910 is shifted to the right, in the sense of FIG. 16D, relative to its position in FIG. 16A, as indicated by an arrow 956. In this operative orientation, a low level pulsed spray 914, a high level output of lights 928 and a low level audio output are provided.

It is noted that On/Off functionality is preferably not provided by the joystick 910.

In accordance with another preferred embodiment of the present invention, joystick 910 may be obviated and integrated circuit 940 may provide multi-media outputs and/or water spray outputs in accordance with one or more predetermined programs, including, inter alia, providing multi-media outputs in time coordination with at least one operational parameter of the water spray assembly.

Figure 17B:
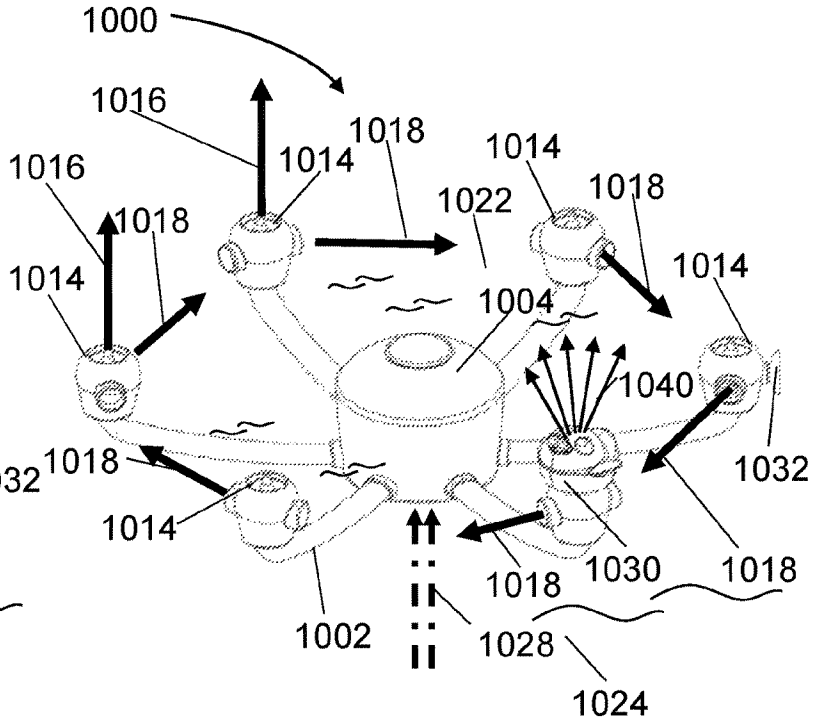
FIG. 17C is a simplified sectional illustrations of a base unit forming part of the changeable spray water toy system of FIGS. 17A & 17B taken along section lines C-C in FIG. 17A.
Figure 17A:
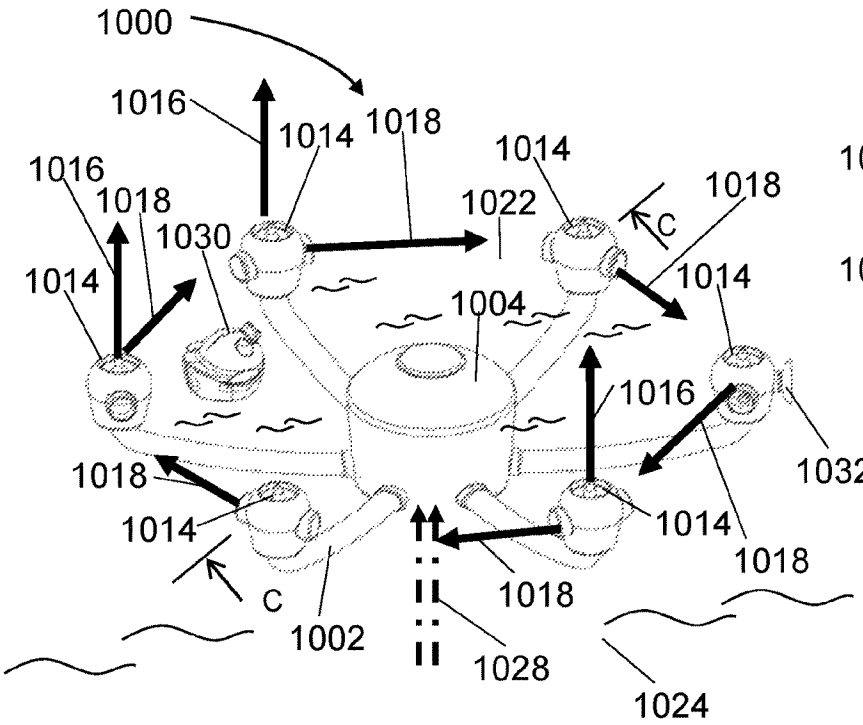
Figure 17C:
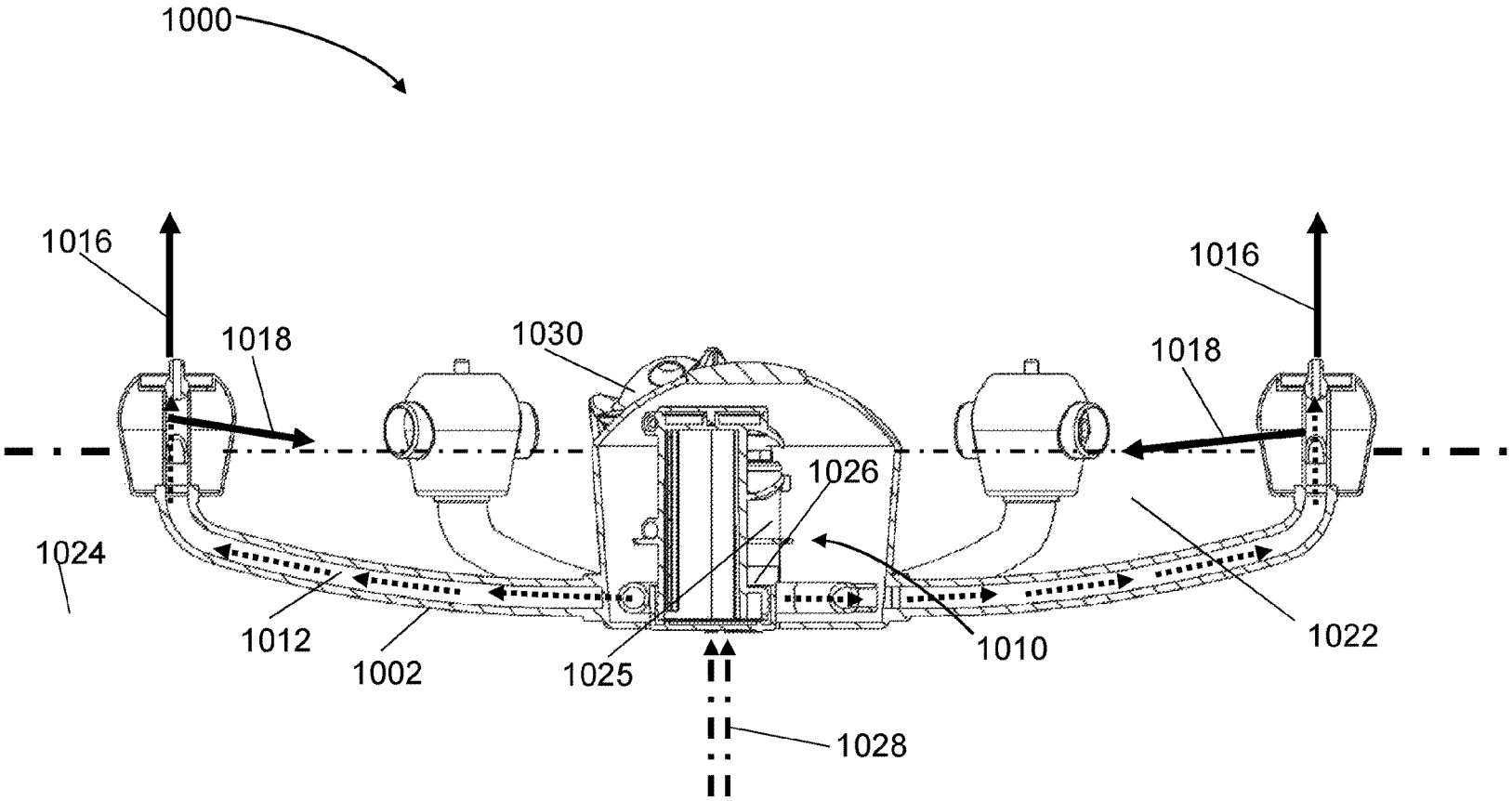

Reference is now made to FIGS. 17A and 17B, which are simplified pictorial illustrations of two operative orientations of a changeable spray stationary water toy system constructed and operative in accordance with another preferred embodiment of the invention, and to FIG. 17C, which is a simplified sectional illustration of a base unit forming part of the changeable spray water toy system of FIGS. 17A & 17B taken along section lines C-C in FIG. 17A.

As seen in FIGS. 17A-17C, there is provided a changeable spray water play space delimited anchored water toy system 1000, preferably a bath toy, including a housing 1002 including a central portion 1004 enclosing a water spray generating assembly 1010, from which central portion extend multiple generally radially extending conduits 1012, each of which terminates in a nozzle 1014, which produces an upwardly directing spray 1016. Nozzles 1014 also provide a water spray that has at least a non-radial component in the plane of the nozzles 1014, which may be a tangential spray, as shown by arrows 1018. Non-radial water sprays 1018 define therewithin a water play space 1022.

Water play space 1022 is preferably in the form of a generally circular ring-like space, preferably arranged to be located in a water-filled bath region 1024, separate in its area from a remainder of the water filled bath region 1024.

Each of nozzles 1014 generates a central generally vertical water spray 1016 in the water play space 1022 and at least one, and preferably a few, floatable unsinkable and unlistable fanciful objects, such as toy ducks 1030, an example of which is described hereinabove with reference to FIG. 8D, are arranged to be floatable on water within the water play space 1022.

In the illustrated embodiment, the water toy system 1000 defining water play space 1022 may be fixed in place, such as by being anchored to the side of a bathtub by means of a suction cup 1032, or may float on the water in the bath. In this embodiment, sprays 1018 forming water play space 1022 provide a function similar to the functionality of the water space delimiter shown in the embodiment of FIGS. 1A & 1B, and restrict the range of movement of the floatable fanciful elements to within a desired water play space, preferably in front of a child.

Each nozzle 1014 is coupled by a conduit 1012 to the outlet of a battery-operated water pump 1025 having a water inlet 1026, all of which form part of the water spray generating assembly 1010. Water is preferably drawn from the bath from below housing 1002, as indicated by arrows 1028.

In the embodiment of FIGS. 17A-17C, the water spray generating assembly 1010 and specifically nozzles 1014 are each configured for selectably receiving in engagement with nozzle 1014 one of a plurality of floating unlistable and unsinkable mutually differently fanciful spray modulating objects, such as toy ducks 1030, which are selectably placeable in water spray receiving engagement with a nozzle 1014 of the water spray generating assembly 1010 and which are operative to convert single vertical water spray 1016 having a first spatial configuration received at at least a first location thereat to a water spray 1040 having a second spatial configuration emitted at at least a second location thereat which is different from the first spatial configuration. A preferred embodiment of such a floating unlistable and unsinkable mutually differently fanciful spray modulating object, such as toy ducks 1030, is described hereinabove with reference to FIG. 8D, it being appreciated that various such objects preferably each have a differently configured outlet spray.

It is a particular feature of the spray modulating objects, such as toy ducks 1030, irrespective of their fanciful configuration and their output spray arrangement, that they are floating, unlistable and unsinkable. These properties preserve their play value and are the result of the provision of at least one and preferably more, volumes filled with a buoyant material, such as a gas or a closed cell foamed plastic material.

Figure 18A:
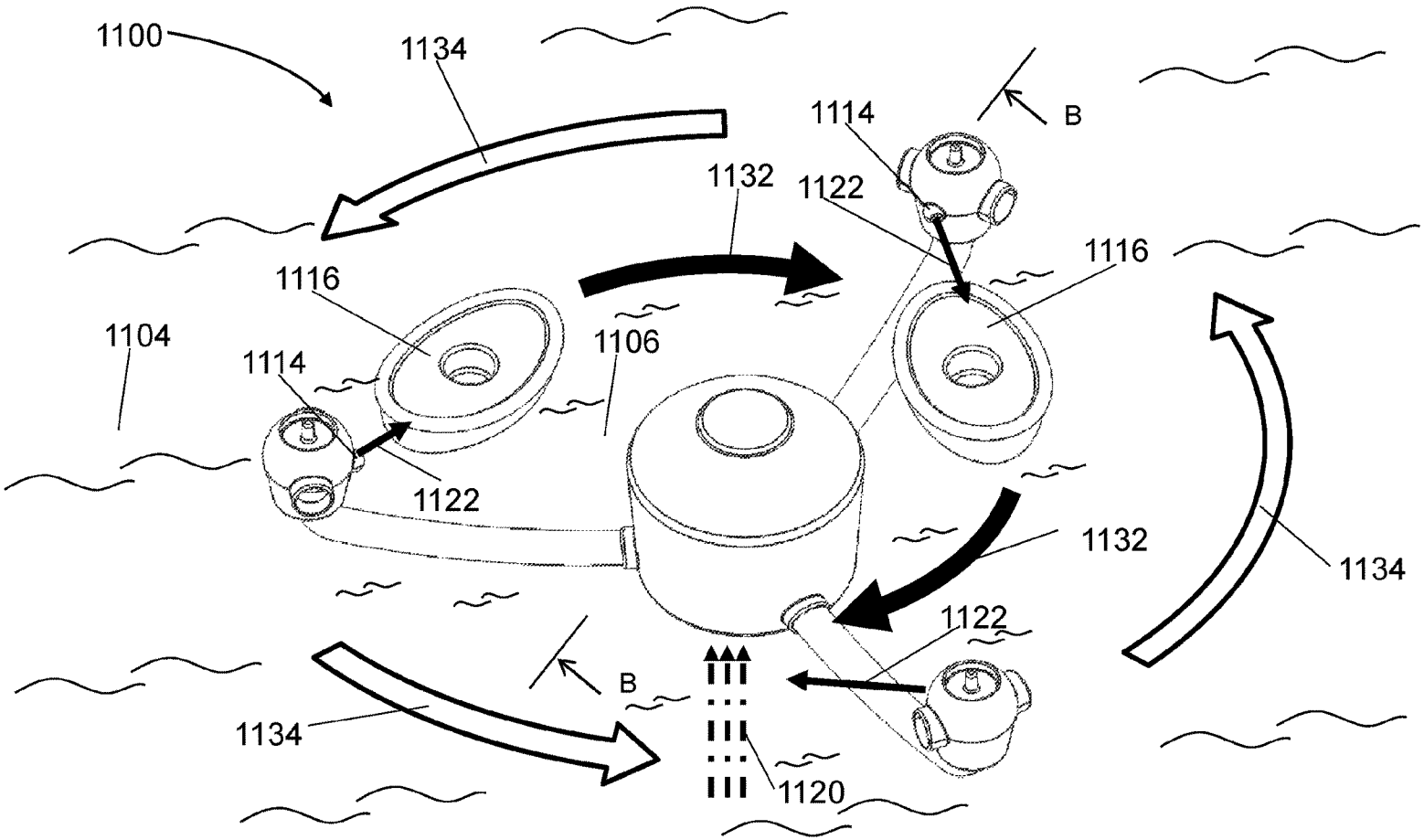
FIGS. 18A and 18B are simplified, respective pictorial and sectional illustrations of a water toy constructed and operative in accordance with a yet further alternative embodiment of the present invention, FIG. 18B being taken along lines B-B in FIG. 18A.
Figure 18B:
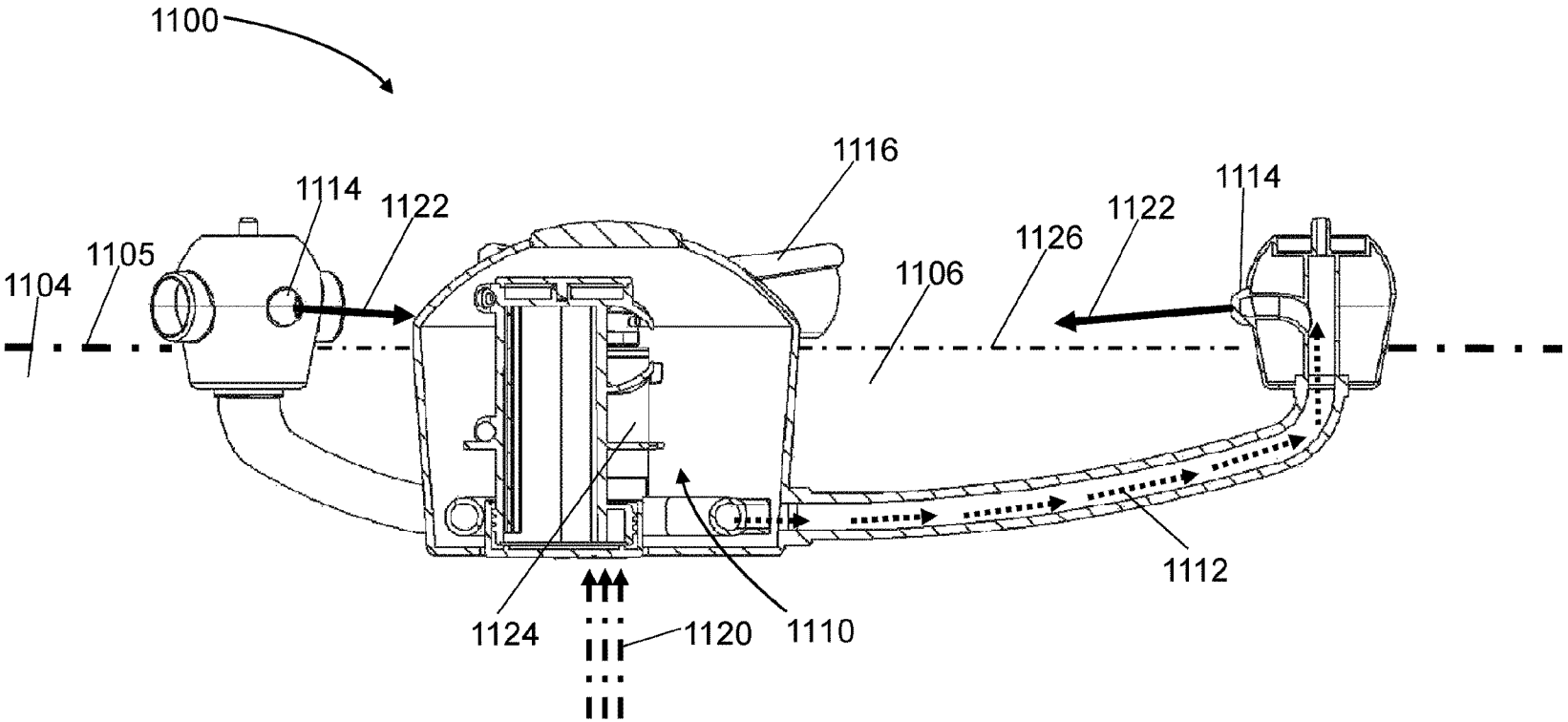

Reference is now made to FIGS. 18A and 18B, which are simplified, respective pictorial and sectional and functional illustrations of a water toy constructed and operative in accordance with a yet further alternative embodiment of the present invention, FIG. 18B being taken along lines B-B in FIG. 18A.

As seen in FIGS. 18A and 18B, there is provided a water toy system 1100, preferably a bath toy, preferably arranged to be located in a water-filled bath 1104, having a nominal water line 1105, and to define a water play space 1106 in water filled bath 1104.

A water spray generating assembly 1110 is preferably coupled by a plurality of generally radially directed conduits 1112 to a plurality of nozzles 1114, each of which generates at least one water spray within the water play space 1106 and at least one, and preferably a few, floatable, unsinkable, unlistable fanciful objects, such as toy boats 1116, are arranged to be floatable on water within the water play space 1106.

The water spray generating assembly 1110 is located centrally of nozzles 1114 and preferably draws water from below the water play space 1106, as illustrated by arrows 1120, and sprays the water into the water play space 1106, as indicated by arrows 1122. In the illustrated embodiment of FIGS. 1A & 1B, multiple water sprays are provided by multiple nozzles 1114, which are coupled by conduits 1112 to the outlet of a battery-operated water pump 1124.

It is a particular feature of this embodiment of the invention that at least some of nozzles 1114 provide a water spray that has at least a non-radial component in the plane of the nozzles 1114 and the boats 1116, which may be a tangential spray, as shown by arrows 1122. Here this water spray is shown to be above the water line 1126 of the water play space 1106 and to impinge on floatable fanciful objects, such as toy boats 1116, preferably causing them to be displaced in a generally circular motion indicated by arrows 1132 along a track defined by the sprays indicated by arrows 1122. The reaction force of the non-radial sprays indicated by arrows 1122 causes a corresponding rotation of the remainder of the water toy system in a direction indicated by arrows 1134.

If the toy is free floating, as illustrated, the mutually counter rotations of the floatable fanciful objects such as toy boats 1116, indicated by arrows 1132, and of the remainder of the toy system, indicated by arrows 1134, may continue as long as the sprays along arrows 1122 are provided. If, however, the toy, other than the boats 1116, is tethered, eventually the counter torque in the tether resulting from its rotation will cause its rotation to stop and rotation in an opposite direction to commence. This back rotation of the toy will enhance the rotation force applied to the objects, such as toy boats 1116, by the sprays along arrows 1122. The back rotation of the toy will continue until the torque falls below a threshold that will allow rotation of the toy, as indicated by arrows 1134, to commence again. This cyclic rotational motion will continue as long as the non-radial sprays along arrows 1122 are provided.

It is appreciated that alternatively, the sprays along arrows 1122 may be replaced by underwater positive water flows in the same direction, with generally the same effects as those described hereinabove.

Figures 19A, 19B:
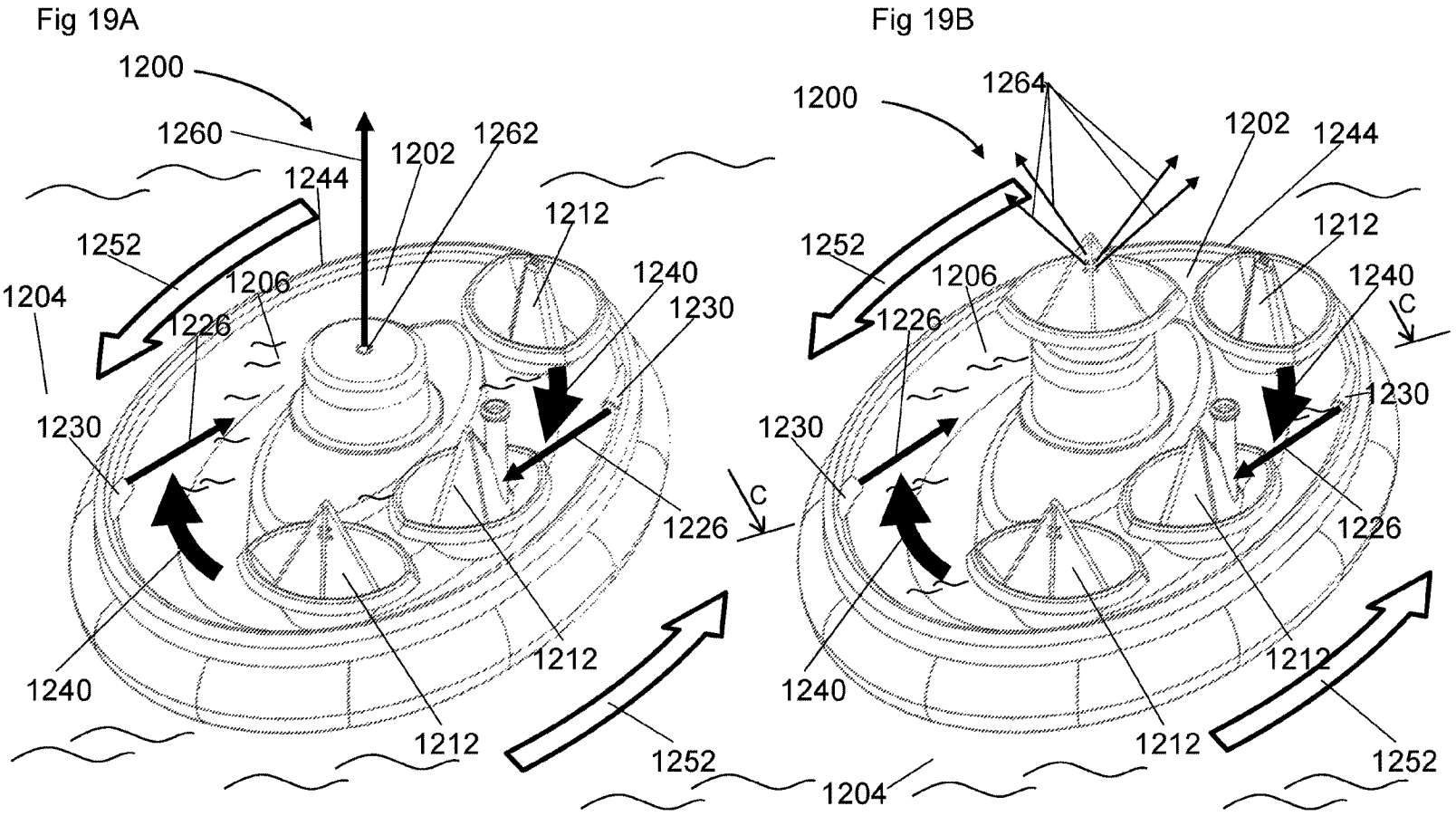
FIGS. 19A and 19B are simplified, respective pictorial and functional illustrations of a water toy constructed and operative in accordance with a yet further alternative embodiment of the present invention.
Figure 19C:
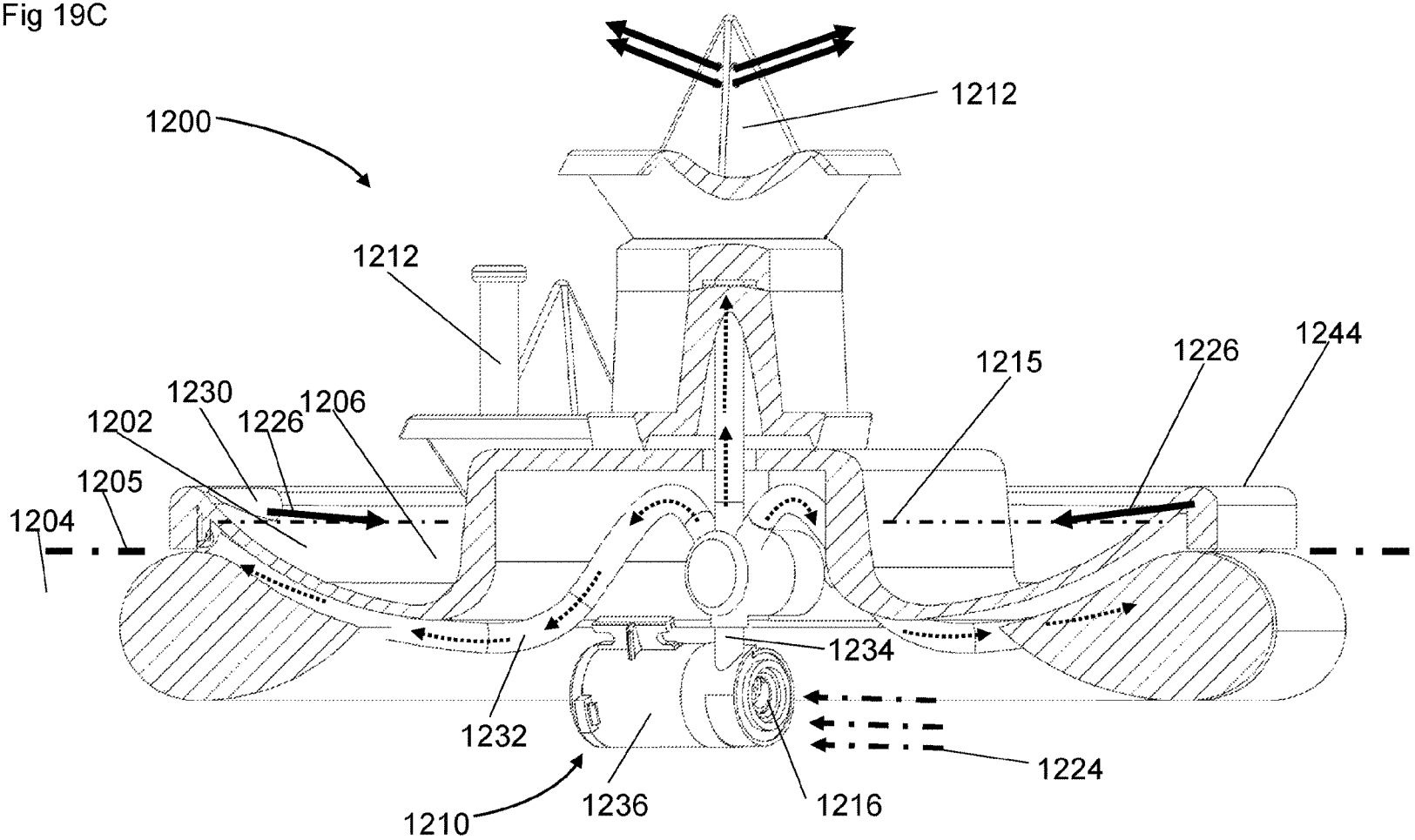
FIG. 19C is a simplified sectional illustration of a base unit forming part of the changeable spray water toy system of FIGS. 19A & 19B taken along section lines C-C in FIG. 19A.

Reference is now made to FIGS. 19A and 19B, which are simplified, respective pictorial illustrations of a water toy constructed and operative in accordance with a yet further alternative embodiment of the present invention, and to FIG. 19C, which is a simplified sectional illustration of a base unit forming part of the changeable spray water toy system of FIGS. 19A & 19B taken along section lines C-C in FIG. 19B.

As seen in FIGS. 19A-19C, there is provided a water toy system 1200, preferably a bath toy, including a water play space delimiter, preferably in the general form of a bowl 1202, preferably arranged to be located in a water-filled bath region 1204, having a nominal water line 1205, and to define an at least partially water-filled water play space 1206, separate from a remainder of the water filled bath 1204.

A water spray generating assembly 1210 generates at least one, and preferably two, pressurized water sprays and/or currents within the water play space 1206 and at least one, and preferably a few, floatable fanciful elements, such as toy boats 1212, are arranged to be floatable on water within the water play space 1206.

In the illustrated embodiment, the water space delimiter may be a concave enclosure or bowl 1202 of any suitable desired shape. It is preferably freely floating on the water in the bath region 1204. A principal function of the water space delimiter is to restrict the range of movement of the floatable fanciful elements to within a desired water play space, preferably in front of a child. Another function of the water space delimiter is to define a relatively calm water surface in the water play space 1206. In this embodiment, a further function of the delimiter is to raise at least part of the water play space 1206 to a height above that of the bath region 1204, such that a water line 1215 of the water play space 1206 is decoupled from the water line 1205 of the bath region 1204 and may be above or below water line 1205. In the illustrated embodiment, the water line 1215 is seen to be above water line 1205.

The water spray generating assembly 1210 is preferably integrally formed with delimiter 1202 and is located therebelow and at the center thereof. Water spray generating assembly 1210 preferably draws water, via a water inlet 1216, from outside the water play space 1206 and below the delimiter, as illustrated by arrows 1224, and directs two streams of pressurized water under water line 1215 into the water play space 1206, in a non-radial direction, which may be, which may be tangential to a generally circular area defined by the deliminter, as indicated by arrows 1226, for creating a preferably circular current and preferably intermittently impinging on an underwater portion of each of toy boats 1212, thereby displacing the toy boats 1212 in an endless circular loop.

In the illustrated embodiment of FIGS. 19A-19C, preferably the streams indicated by arrows 1226 exit from nozzles 1230, which are coupled by piping 1232 to the outlet 1234 of a battery-operated water pump 1236 which receives water via water inlet 1216, all of which form part of the water spray generating assembly 1210, thereby generating a water current in an endless loop, as indicated by arrows 1240, for displacing the floatable fanciful elements, such as toy boats 1212, in endless loop motion.

In the embodiment of FIGS. 19A-19C, the water play space 1206 is defined by the bowl 1202 in area and in depth. The water play space 1206 may be considered to extend above the water line 1205 of the bath region 1204 and above the water line 1215 of the water play space 1206, preferably to a height to which the top surface of the delimiter extends, here designated by reference numeral 1244. Alternatively, the water play space may be considered to extend above height 1244 to a maximum height reached by floatable elements, such as toy boats 1212.

In the illustrated embodiment, the water space delimiter may be entirely freely floatable or alternatively may be floatable and tethered so that it can rotate but is not displaced from a given general location in the bath.

It is a particular feature of this embodiment of the invention that at least some of nozzles 1214 provide a water spray that has at least a non-radial component in the plane of the delimeter, which may be a tangential component, as shown by arrows 1226. Here this water spray is shown to be above the water line 1215 of the water play space 1206 and to impinge on floatable fanciful objects, such as toy boats 1212, preferably causing them to be displaced in a generally circular motion indicated by arrows 1240 along a track defined by the sprays indicated by arrows 1226 and by the delimiter. The reaction force of the preferably tangential sprays indicated by arrows 1226 causes a corresponding rotation of the remainder of the water toy system including the delimiter in a direction indicated by arrows 1252.

If the delimiter is free floating, the mutually counter rotations of the floatable fanciful objects, such as toy boats 1212, indicated by arrows 1240, and of the remainder of the toy system, indicated by arrows 1252, may continue as long as the sprays along arrows 1226 are provided. If, however, the delimiter is tethered, eventually the counter torque in the tether resulting from the rotation of the delimiter will cause its rotation to stop and rotation in an opposite direction to commence. This back rotation of the delimiter will enhance the rotation force applied to the objects, such as toy boats 1212, by the sprays along arrows 1226. The back rotation of the delimiter will continue until the torque falls below a threshold that will allow rotation of the delimiter as indicated by arrows 1252 to commence again. This cyclic rotational motion will continue as long as the non-radial sprays along arrows 1226 are provided.

It is appreciated that alternatively, the sprays along arrows 1226 may be replaced by underwater positive water flows in the same direction, with generally the same effects as those described hereinabove.

In the embodiment of FIGS. 19A-19C, the water spray generating assembly 1210 also preferably provides a generally vertical spray 1260 from a nozzle 1262. Nozzle 1262 is preferably configured for selectably receiving in engagement therewith one of a plurality of floating unlistable and unsinkable mutually differently fanciful spray modulating objects, such as toy boats 1212, which are selectably placeable in water spray receiving engagement with nozzle 1262 of the water spray generating assembly 1210 and which are operative to convert vertical water spray 1260 having a first spatial configuration received at at least a first location thereat to a water spray 1264 having a second spatial configuration emitted at at least a second location thereat which is different from said first spatial configuration. A preferred embodiment of such a floating unlistable and unsinkable mutually differently fanciful spray modulating object, such as toy boats 1212, may be essentially similar, except for fanciful features, to that of toy ducks 530 described hereinabove with reference to FIG. 8A-9C, it being appreciated that various such objects preferably each have a differently configured outlet spray.

It is a particular feature of the spray modulating objects, such as toy boats 1212, irrespective of their fanciful configuration and their output spray arrangement, that they are floating, unlistable and unsinkable. These properties preserve their play value and are the result of the provision of at least one, and preferably more, volumes filled with a buoyant material, such as a gas or a closed cell foamed plastic material.

Figures 20A, 20B:
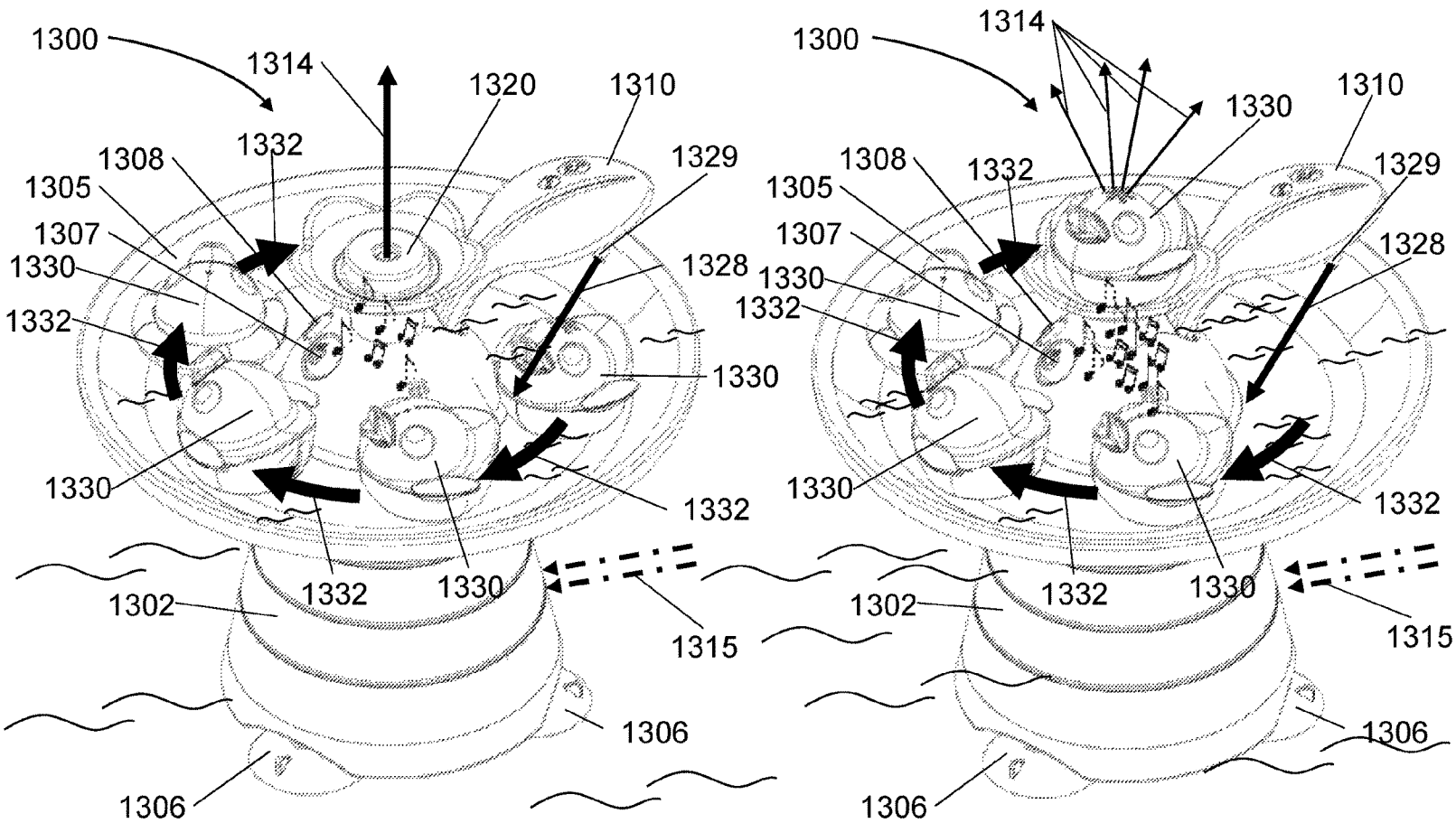
FIGS. 20A, 20B, 20C and 20D are simplified pictorial illustrations of four operative orientations of a multi-media joystick-controlled water toy constructed and operative in accordance with an embodiment of the present invention.
Figure 20D:
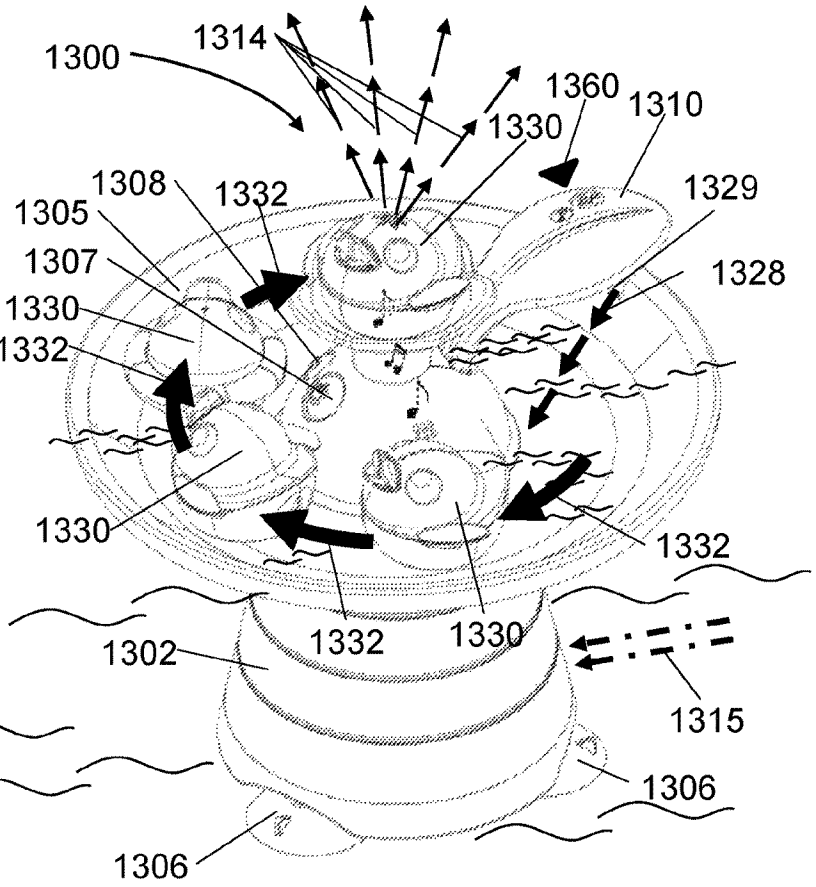
Figure 20C:
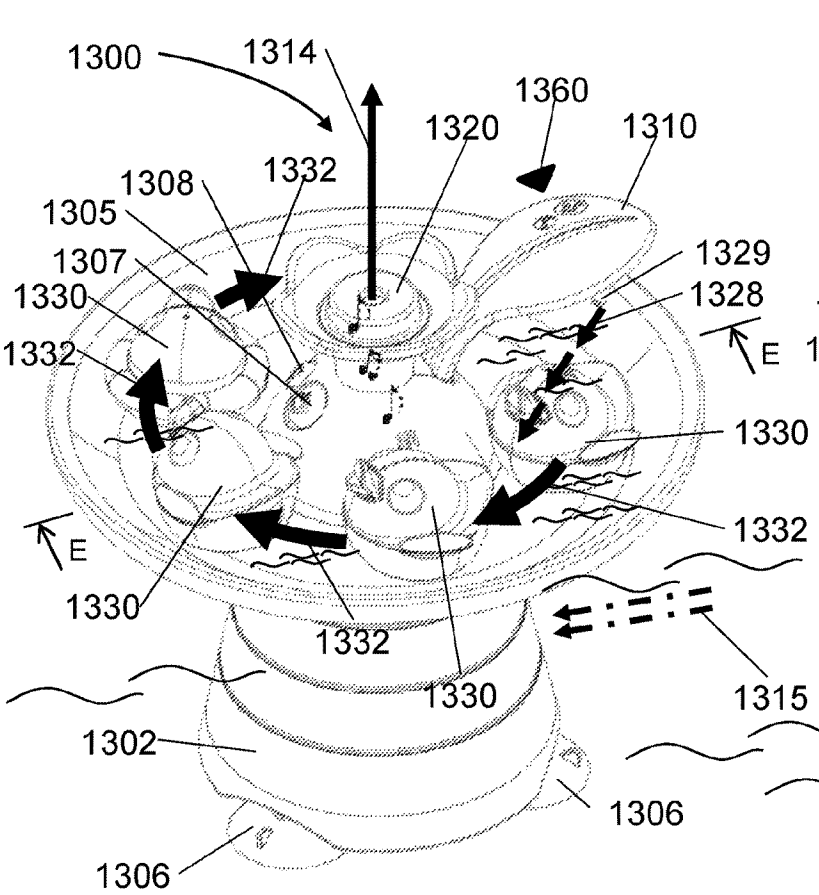
Figure 20F:
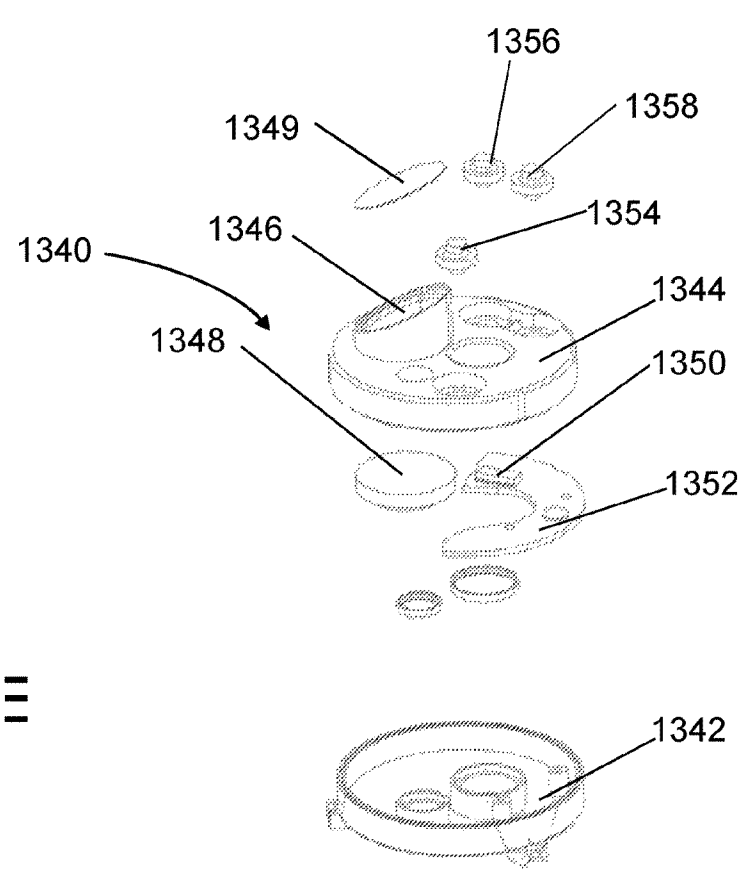
FIG. 20F is a simplified exploded view illustration of parts of the multi-media joystick-controlled water toy of FIGS. 20A-20E.
Figure 20E:
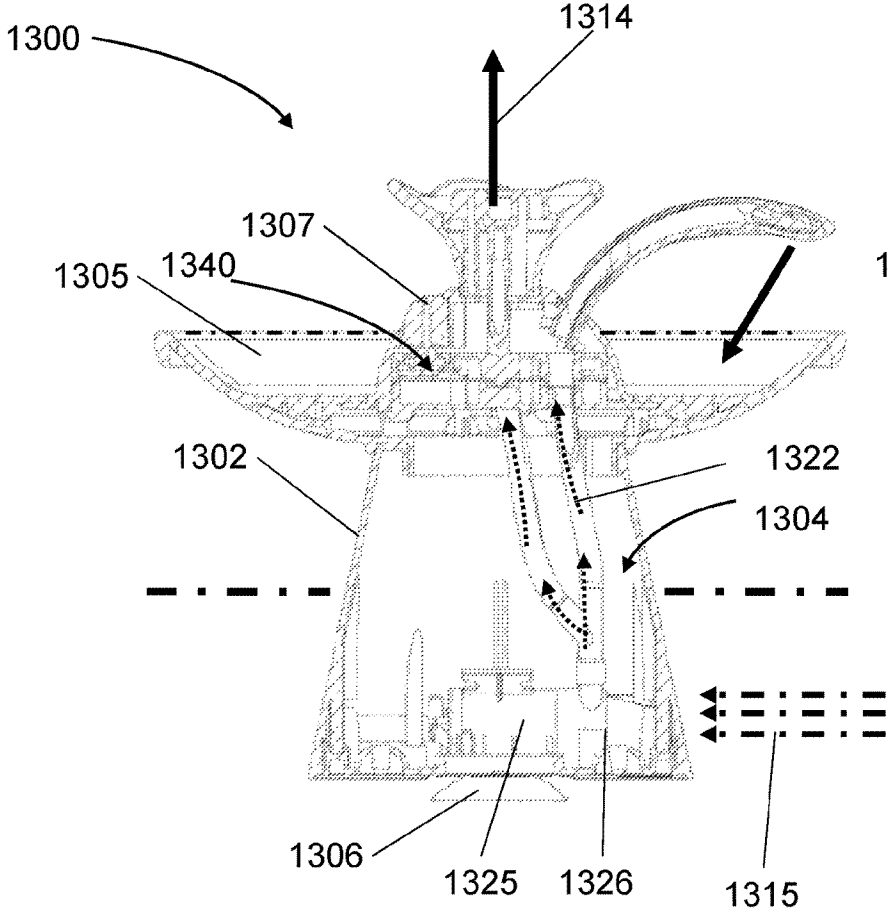
FIG. 20E is a simplified partially cut-away pictorial illustration of the multi-media joystick-controlled water toy of FIGS. 20A-20D taken along section lines E-E in FIG. 20A.

Reference is now made to FIGS. 20A, 20B, 20C and 20D, which are simplified pictorial illustrations of four operative orientations of a multi-media joystick-controlled water toy constructed and operative in accordance with an embodiment of the present invention, to FIG. 20E, which is a simplified partially cut-away pictorial illustration of the multi-media joystick-controlled water toy of FIGS. 20A-20D and to FIG. 20F, which is a simplified exploded view illustration of parts of the multi-media joystick-controlled water toy of FIGS. 20A-20E.

As seen in FIGS. 20A-20E, there is provided a joystick-operated water toy system 1300, preferably a bath toy, including a fanciful housing 1302, which encloses a water spray generating assembly 1304, which generates a vertical water spray within a water play space defined by a water play space delimiter preferably in the form of a bowl 1305. In the illustrated embodiment, the housing 1302 may be of any suitable desired shape. It may be fixed in place, such as by being anchored to the bottom of a bathtub by vacuum cups 1306, or may float on the water in a bath. An On/Off switch 1307 and a mute switch 1308 are preferably mounted on the side of housing 1302. A young child operable joystick 1310 is pivotably mounted onto the housing 1302 and operates a spray volume controller (not shown) of a spray volume control valve (not shown), such that variation of the orientation of the joystick 1310 produces a concomitant variation of the volume, pulse rate and/or height of a spray, here designated by reference numeral 1314, produced by the water spray generating assembly 1304. The structure and operation of the joystick 1310 in governing the spray volume and/or height may be similar or identical to those described hereinabove with reference to FIGS. 16A-16G.

The water spray generating assembly 1304 is preferably mounted inside housing 1302 and preferably draws water from outside the housing 1302 as indicated by arrows 1315. In the illustrated embodiment of FIGS. 20A-20F, preferably a single water spray 1314 is provided from a nozzle 1320, which is coupled by piping 1322 via the spray volume control valve, operated by the spray volume controller, to the outlet of a battery-operated water pump 1325 having a water inlet 1326, all of which form part of the water spray generating assembly 1304.

Preferably a second, tangential spray 1328 is provided from a nozzle 1329, on bowl 1305, which is coupled by piping 1322 via the same or a different spray volume control valve, operated by the same or a different spray volume controller, to the outlet of battery-operated water pump 1325. This tangential spray 1328 preferably drives a plurality of floatable, unsinkable, unlistable objects, such as toy ducks 1330, in continuous loop motion in bowl 1305, as indicated by arrows 1332. The toy ducks 1330 may be constructed and operative as described hereinabove with reference to FIGS. 8A-8D.

Also disposed within housing 1302, preferably in a water-tight enclosure, is an electronics module 1340 which provides joystick-controlled multi-media outputs, preferably including an audio component and a visual component. A simplified exploded view of the electronics module 1340 is shown in FIG. 20F and it is seen that the enclosure preferably includes a bottom cover 1342 and a top cover 1344. The top cover defines a speaker housing portion 1346 for mounting of a speaker 1348, covered by a speaker membrane 1349. An integrated circuit 1350 governs the joystick-controlled multi-media outputs and is mounted on a printed circuit board 1352. Integrated circuit 940 also preferably includes the spray volume controller, which provides joystick controlled spray control valve output based on the joystick position. A joystick controlled button 1354, a manually controllable externally accessible On/Off button 1356 and a manually controllable, externally accessible audio mute button 1358 cooperate with circuitry on the printed circuit board 1352.

A plurality of typical operative orientations of the joystick-operated toy of FIGS. 20A-20F will now be described, it being understood that these are mere illustrative examples and that a great variety of multi-media outputs may be realized by suitable positioning of the joystick.

FIG. 20A shows the water toy of FIGS. 20A-20F in an ON state, preferably resulting from pressing on the On/Off button 1307. The joystick 1310 in a first operative orientation and is centered. In this operative orientation, a continuous single vertical spray 1314, a continuous tangential spray 1328 and an audio output are provided.

FIG. 20B shows the water toy of FIGS. 20A-20F with the same joystick arrangement as in FIG. 20A, only here one of the toy ducks 1330 is placed over and in operative engagement with nozzle 1320 and provides a modified spray output, as described hereinabove with reference to FIGS. 8A-8D.

FIG. 20C shows the water toy of FIGS. 20A-20F in an ON state, preferably resulting from pressing on the On/Off button 1307. The joystick 1310 in a second operative orientation, rotated to the left relative to the orientation of FIG. 20A as indicated by an arrow 1360. In this operative orientation, a pulsed single vertical spray 1314, a pulsed tangential spray 1328 and an audio output are provided.

FIG. 20D shows the water toy of FIGS. 20A-20F with the same joystick arrangement as in FIG. 20C, only here one of the toy ducks 1330 is placed over and in operative engagement with nozzle 1320 and provides a modified spray output, as described hereinabove with reference to FIGS. 8A-8D.

It is noted that On/Off functionality is preferably not provided by the joystick 1310.

Figures 21A, 21C:
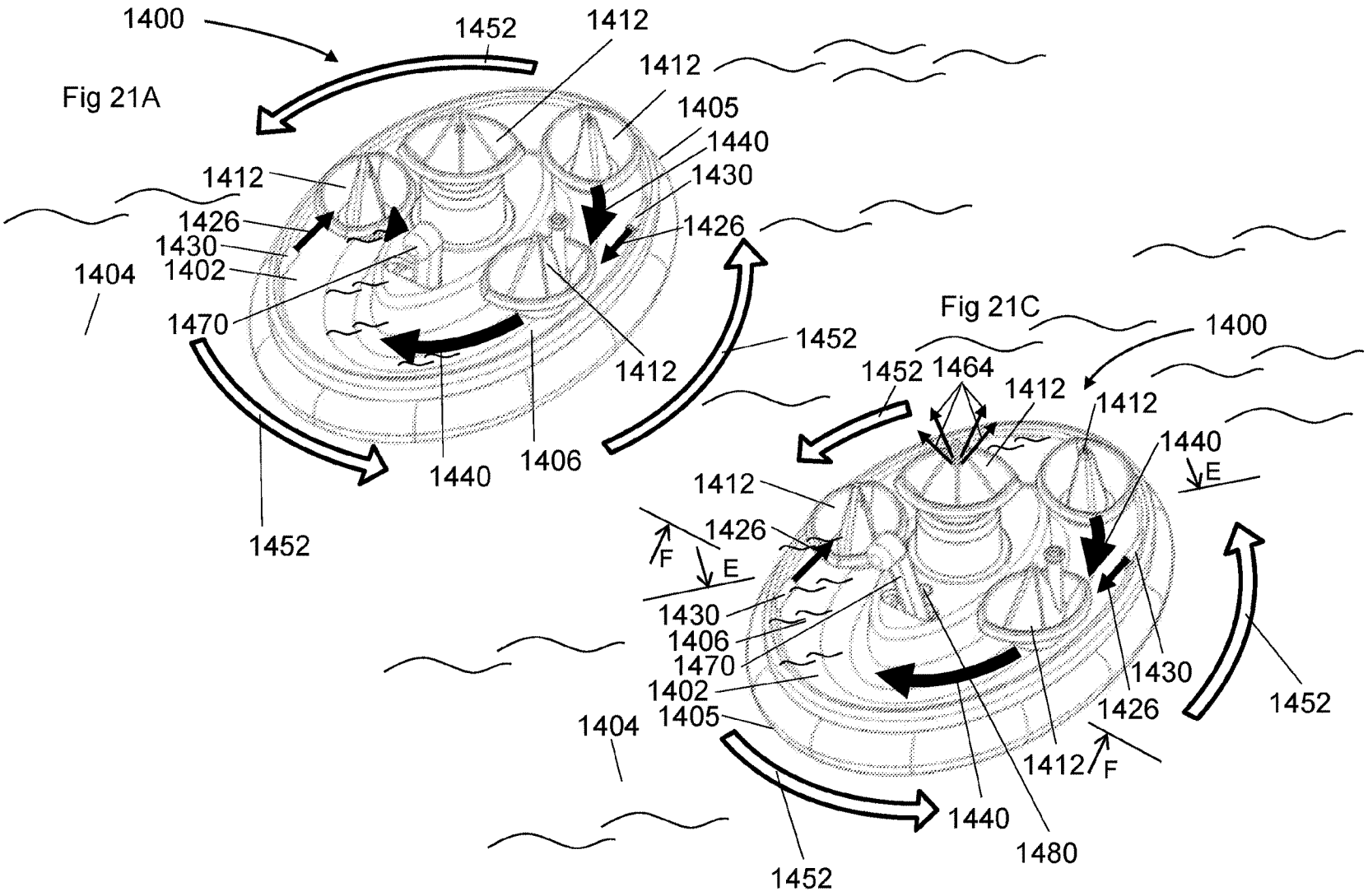
FIGS. 21A, 21B, 21C and 21D are simplified pictorial illustrations of four operative orientations of a joystick-controlled floating water toy constructed and operative in accordance with another embodiment of the present invention.
Figures 21B, 21D:
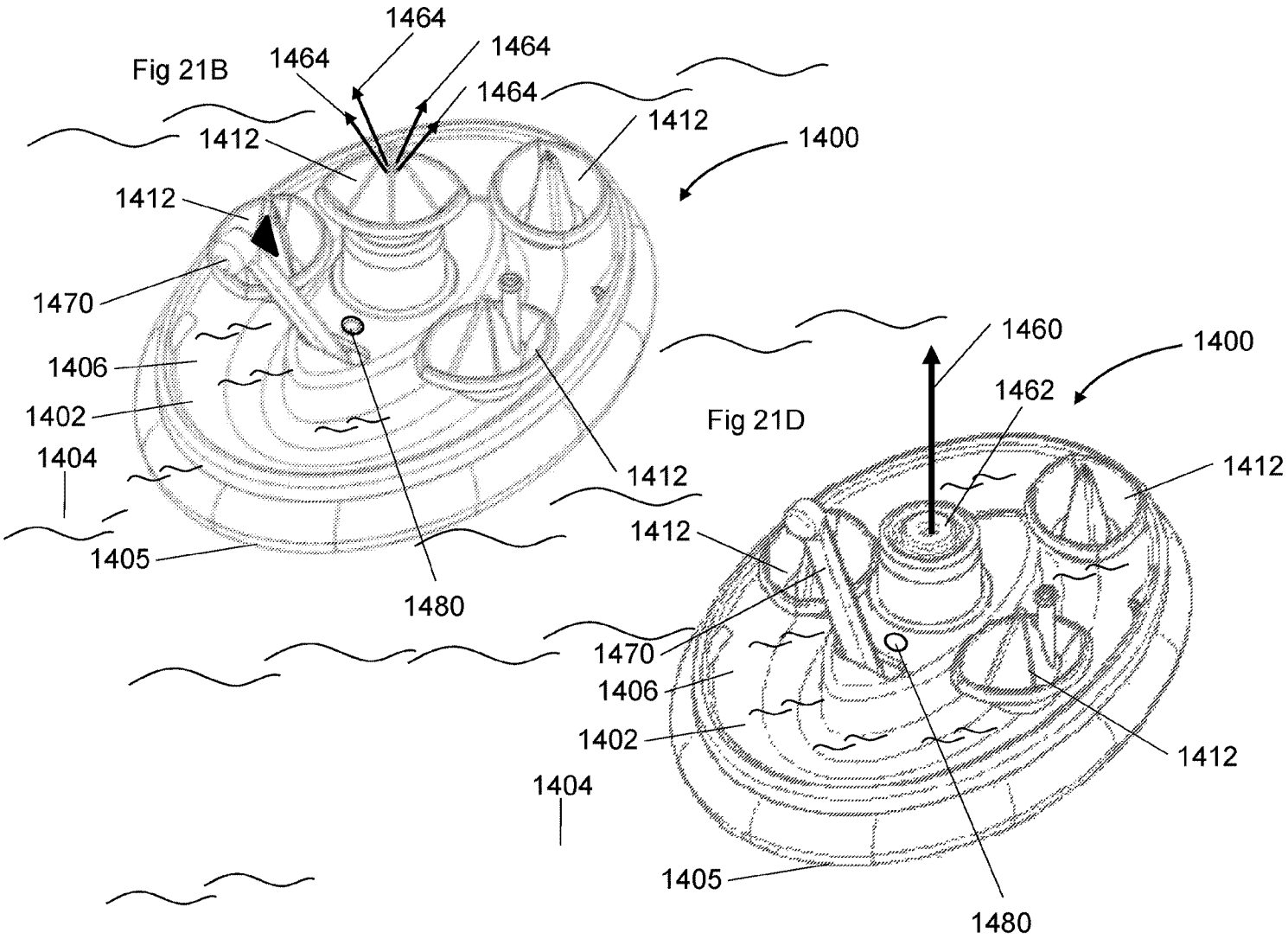
Figure 21E:
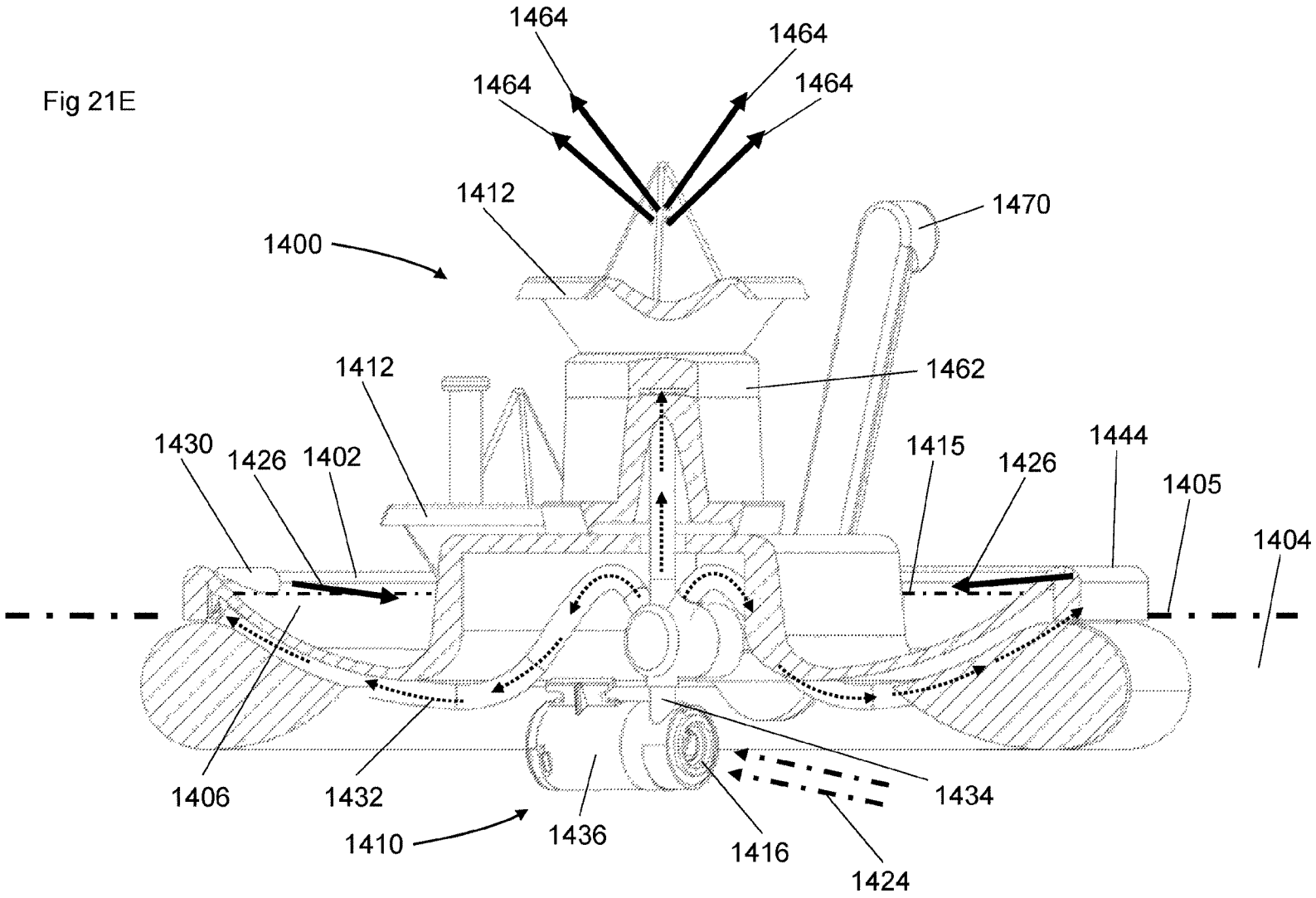
FIG. 21E is a simplified partially cut-away pictorial illustration of the joystick-controlled water toy of FIGS. 21A-21D in one operative orientation, taken along section lines E-E in FIG. 21C.
Figure 21F:
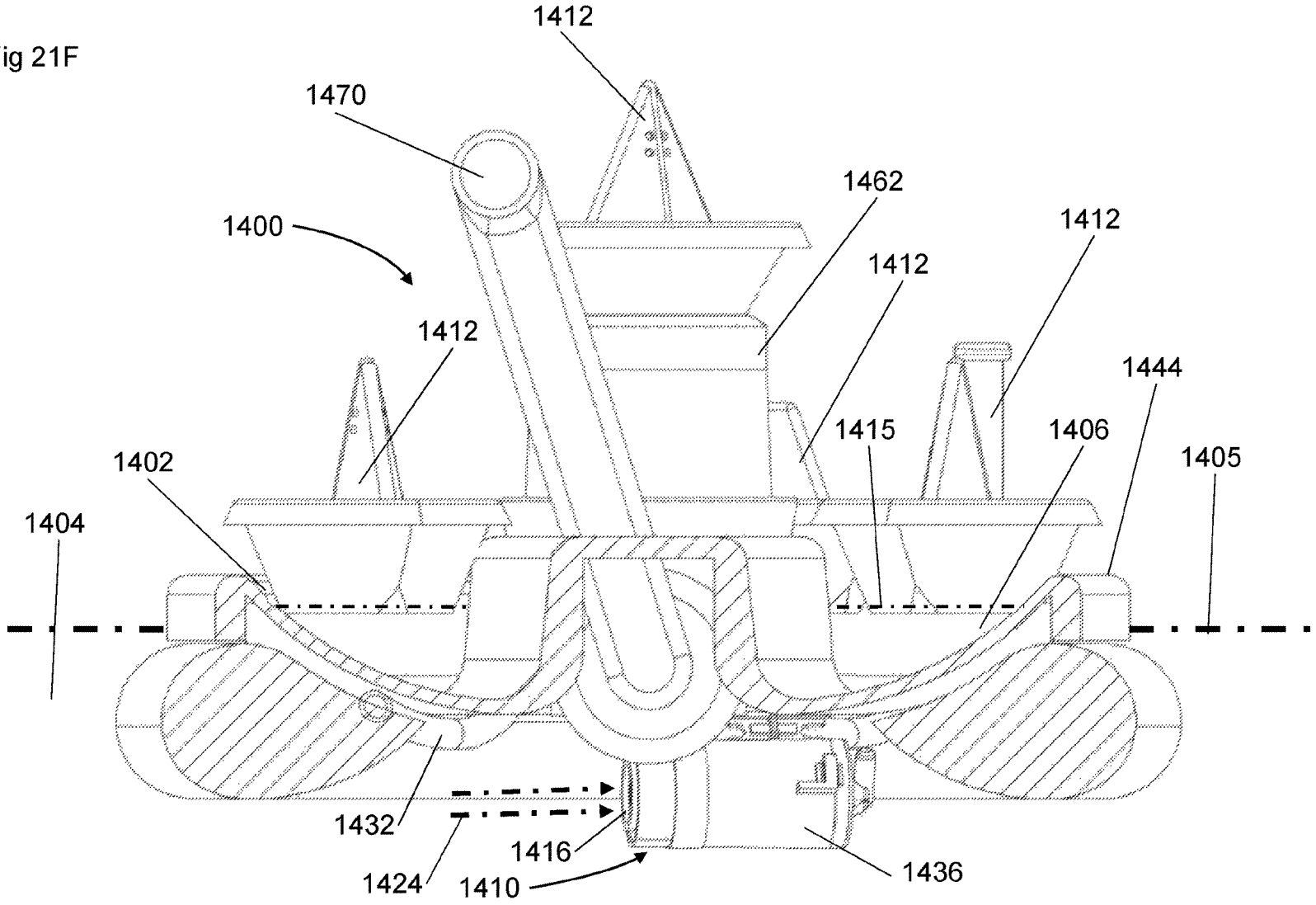
FIG. 21F is a simplified partially cut-away pictorial illustration of the joystick-controlled water toy of FIGS. 21A-21D in another operative orientation, taken along section lines F-F in FIG. 21C.

Reference is now made to FIGS. 21A, 21B, 21C and 21D, which are simplified pictorial illustrations of four operative orientations of a joystick operated floating water toy constructed and operative in accordance with an embodiment of the present invention; to FIG. 21E, which is a simplified sectional illustration of the multi-media joystick-controlled water toy of FIGS. 21A-21D, taken along lines E-E in FIG. 21C in a first operative orientation and to FIG. 21F, which is a simplified sectional illustration of the multi-media joystick-controlled water toy of FIGS. 21A-21D, taken along lines F-F in FIG. 21C in a second operative orientation.

As seen in FIGS. 21A-21F, there is provided a water toy system 1400, preferably a bath toy, including a water play space delimiter, preferably in the general form of a bowl 1402, preferably arranged to be located in a water-filled bath region 1404, having a nominal water line 1405, and to define an at least partially water-filled water play space 1406, separate from a remainder of the water filled bath 1404.

A water spray generating assembly 1410 generates at least one, and preferably two, pressurized water sprays and/or currents within the water play space 1406 and at least one, and preferably a few, floatable fanciful elements, such as toy boats 1412, are arranged to be floatable on water within the water play space 1406.

In the illustrated embodiment, the water space delimiter may be a concave enclosure or bowl 1402 of any suitable desired shape. It is preferably freely floating on the water in the bath region 1404. A principal function of the water space delimiter is to restrict the range of movement of the floatable fanciful elements to within a desired water play space, preferably in front of a child. Another function of the water space delimiter is to define a relatively calm water surface in the water play space 1406. In this embodiment, a further function of the delimiter is to raise at least part of the water play space 1406 to a height above that of the bath region 1404, such that a water line 1415 of the water play space 1406 is decoupled from the water line 1405 of the bath region 1404 and may be above or below water line 1405. In the illustrated embodiment, the water line 1415 is seen to be above water line 1405.

The water spray generating assembly 1410 is preferably integrally formed with delimiter 1402 and is located therebelow and at the center thereof. Water spray generating assembly 1410 preferably draws water, via a water inlet 1416, from outside the water play space 1406 and below the delimiter, as illustrated by arrows 1424, and directs two streams of pressurized water under water line 1415 into the water play space 1406, in a non-radial direction, which may be tangential to a generally circular area defined by the deliminter, as indicated by arrows 1426, for creating a preferably circular current and preferably intermittently impinging on an underwater portion of each of toy boats 1412, thereby displacing the toy boats 1412 in an endless circular loop.

In the illustrated embodiment of FIGS. 21A-21F, preferably the streams indicated by arrows 1426 exit from nozzles 1430, which are coupled by piping 1432 to the outlet 1434 of a battery-operated water pump 1436 which receives water via water inlet 1416, all of which form part of the water spray generating assembly 1410, thereby generating a water current in an endless loop, as indicated by arrows 1440, for displacing the floatable fanciful elements, such as toy boats 1412, in endless loop motion.

In the embodiment of FIGS. 21A-21F, the water play space 1406 is defined by the bowl 1402 in area and in depth. The water play space 1406 may be considered to extend above the water line 1405 of the bath region 1404 and above the water line 1415 of the water play space 1406, preferably to a height to which the top surface of the delimiter extends, here designated by reference numeral 1444. Alternatively, the water play space may be considered to extend above height 1444 to a maximum height reached by floatable elements, such as toy boats 1412.

In the illustrated embodiment, the water space delimiter may be entirely freely floatable or alternatively may be floatable and tethered so that it can rotate but is not displaced from a given general location in the bath.

It is a particular feature of this embodiment of the invention that at least some of nozzles 1430 provide a water spray that has at least a non-radial component in the plane of the delimeter, which may be a tangential component, as shown by arrows 1426. Here this water spray is shown to be above the water line 1415 of the water play space 1406 and to impinge on floatable fanciful objects, such as toy boats 1412, preferably causing them to be displaced in a generally circular motion indicated by arrows 1440 along a track defined by the sprays indicated by arrows 1426 and by the delimiter. The reaction force of the preferably tangential sprays indicated by arrows 1426 causes a corresponding rotation of the remainder of the water toy system including the delimiter in a direction indicated by arrows 1452.

If the delimiter is free floating, the mutually counter rotations of the floatable fanciful objects, such as toy boats 1412, indicated by arrows 1440, and of the remainder of the toy system, indicated by arrows 1452, may continue as long as the sprays along arrows 1426 are provided. If, however, the delimiter is tethered, eventually the counter torque in the tether resulting from the rotation of the delimiter will cause its rotation to stop and rotation in an opposite direction to commence. This back rotation of the delimiter will enhance the rotation force applied to the objects, such as toy boats 1412, by the sprays along arrows 1426. The back rotation of the delimiter will continue until the torque falls below a threshold that will allow rotation of the delimiter as indicated by arrows 1452 to commence again. This cyclic rotational motion will continue as long as the non-radial sprays along arrows 1426 are provided.

It is appreciated that alternatively, the sprays along arrows 1426 may be replaced by underwater positive water flows in the same direction, with generally the same effects as those described hereinabove.

In the embodiment of FIGS. 21A-21F, the water spray generating assembly 1410 also preferably provides a generally vertical spray 1460 from a nozzle 1462. Nozzle 1462 is preferably configured for selectably receiving in engagement therewith one of a plurality of floating unlistable and unsinkable mutually differently fanciful spray modulating objects, such as toy boats 1412, which are selectably placeable in water spray receiving engagement with nozzle 1462 of the water spray generating assembly 1410 and which are operative to convert vertical water spray 1460 having a first spatial configuration received at at least a first location thereat to a water spray 1464 having a second spatial configuration emitted at at least a second location thereat which is different from said first spatial configuration. A preferred embodiment of such a floating unlistable and unsinkable mutually differently fanciful spray modulating object, such as toy boats 1412, may be essentially similar, except for fanciful features, to that of toy ducks 530 described hereinabove with reference to FIG. 8A-9C, it being appreciated that various such objects preferably each have a differently configured outlet spray.

It is a particular feature of the spray modulating objects, such as toy boats 1412, irrespective of their fanciful configuration and their output spray arrangement, that they are floating, unlistable and unsinkable. These properties preserve their play value and are the result of the provision of at least one, and preferably more, volumes filled with a buoyant material, such as a gas or a closed cell foamed plastic material.

A young child operable joystick 1470 is pivotably mounted onto the delimiter 1402 and operates a spray controller (not shown), such that variation of the orientation of the joystick 1470 can be used to provide various spray options. For example, as seen in FIG. 21A, the joystick 1470 is in a first, generally vertical, operative orientation, which is a right directed orientation, from the perspective of FIG. 21A, as indicated by an arrow. In this operative orientation sprays are not provided and only non-radial flows, which produce motion of the toy boats 1412 in a first rotation direction and concomitant rotation of the delimiter in a second rotation direction, are provided.

As seen in FIG. 21B, with the joystick 1470 in a second position, only a generally vertical spray is provided and neither the toy boats 1412 nor the delimiter are driven in rotational motion. In the embodiment illustrated in FIG. 21B, one of the toy boats 1412 is placed over and in operative engagement with nozzle 1462 and provides a modified spray output as indicated by arrows 1464. In FIGS. 21C and 21E-21F, when the joystick 1470 is in a third position, all of the sprays of the examples of FIGS. 21A and 21B are simultaneously provided. Additionally, in the embodiment illustrated in FIG. 21C, one of the toy boats 1412 is placed over and in operative engagement with nozzle 1462 and provides a modified spray output as indicated by arrows 1464.

FIG. 21D shows the joystick 1470 in the second position, as shown in FIG. 21B, in which only a central vertical spray 1460 is provided.

It is noted that On/Off functionality is preferably not provided by the joystick 1470, but is preferably provided by an On/Off button 1480.

Figure 22B:
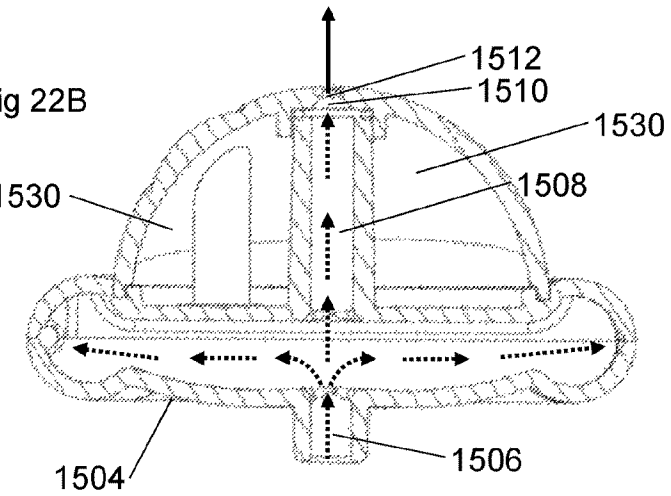
FIGS. 22A, 22B and 22C, illustrate a self rotatable fanciful floatable unsinkable and unlistable object useful in the embodiments of FIGS. 8A-8D, 9A-9C, 10A-10C, 11A-11C, 17A-17C, 19A-19C, 20A-20F and 21A-21F, FIGS. 22B and 22C being sectional illustrations taken along respective lines B-B and C-C in FIG. 22A.
Figure 22C:
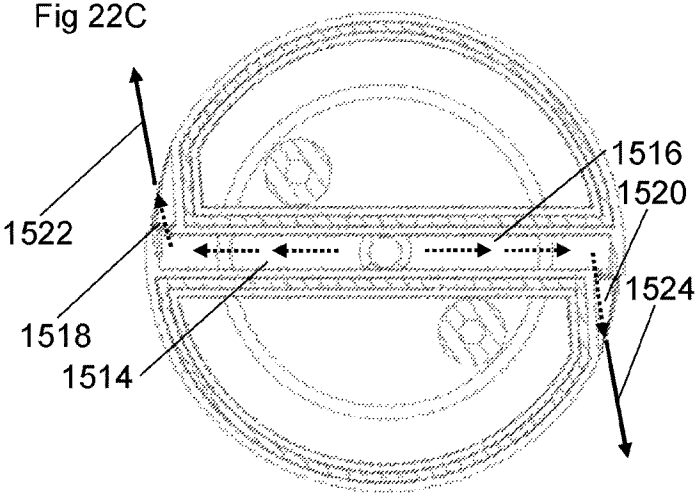
Figure 22A:
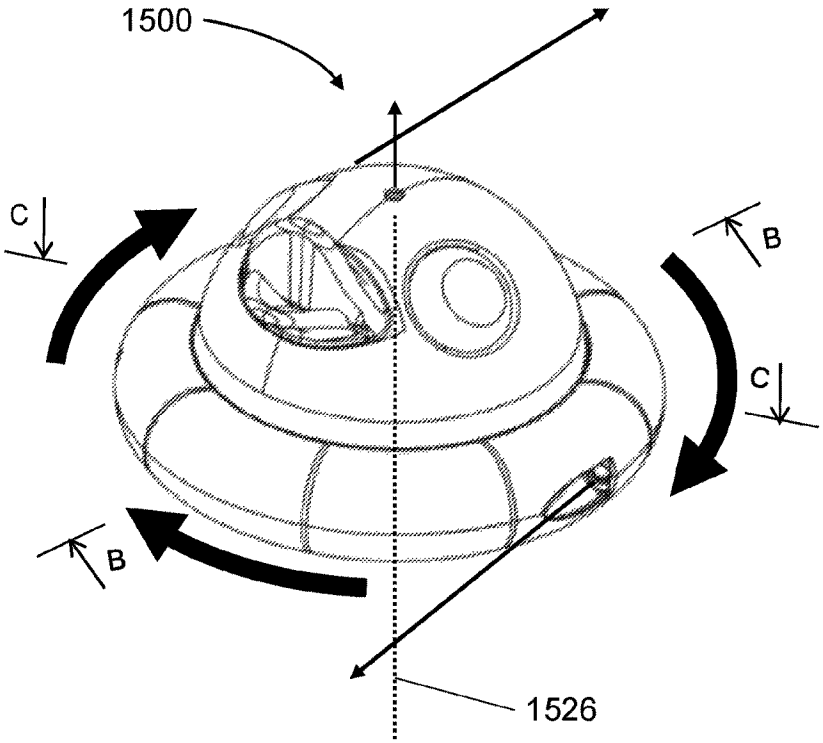

Reference is now made to FIGS. 22A, 22B and 22C, which illustrate a self rotatable fanciful object useful in the embodiments of FIGS. 8A-8C, 9A-9C, 10A-10C, 11A-11C, 17A-17C, 19A-19C, 20A-20F and 21A-21F, FIGS. 22B and 22C being sectional illustrations taken along respective lines B-B and C-C in FIG. 22A.

As seen in FIGS. 22A-22C, the self-rotating fanciful spray modulating object, here in the form of a duck 1500, preferably includes a bottom surface 1504 arranged to rotatably mate with a nozzle, such as nozzle 472 (FIGS. 8A-8C), and a conduit 1506 arranged to be inserted into a spray outlet aperture, such as spray outlet aperture 470 (FIGS. 8A-8C) of nozzle 472 for receiving a pressurized vertically upwardly directed flow of water therethrough. Conduit 1506 preferably terminates at an upward end 1508 thereof at an outlet 1510 having a spray outlet aperture 1512. Conduit 1506 preferably has a pair of branches 1514 and 1516 which terminate in respective non-radially directed outlet apertures 1518 and 1520, which produce water sprays along respective arrows 1522 and 1524, tangential to the outer periphery of the duck 1500, thus producing rotation of the duck 1500 about a central axis 1526 thereof, which is preferably an axis of symmetry of the duck 1500.

It is appreciated that the self-rotating spray modulating objects, such as duck 1500, irrespective of their fanciful configuration and their output spray arrangement, may also be floating, unlistable and unsinkable. These properties preserve their play value and are the result of the provision of at least one, and preferably more, preferably circumferentially disposed, sealed, gas filled compartments 1530. Alternatively, sealed gas filled compartments 1530 may be filled with a floatable material and need not be sealed.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

The invention claimed is:

1. A bath toy system comprising:

a water play space delimiter arranged to be located in a water-filled bath and to define a water play space separate from a remainder of the water filled bath;

a water spray assembly generating at least one water spray within said water play space; and at least one floatable fanciful element floatable on said water within said water play space, said water play space delimiter being a floating water play space delimiter; and said at least one water spray including at least one water spray including a non-radial component in a plane of said delimiter within said water play space and impinging at least intermittently on said at least one floatable fanciful element, thereby causing rotational displacement of said delimiter and said at least one floatable fanciful element in mutually opposite directions.

2. A bath toy system according to claim 1 and wherein said water spray assembly has a water inlet drawing water from a location within said water-filled bath but outside said water play space.

3. A bath toy system according to claim 1 and wherein said at least one floatable fanciful element is selectably placeable in water spray receiving engagement with said water spray assembly and is operative to convert a water spray having a first spatial configuration received at at least a first location thereat to a water spray having a second spatial configuration emitted at at least a second location thereat which is different from said first spatial configuration.

4. A bath toy system comprising:

at least one floatable fanciful element floatable on water within a water-filled water play space; and a floatable and rotatable water spray assembly generating at least one water spray including a non-radial component in a plane defined by said water spray assembly within said water-filled water play space and impinging at least intermittently on said at least one floatable fanciful element, thereby causing rotational displacement of said water spray assembly and said at least one floatable fanciful element in mutually opposite directions.

5. A bath toy system according to claim 4 and wherein said at least one floatable fanciful element is selectably placeable in water spray receiving engagement with said water spray assembly and is operative to convert a water spray having a first spatial configuration received at at least a first location thereat to a water spray having a second spatial configuration emitted at at least a second location thereat which is different from said first spatial configuration.

6. A bath toy system according to claim 5 and wherein:

said water spray assembly generates said at least one water spray above a water level within said water play space;

said water spray assembly also generates at least a second water spray;

said plurality of floatable fanciful elements are floatable on said water within said water-filled water play space and are intermittently impinged by said at least a second water spray; and each of said plurality of mutually differently fanciful spray modulating objects define at least one generally vertical water spray traversal channel extending from said first location to said at least a second location.

7. A bath toy system comprising:

a water spray assembly generating at least one water spray within an at least partially water-filled water play space; and at least one floating, unsinkable and unlistable fanciful spray modulating object which is selectably placeable in water spray receiving engagement with said water spray assembly and which is operative to convert a water spray having a first spatial configuration received at at least a first location thereat to a water spray having a second spatial configuration emitted at at least a second location thereat which is different from said first spatial configuration.

8. A bath toy system according to claim 7 and wherein said at least one fanciful element includes a plurality of fanciful elements, said plurality of fanciful elements comprising at least one of:

a plurality of mutually differently fanciful spray modulating objects; and a plurality of floatable fanciful spray modulating objects in which each of said plurality of fanciful spray modulating objects produce a water spray having a spatial configuration which is different from that produced by another one of said plurality of fanciful spray modulating objects.

9. A bath toy system according to claim 7 and wherein said water spray assembly is adapted to be floating and to be operative for generating at least one water spray impinging at least intermittently on at least one floatable fanciful element, thereby causing rotational displacement of said water spray assembly delimiter and said at least one floatable fanciful element in mutually opposite directions.

10. A bath toy system according to claim 7 and wherein:

said water play space defines an endless loop; and said at least one fanciful spray modulating object is floatable in said at least partially water-filled water play space defining an endless loop and is drivable by at least one water spray generated by said water spray assembly in looped motion along said endless loop.

11. A bath toy system comprising:

a water spray assembly generating at least one water spray within an at least partially water-filled water play space; and at least one self-rotatable fanciful spray modulating object which is selectably placeable in water spray receiving engagement with said water spray assembly and which is operative to self-rotate when placed in operative engagement with said at least one water spray and to convert a water spray having a first spatial configuration received at at least a first location thereat to at least one first water spray having a second spatial configuration emitted at at least a second location thereat which is different from said first spatial configuration and at least one second water spray directed so as to produce rotation of said object.

12. A bath toy system according to claim 11 and wherein:

said water play space defines an endless loop; and said at least one fanciful spray modulating object is floatable in said at least partially water-filled water play space defining an endless loop and is drivable by at least one water spray generated by said water spray assembly in looped motion along said endless loop.

13. A bath toy system comprising:

a water play space delimiter arranged to be located in a water-filled bath and to define a water play space separate from a remainder of the water filled bath;

a water spray assembly generating at least one water spray within said water play space;

at least one floatable fanciful element floatable on said water within said water play space; and a child-operable joy stick controlling multiple operational parameters of said water spray assembly.

14. A bath toy system according to claim 13 and wherein said child-operable joy stick is operative to select at least one of:

a pulsed or a continuous water spray;

a time pattern of at least pulsed sprays of varying amplitude; and an amplitude of a water spray produced by said water spray assembly.

15. A bath toy system comprising:

a water spray assembly generating at least one water spray within an at least partially water-filled water play space; and a child-operable joy stick controlling multiple operational parameters of said water spray assembly.

16. A bath toy system according to claim 15 and also comprising:

a multimedia generator providing at least one of audible and visually sensible outputs; and wherein:

said child-operable joy stick also governs the operation of said multimedia generator.

17. A bath toy system comprising:

a water play space delimiter arranged to be located in a water-filled bath and to define a water play space separate from a remainder of the water filled bath;

a water spray assembly generating at least one water spray within said water play space;

at least one floatable fanciful element floatable on said water within said water play space; and a spray parameter linked sound and light generating system operative to provide audible and visual outputs in time coordination with at least one operational parameter of said water spray assembly.

18. A bath toy system comprising:

a water play space delimiter arranged to be located in a water-filled bath and to define a water play space separate from a remainder of the water filled bath;

a water spray assembly generating at least one water spray within said water play space; and at least one floatable fanciful element floatable on said water within said water play space, said water spray assembly having a water inlet drawing water from a location within said water-filled bath but outside said water play space.

19. A bath toy system comprising:

a water play space delimiter arranged to be located in a water-filled bath and to define a water play space separate from a remainder of the water filled bath;

a water spray assembly generating at least one water spray within said water play space; and at least one floatable fanciful element floatable on said water within said water play space, said at least one floatable fanciful element being selectably placeable in water spray receiving engagement with said water spray assembly and being operative to convert a water spray having a first spatial configuration received at at least a first location thereat to a water spray having a second spatial configuration emitted at at least a second location thereat which is different from said first spatial configuration.

* * * * *